US005791652A

United States Patent [19]

Nielsen

[11] Patent Number: 5,791,652

[45] Date of Patent: Aug. 11, 1998

[54] DOMINO AND INTERCHANGEABLE SUIT CARDS, GAMES, AND METHODS OF PLAY

[76] Inventor: Rodney D. Nielsen, 10531 Kipling Way, Broomfield, Colo. 80021

[21] Appl. No.: 665,669

[22] Filed: Jun. 20, 1996

Related U.S. Application Data

[60] Provisional application No. 60/000,500, Jun. 26, 1995.

[51] Int. Cl.[6] ..... A63F 1/00

[52] U.S. Cl. ..... 273/305; 273/304

[58] Field of Search ..... 273/292, 303, 273/305

[56] References Cited

U.S. PATENT DOCUMENTS

| | | | |
|---|---|---|---|
| D. 83,342 | 2/1931 | Niederlitz . | |
| D. 212,239 | 9/1968 | Schick . | |
| 516,165 | 3/1894 | Paine | 273/305 |
| 645,961 | 3/1900 | Kingwell | 273/303 |
| 712,566 | 11/1902 | Moller . | |
| 821,781 | 5/1906 | Cudwaller . | |
| 4,170,358 | 10/1979 | Hancock . | |
| 4,588,193 | 5/1986 | Winston | 273/305 X |
| 5,280,916 | 1/1994 | Gleason . | |

FOREIGN PATENT DOCUMENTS

| | | | |
|---|---|---|---|
| 2191953 | 12/1987 | United Kingdom | 273/303 |

OTHER PUBLICATIONS

Sylvia Mann, Collecting Playing Cards, 1966 pp. 186–189, Bell, New York USA.

*Primary Examiner*—William E. Stoll

[57] ABSTRACT

A deck of playing cards, games, and methods of play to be used for play of conventional domino games and interchangeable suit or multiple denomination card games. The deck of cards is representative of a set of dominoes. The cards contain a primary indicia (30*a*), a secondary indicia (30*b*), and a tertiary indicia (30*c*). These indicia are located in positions that allow the player to clearly view and recognize all possible denominations of the cards when they are held in the typical fan-like fashion. Each indicia is composed of a first value (32*b*) and a second value (34*b*). These three indicia are each representative of the same domino and have corresponding orientations, with respect to their values. In many games, the method of play allows a player to choose either value for the suit and the other becomes the rank. The player can organize their cards by rotating them by 180 degrees, inverting the relative position of its values, to reflect a change in the desired suit.

15 Claims, 10 Drawing Sheets

DOMINO AND INTERCHANGEABLE SUIT CARDS, GAMES, AND METHODS OF PLAY

BACKGROUND—CROSS-REFERENCES TO RELATED APPLICATIONS

This application follows provisional patent application, Ser. No. 60/000,500, filed on Jun. 26, 1995.

BACKGROUND—FIELD OF INVENTION

This invention relates to dominoes, specifically to domino playing cards; it also relates generally to playing cards, specifically to multiple denomination playing cards where the suit and rank are interchangeable.

BACKGROUND—DESCRIPTION OF PRIOR ART

The use of conventional double-6, double-9, and double-12 domino tile sets of the previous art are well known. The dominoes are rectangular tiles made of wood, ivory, bone, stone, or plastic. A typical size is 1 in by 1⅞ in by ⅜ in. The dominoes have two halves marked by a line in the center and the halves may contain spots (also known as pips). In double-6 dominoes, every domino has from 0 to 6 spots on each half Tile dominoes suffer from several disadvantages including the following:

(a) They are extremely difficult to hold in the hand. People with small hands can generally only hold two or three dominoes.

(b) The impracticality of holding dominoes in your hand usually forces players to set the dominoes on their edge in front of the player on the playing surface. The first consequence of this is that it makes it very easy for other players to see your hand of dominoes. This limits the practical number of players to about 4.

(c) A second consequence of setting the dominoes on the table is to make it more difficult for people with impaired vision to recognize the value of the dominoes.

(d) A third consequence of setting the dominoes on the table is to use up more of the playing surface. This surface is already used at a considerable rate due to the nature of the way dominoes are played end to end on the playing surface.

(e) A fourth consequence of setting the dominoes on the table is that it makes playing the dominoes more difficult than playing them directly from your hand.

(f) The layout (or in-play configuration) of conventional tile dominoes takes up a large amount of space on the playing surface. In conventional matching games the dominoes are laid end to end in a non-overlapping fashion. They frequently cross the entire table and then must be played in a perpendicular direction in order to stay on the playing surface.

(g) The stock (or boneyard) of dominoes from which players must draw at the beginning of play (and in certain games when unable to play) also takes up a large amount of space. Again this is because none of the domino tiles can overlap and they are spread out across the table.

(h) Shuffling generally requires all players. Each player must push the face-down dominoes around on the table in an attempt to mix them.

(i) Shuffling has the additional draw back that it is possible for players to follow the location of certain key dominoes. This is especially true when there are only two players shuffling the dominoes.

(j) A third problem resulting from shuffling the dominoes by sliding them around is that they scratch the playing surface.

(k) A fourth problem resulting from shuffling the dominoes by sliding them around on the table is that the color on the spots wears off. This causes the dominoes to be unsightly. More importantly it renders them nearly impossible to recognize, making play extremely difficult.

(l) Even before the color wears off the dominoes many people find recognition of the dominoes very difficult. Due to this difficulty some consumers paint each group of spots a different color for easy comparison (e.g., ones red, twos blue, threes yellow, etc.)

(m) Dominoes are generally made of heavy material, the material is often easy to scratch or chip, the dominoes are generally stored on top of one another, and they are frequently dumped onto a hard playing surface when they are removed for play. All of these factors contribute to marks on the dominoes. These marked sets of dominoes are worthless for serious play. This leads to a number of disadvantages. The first disadvantage is that you may decide not to play dominoes if your deck is marked.

(n) A second disadvantage is that you may need to delay the game to go purchase a new set of dominoes. This is both an inconvenience and an extra expense.

(o) A third disadvantage comes from the fact that players draw their own hand of dominoes. A player may detect the marks and take dominoes that are more advantageous.

(p) Similarly, a player may detect the marks on other player's dominoes and make plays that are disadvantageous to the other player. This is relatively easy since players place all their dominoes in full view in front of them on the playing surface. This allows other players to see the entire back of their dominoes.

(q) Conventional tile dominoes take a considerable amount of storage due to their size.

(r) The storage requirements of dominoes also make it less desirable to carry them with you on vacation, to someone's house, or to another place of gathering.

(s) Conventional tile dominoes are more expensive to manufacture than cards.

Chinese domino cards exist that are not representative of conventional tile dominoes. Chinese domino cards suffer from several disadvantages including the following:

(a) Chinese domino cards are not intended to be used for playing conventional domino matching games and are not representative of conventional tile dominoes. Therefore, they cannot practically be used to play the conventional domino matching games. These games require the two values (sets of spots) of the domino to be at opposite ends of the domino. Chinese domino cards have both sets of spots at both ends of the card.

(b) Playing matching games is further rendered impractical because the set of spots at one end of the Chinese domino cards is in the opposite order of those at the other end (e.g., when holding the 2:3 domino card in a constant position, if the group of two spots are above or to the left of the group of three spots at one end of the card then they are below or to the right of the group of three spots at the other end of the card.)

(c) Chinese domino card decks consist of 21 cards with spots representing all feasible combinations when rolling two dice. These groups of 21 cards may be repeated in part or in whole within the deck. Chinese domino cards do not contain combinations where there are no spots or where there are more than six spots. Conventional tile domino sets contain a series of dominoes that are blank (that have no spots) at one end. The most widely used set of conventional dominoes is the double-6 set. This set contains 28 dominoes. These consist of the 21 pairs of values on the Chinese domino cards plus seven dominoes that are blank at one end and have from zero to six spots at the other end. There are two other popular sets of conventional tile dominoes. These are the double-9 and double-12 sets. These sets also contain several dominoes that are blank at one end. Additionally, these sets contain several dominoes with more than six spots at one or both ends. The lack of pairs of values where one or both values are blank or greater than six also prevents you from using Chinese domino cards to play conventional domino games.

(d) When Chinese domino cards are turned upside down they look the same as far as the spots are concerned (e.g., if you are holding the 2:3 domino card and the group of two spots are above or to the left of the group of three spots at the top of the card then when the card is turned over the top still has the same configuration.) This is because as mentioned above the configuration of spots at the two ends of the card are opposite to one another.

(e) Chinese domino cards are generally divided into two groups, military and civilians. The domino spots are usually colored red or green depending on the domino. Chinese domino cards usually contain an artistic design in their center that currently is non-utilitarian in nature. It is believed many of these cards originated as tarot cards and the designs had some significance. These cards are intended for use with a specific set of Chinese domino card games and are not very useful for any other card games.

(f) The value of Chinese domino cards are represented strictly by spots. This requires the player to recognize the pattern of spots or to count the spots to determine the card's value.

(g) Chinese domino cards are substantially longer than they are wide, with very round ends. The first consequence of this is that it makes it very difficult to shuffle the cards by most of the methods in common use.

(h) A second consequence of this non-standard size card is that it is more difficult to find manufactures that will produce the cards. Therefore, it is extremely likely that Chinese domino playing cards would be more expensive to have manufactured.

(i) A third consequence of this non-standard size playing card is that Chinese domino cards cannot be used with most of the playing card accessories currently on the market (e.g., most card trays, holders, boxes, etc.)

(j) A fourth consequence of this narrow playing card is that it is even more difficult to see the domino pattern than on tile dominoes.

(k) A fifth consequence of this non-standard size playing card is simply a lack of social acceptance in most countries.

U.S. Pat. No. Des. 83,342 to Niederlitz (1931) discloses a small illustration of a domino in the center of a card. The outer portion of the card has an indicia for a standard playing card (e.g., A of clubs), the next layer has the indicia for a different standard playing card (e.g., K of hearts), and the center has an illustration of a tile domino. These cards have several disadvantages including the following:

(a) The value of the dominoes on these cards is represented strictly by spots. They do not contain a secondary indicia that represents the domino. This requires the player to recognize the pattern of spots or to count the spots to determine the domino's value. Again this leads to the problem of making it extremely difficult to recognize the domino pattern, as with conventional tile dominoes and Chinese domino cards.

(b) The domino illustrations on these cards are very small. This compounds the problem of recognizing the domino pattern, especially for those with poor eye sight.

(c) The lack of a secondary indicia representative of the domino and the small illustration of the domino in the center of the cards leads to the inability to recognize the domino at all when the cards are held in the socially accepted fan-like fashion. In fact, the player cannot see any indication of the dominoes when holding the cards in this standard fan-like fashion, except on the front card.

(d) Since these cards cannot be held in the standard fan-like fashion they are extremely difficult to hold in the hand. People with small hands can generally only hold two or three of these cards and still see the domino illustration.

(e) These cards have an additional disadvantage over conventional tile dominoes in that players cannot set the cards on their edge on the playing surface. This sets a practical limit on the number of dominoes one can have during a game to a very small number, about five. This makes the cards much more difficult to use than conventional tile dominoes.

(f) The layout of these cards when used to play dominoes takes up a much larger amount of space on the playing surface even than tile dominoes. In conventional matching games these cards can only be overlapped slightly without covering up the only representation of the domino. The non-overlapping portion is slightly longer than a tile domino and about 2.5 times as wide. These cards will clutter the playing surface much more quickly than tile dominoes.

(g) This deck of playing cards does not include an illustration of the double-blank domino. The double blank is a standard domino in both the double-6 and double-9 sets of dominoes.

(h) These playing cards are crowded with information and are not easy to use. The extra indicia for two sets of standard 52-card decks distracts from the play of dominoes. It also gives the cards a less desirable appearance.

The use of a 52-card deck of single denomination poker cards to play a wide variety of card games is well known in the prior art. Names, ranking, and the four suits are also well known. Common disadvantages or objections to playing games with standard 52-card decks include:

(a) There are very few high value cards and they must be shared with all the other players in the game.

(b) Very few hands are perceived as winning hands. Therefore, games are not always very exciting.

(c) The hand that wins is often viewed as the least poor hand.

(d) Each of the cards in a standard 52-card deck has only one denomination.

(e) It is fairly easy to remember what important cards have been played previously in a hand.

(f) Due to the large number of cards, many games move slow and take a long time to complete.

(g) Most of the chance is determined by the deal or draw of the cards. There is very little chance associated with the play itself.

(h) These cards cannot be used for the play of domino games.

U.S. Pat. Nos. Des 212,239 to Schick (1968), 712,566 to Moller (1902), 821,781 to Cudwallader (1906), U.S. Pat. Nos. 4,170,358 to Hancock (1979), and 5,280,916 to Gleason (1994) disclose alterations to standard playing cards to provide double denomination cards. These cards generally are divided in half, with each half containing the representation of an additional card (e.g., one half of the card might represent the ace of spades and the other half of the card may represent the 2 of hearts.) These cards suffer from among the following disadvantages:

(a) Most of these cards have the indicia for the two denominations on opposite corners of the cards. This makes them difficult to use because you cannot see all of the denominations at once when the cards are held in the typical fan-like fashion.

(b) For the cards described in (a), play may require the selection of one denomination at the beginning of the game. In this case the players must spend a significant amount of time before play begins sorting through and analyzing their cards.

(c) For the cards described in (a), play may allow the selection of a denomination at the time the card is laid. In this case the players must either memorize all of the cards in their hand or sort through them every time they need to make a decision. This slows the game down tremendously and lessens its enjoyment.

(d) Even though there are twice as many denominations it still may be fairly easy to remember most of the important cards that have been played previously in a hand.

(e) Due to the large number of cards, many games move slow and take a long time to complete.

(f) These playing cards are crowded with information and are not easy to use. The extra indicia for two sets of standard 52-card decks is distracting. It also gives the cards a less desirable appearance.

(g) As with standard 52-card decks, most of the chance is determined by the deal or draw of the cards. There is little chance associated with the play itself.

(h) These cards cannot be used for the play of domino games.

(i) Due to the problems above and others these cards have the additional disadvantage that they have not gained social acceptance.

OBJECTS AND ADVANTAGES

Accordingly, several objects and advantages of the present invention in various embodiments are:

(a) to provide a physical representation of a conventional tile domino that allows a player to easily hold several dominoes in a single hand;

(b) to provide a domino that allows clear view of its value;

(c) to provide a domino that allows easier recognition of its value;

(d) to provide a domino that players with poor vision can recognize more easily;

(e) to provide a set of dominoes that allows a larger group of people to participate in a game;

(f) to provide a set of dominoes that allows a method of holding where a player's dominoes do not take up space on the playing surface;

(g) to provide a set of dominoes that allows a player to more easily play their dominoes;

(h) to provide a set of dominoes that allows a more compact layout, taking up less space on the playing surface;

(i) to provide a set of dominoes that allows the stock to be kept in a compact area that takes up less space on the playing surface;

(j) to provide a set of dominoes that allows a single player to shuffle;

(k) to provide a set of dominoes that are easy to shuffle;

(l) to provide a set of dominoes that allows a method of shuffling that makes it more difficult for players to cheat;

(m) to provide a set of dominoes that allows a method of shuffling that does not scratch the playing surface;

(n) to provide a set of dominoes whose spots or value representation is less likely to wear off;

(o) to provide a set of dominoes that are less likely to become marked;

(p) to provide a set of dominoes and method of play that makes it more difficult for players to cheat when they acquire their starting hand;

(q) to provide a set of dominoes and method of play that makes it more difficult for players to recognize slightly marked playing pieces;

(r) to provide a set of dominoes that can be stored more compactly;

(s) to provide a set of dominoes that encourages players to take them with when they vacation, visit friends, or go to other group meetings;

(t) to provide a set of dominoes that is inexpensive to manufacture;

(u) to provide a deck of cards that allows the practical play of domino games;

(v) to provide a deck of cards that is representative of and can easily be substituted for a set of conventional tile dominoes;

(w) to provide decks of domino cards that contain all of the cards in a double-6, double-9, or double-12 set of conventional tile dominoes, including the blanks and those values greater than six;

(x) to provide a domino card whose indicia values will be inverted when the card is inverted;

(y) to provide a deck of domino cards and a method of play that allows one to alter rules to use those domino cards to play standard card games intended for play with 52-card decks;

(z) to provide a deck of cards that in its preferred embodiment provides a numeric indicia to represent the value of a domino for easy recognition;

(aa) to provide a deck of domino cards that can be manufactured more readily than Chinese domino cards;

(bb) to provide a deck of domino cards that in their preferred embodiment can be more easily used with standard playing card accessories;

(cc) to provide a deck of domino cards that in their preferred embodiment will fit the norm of standard playing cards and so will be found socially acceptable;

(dd) to provide a deck of domino cards whose values can be easily recognized when the cards are held in the standard fan-like fashion;

(ee) to provide a deck of domino cards that are not crowded with other distracting features, such as indicia for standard 52-card decks;

(ff) to provide a deck of playing cards that has a large proportion of cards that can be played as high value cards;

(gg) to provide a deck of playing cards where many hands can be perceived as potentially winning hands, thus providing more excitement to the games;

(hh) to provide a deck of playing cards where each card can represent multiple denominations;

(ii) to provide a deck of playing cards where the suit and rank are interchangeable, that is either value could be the suit and the other value is then the rank;

(jj) to provide a deck of playing cards where it is more difficult to remember all of the important or highest ranking cards that have been played;

(kk) to provide a deck of playing cards and methods of playing games that can increase the speed at which games are played, thus increasing the number of games you can play, and your odds of winning a game;

(ll) to provide a deck of playing cards and methods of playing games that increase the role of chance in the games throughout the play;

(mm) to provide a deck of playing cards that allows you to recognize all of the denominations of a card when held in the typical fan-like fashion and without having to turn the card over, thus allowing for quick play and preventing the need to memorize a card's alternative denomination;

(nn) to provide a deck of playing cards and a method of play that allows the possibility of determining which of multiple denominations a player chooses for a card at the beginning of play;

(oo) to provide a deck of playing cards and a method of play that allows a player to easily recognize all denominations of a card, yet organize the cards according to a specific denomination;

(pp) to provide a deck of playing cards and a method of play that allows a player to choose which of a card's multiple denominations they want to use at the last moment of play;

(qq) to provide a deck of multiple denomination playing cards that are not crowded with multiple different indicia;

(rr) to provide a deck of multiple denomination playing cards that can also be used to play domino games as well as standard games for 52-card decks;

(ss) to provide a deck of playing cards and methods of play that can stimulate one to learn arithmetic through the playing of games;

(tt) to provide a deck of playing cards that can be grouped into pairs, where the total value of each pair is equivalent; and (uu) to provide a deck of playing cards that facilitates the play of new forms of rummy, solitaire, other sequence forming games, and matching games.

The above objects and advantages pertain to specific embodiments and should not be assumed for all embodiments of the present invention (e.g., the scope of the present invention includes a deck of playing cards representative of a set of double-9 dominoes, but this deck does not satisfy object (tt) above.) Further objects and advantages of my invention will become apparent from a consideration of the drawings and ensuing description.

DRAWING FIGURES

In the drawings, closely related figures have the same number but different alphabetic suffixes.

Figure 6:
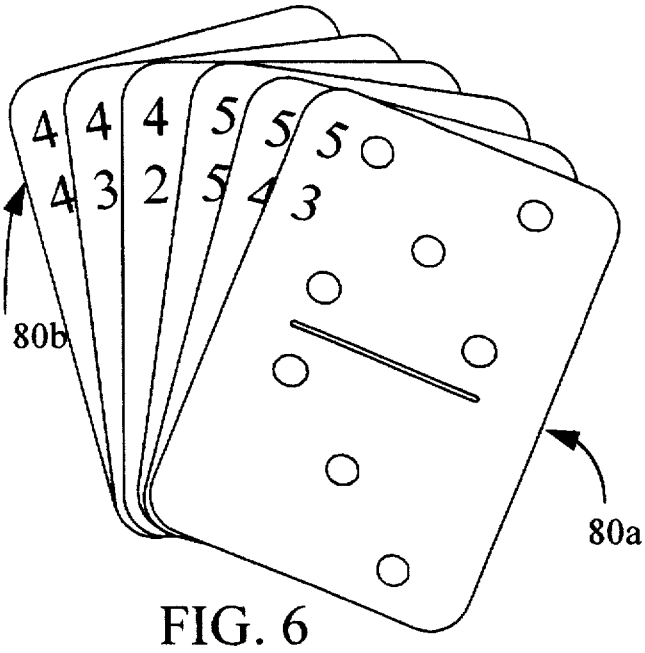

FIG. 6 is a view of a group of full card dominoes with a single secondary indicia. This group of cards represents a winning hand under one method of play of domino playing card rummy. The cards shown here are grouped in a typical fan-like fashion.

Figure 7:
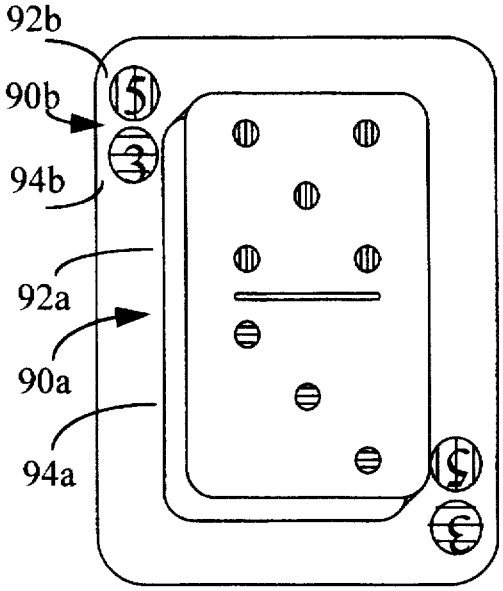

FIG. 7 is a view of a domino playing card where the values are color coded to allow even easier recognition for many people.

Figure 8:
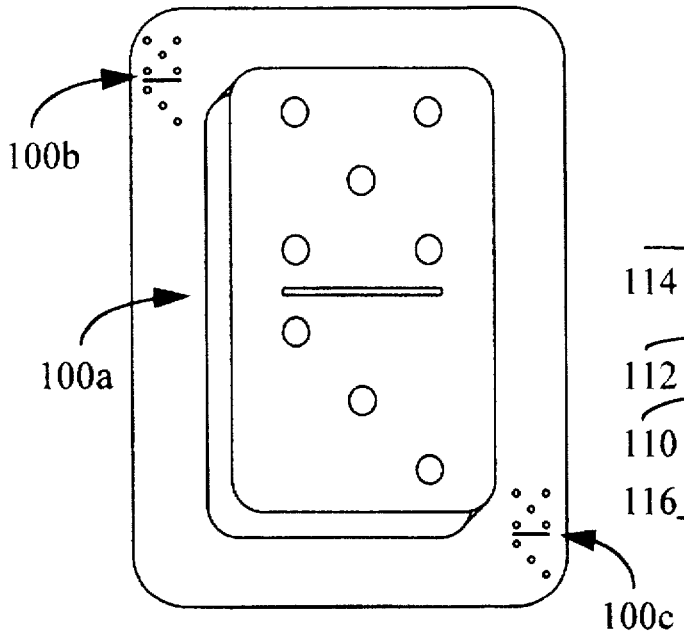

FIG. 8 is a view of an interchangeable suit domino card with non-numeric secondary indicia. The secondary indicia are representative of a conventional domino.

Figure 9:
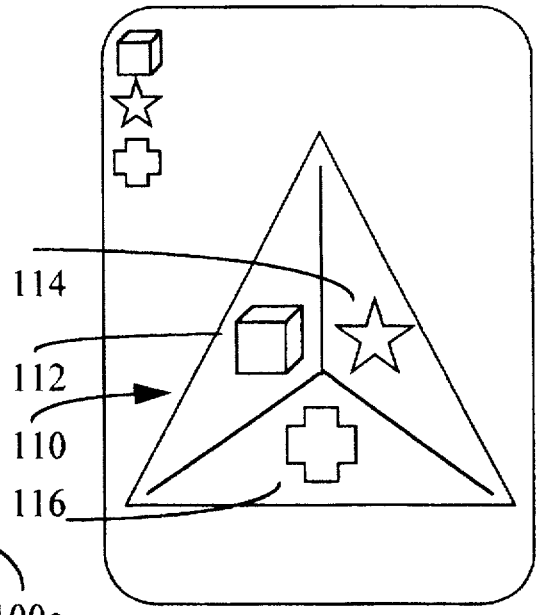

FIG. 9 is a view of an interchangeable suit card where the suits do not have numeric values. The figure shows a card with more than two suits.

Figure 10:
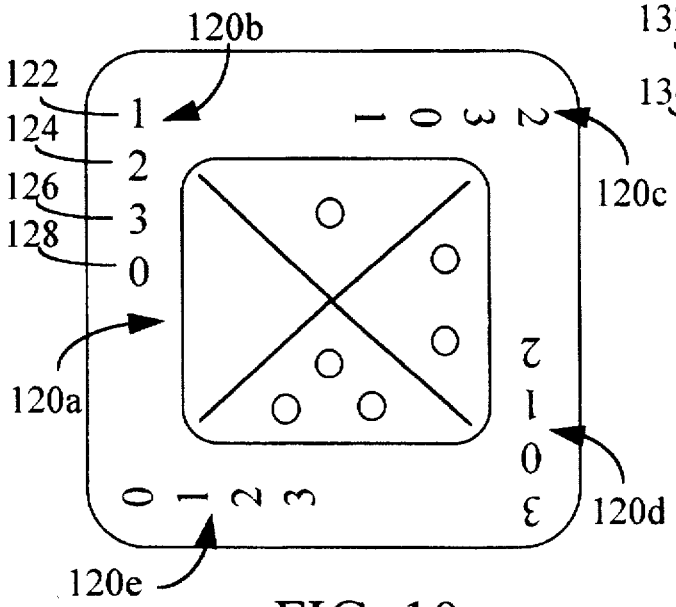

FIG. 10 is a view of an interchangeable suit card with four suits. The figure shows indicia in all corners of the card. These indicia represent the card fully, including the value associated with each position on the card relative to the given indicia.

Figure 11:
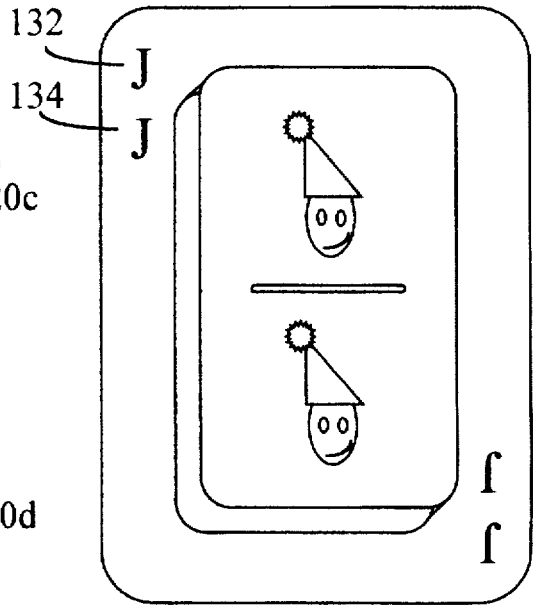

FIG. 11 is a view of a possible joker for the present invention.

Figure 12:
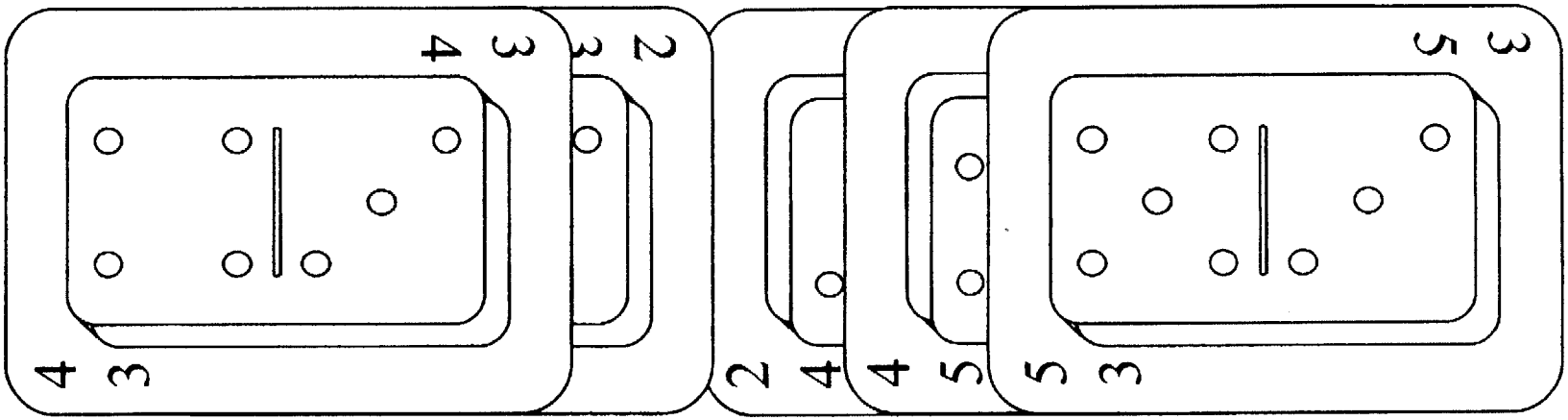
Figure 13A:
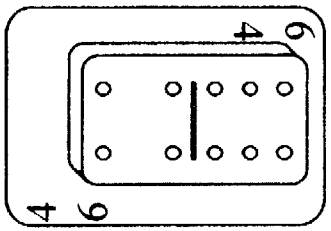
Figure 13B:
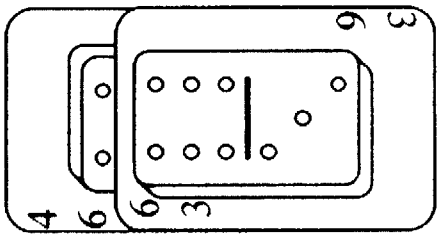
Figure 13C:
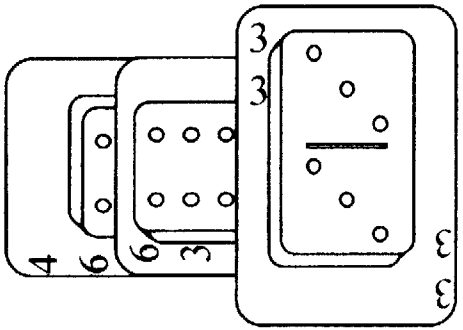
Figure 13D:
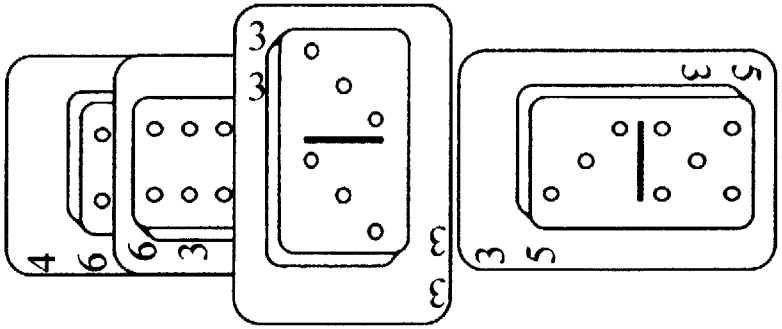
Figure 13E:
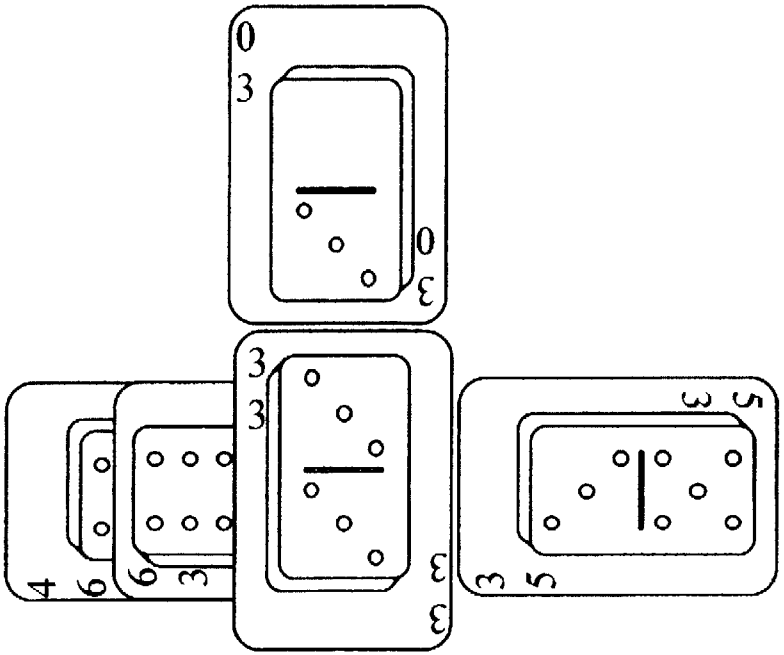

FIG. 12 is a view of overlapped cards played in conventional domino matching style.

FIGS. 13A to 13E are views of a series of play in a matching game where players score based on the sum of the values at the open ends of the layout.

Figure 14A:
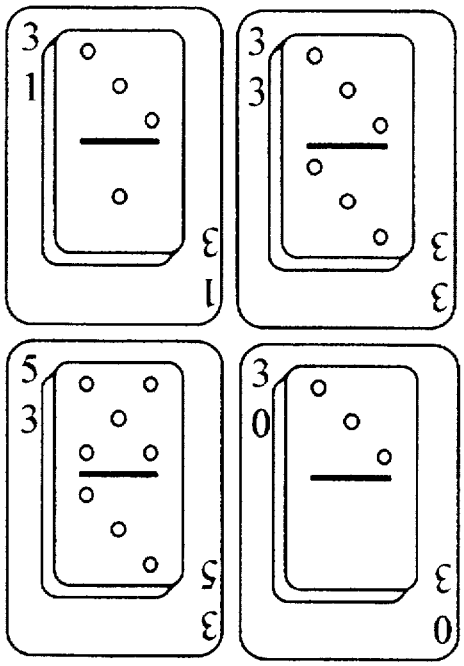
Figure 14B:
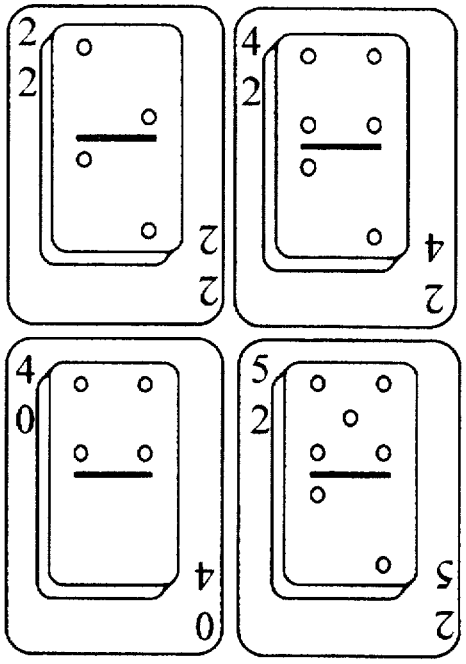
Figure 14C:
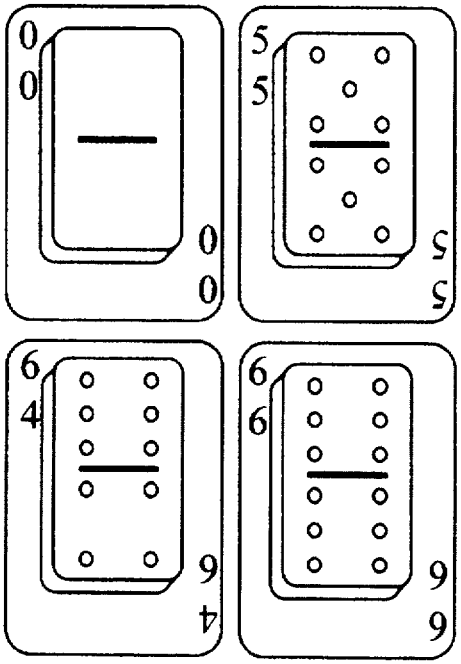

FIGS. 14A to 14C are views of a series of tricks in a trick taking game.

Figure 15:
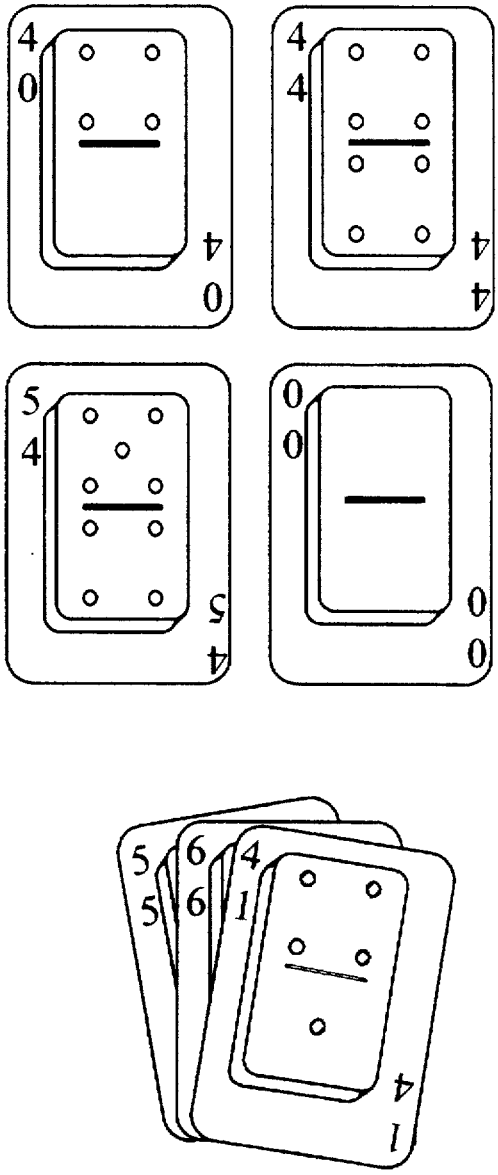

FIG. 15 is a view of a group of cards used to demonstrate the play of a game called Sweep Fives in the specification below.

Figure 16A:
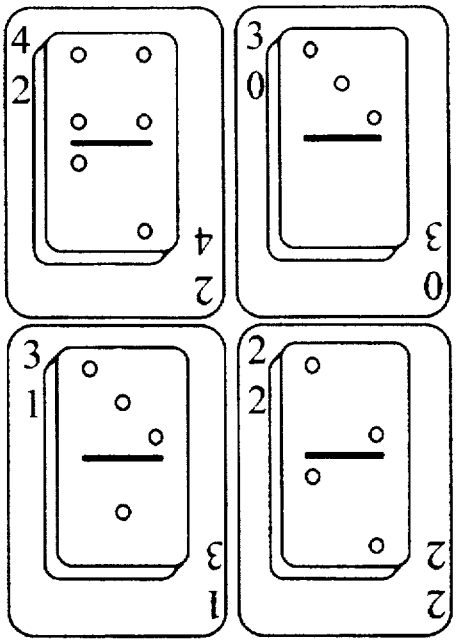
Figure 16B:
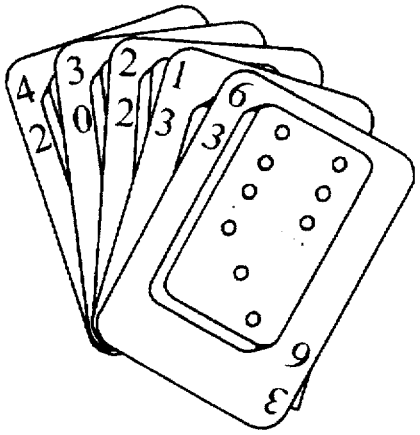
Figure 16C:
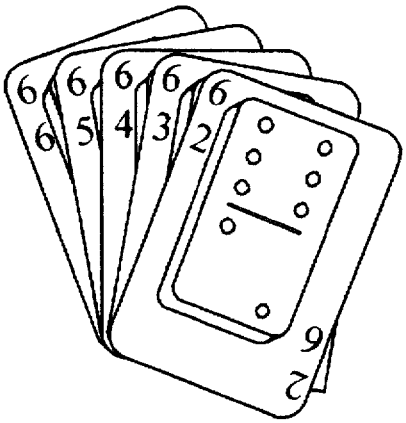

FIGS. 16A to 16C are views of hands in Poker games of the present invention.

SUMMARY

The present invention is a multiple denomination playing card deck, where a card's suit and rank are interchangeable. The present invention also includes methods of using this card deck. The deck is useful for playing domino games and many card games invented for the standard 52-card deck, as well as games invented specifically for play with the disclosed multiple denomination playing card deck.

Description of the Preferred Embodiment of the Cards and General Play—FIGS. 1 to 3, 6

Figure 1:
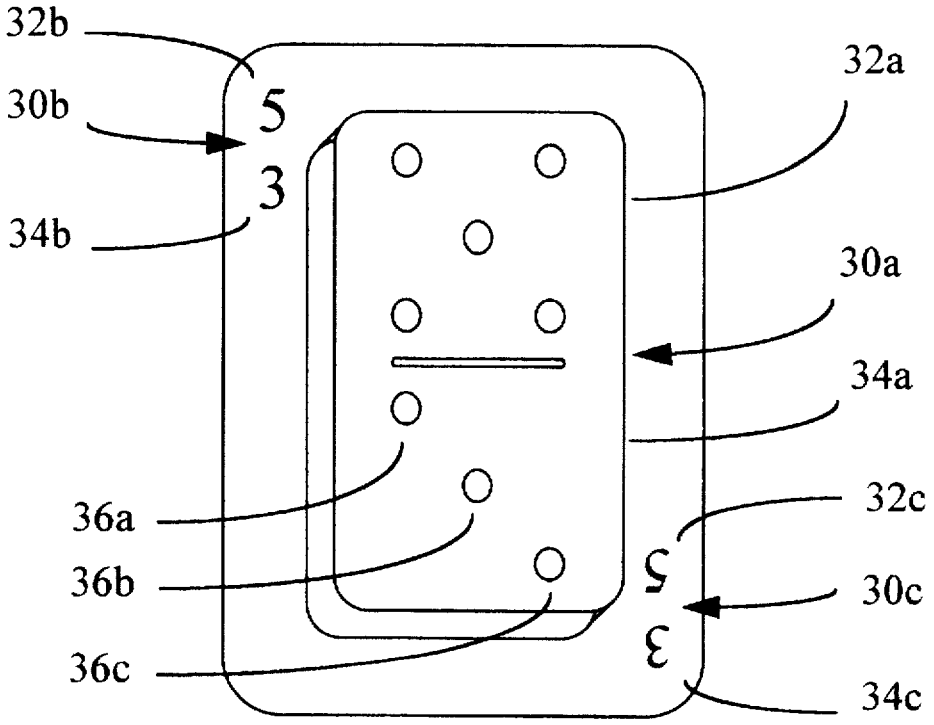
FIG. 1 is a plan view of the face of the preferred embodiment of my interchangeable suit and rank domino playing cards. The figure consists of three indicia 30*a*, 30*b*, and 30*c* that are representative of a single domino.

The preferred embodiment of a playing card of the present invention is illustrated in FIG. 1 (plan view.) The preferred embodiment of the card consists of a primary indicia 30*a*, a secondary indicia 30*b*, and a tertiary indicia 30*c*. In the preferred embodiment, primary indicia 30*a* is an illustration of a conventional domino and secondary indicia 30*b* and tertiary indicia 30*c* are numeric.

Secondary indicia 30*b* is located in a position that provides clear view and recognition of the card's denomination. In the preferred embodiment, secondary indicia 30*b* and tertiary indicia 30*c* are located in the upper left and lower right corners. In these locations you can clearly see at least one indicia on each card when they are held in a typical fan-like fashion (FIG. 6). In the preferred embodiment, primary indicia 30*a* consists of a first value 32*a* and a second value 34*a*. First value 32*a* of primary indicia 30*a* is represented in secondary indicia 30*b* by a first value 32*b*. There is a consistent first value 32*c* in tertiary indicia 30*c*. Similarly there are second values 34*b* and 34*c* of secondary indicia 30*b* and tertiary indicia 30*c* respectively that are representative of second value 34*a* of primary indicia 30*a*.

In the preferred embodiment, the orientation of indicia 30*a*, 30*b*, and 30*c* are consistent. That is first values 32*a*, 32*b*, and 32*c* are all on the same side of second values 34*a*, 34*b*, and 34*c* respectively. Thus when the card is rotated 180 degrees (turned upside down) the orientation of all three indicia 30*a*, 30*b*, and 30*c* is the inverse of its original orientation.

In the preferred embodiment, second value 34*a* of primary indicia 30*a* is represented by spots (or dots or pips) 36*a*, 36*b*, and 36*c*. Similarly, first value 32*a* is represented by a group of spots.

Figure 2:
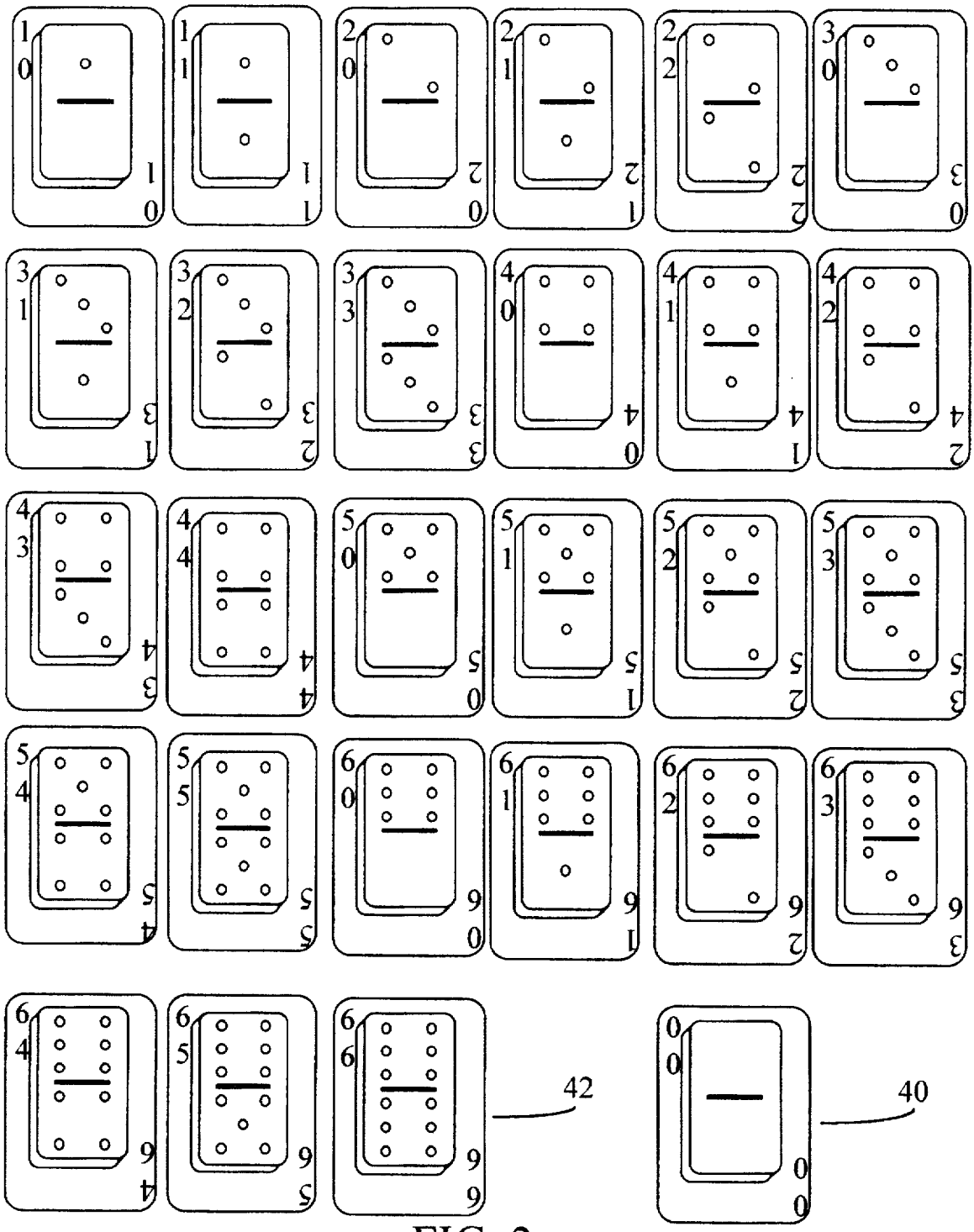
FIG. 2 is a plan view of a deck of interchangeable suit cards in their preferred embodiment, representative of a complete set of double-6 dominoes.

FIG. 2 shows the preferred embodiment of a deck of playing cards of the present invention. This deck is representative of a complete set of double-6 dominoes. The deck represents all possible combinations of the values zero through six taken two at a time. The heaviest domino (the one with the most spots) is a double six domino 42. The lightest domino is a double blank domino 40.

Figure 3:
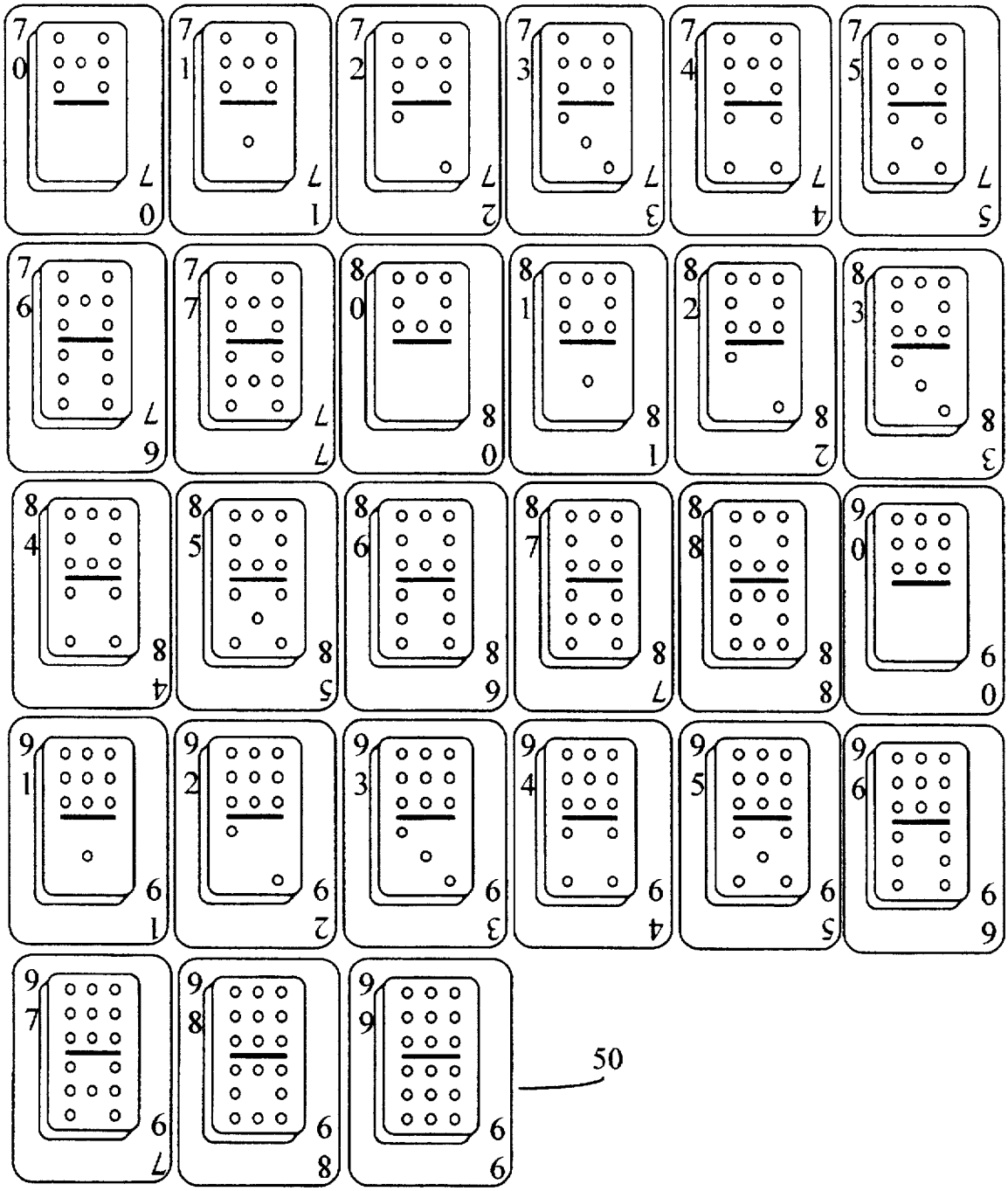
FIG. 3 is a view of the group of interchangeable suit cards that when combined with the cards in FIG. 2 are representative of a complete set of double-9 dominoes.

FIG. 3 shows the cards that must be combined with those in FIG. 2 to provide a complete set of double-9 domino playing cards. The resulting deck represents all possible combinations of the values zero through nine taken two at a time. The heaviest domino in this deck is a double nine domino 50.

Another highly desirable deck of domino playing cards is the double-12 set. This deck consists of all possible combinations of the values zero through twelve taken two at a time. The double-6, double-9, and double-12 decks are representative of the three most popular sets of conventional tile dominoes. Of course other non-conventional decks (e.g., a double-13 deck) are also covered by the present invention.

In the preferred embodiment these playing cards would be made of standard playing card paper, with a standard coating, and be the size of standard poker cards. However, it is clear a variety of other materials, coatings (or lack of a coating), and sizes would be suitable.

Operation General Play—FIGS. 1, 6

The instructions for a variety of games are disclosed in sections below. This section describes many of the common themes throughout the methods of play disclosed in other sections below. Most of the discussion here is in reference to the preferred embodiment, a domino playing card as shown in FIG. 1 and described above.

In the preferred embodiment, the playing cards are made of a non-abrasive, flexible, light weight, coated material. These cards can be made using the same manufacturing process as standard 52-card playing decks. This provides for readily available facilities and inexpensive production.

The number of players required for these games varies greatly. Some games are for partnership play and others are for individual play. Partnerships may be decided by any of the standard methods used in either dominoes or standard 52-card games. For example, the players could draw cards and the group with the heaviest dominoes form a team.

The cards can be stored in a standard playing card box. This provides for much more compact storage than what is possible with conventional tile dominoes. This reduction in storage volume contributes to a willingness among people to take card decks on vacation, to friend's homes, or to other gatherings. This is further achieved by the fact that playing cards have achieved greater social acceptance in many places than dominoes.

When cards are removed from their box they are less likely to be dumped out onto the playing surface. Due to this fact, the playing card material, and the method of shuffling described below, the cards are less likely to become marked.

The first dealer can be chosen by a number of methods. A common method is to draw dominoes and the player with the heaviest domino deals first.

Play begins by shuffling the cards. The present invention has the advantage that the dominoes are easy to shuffle. They may be shuffled like a standard 52-card playing deck. Only one player needs to shuffle the deck, although it is recommended that a second player cut the deck before the cards are dealt. The domino cards need not be slid around on the playing surface. This fact and the material composition of the cards significantly reduce the chance the dominoes will scratch the playing surface, during the shuffle or during play. Since the cards are shuffled and cut in this manner, it makes it more difficult for players to cheat by following the location of key cards. Additionally, this method of shuffling combined with the coating on the cards reduces the chance of the cards becoming marked during the shuffle.

After the shuffle and cut, players are dealt the appropriate number of cards. Players do not draw their own hand from a set of playing pieces whose backs are fully exposed. As with the shuffle and cut, the deal follows the standard of the 52-card playing deck. This prevents players from looking for and taking or avoiding particular marked cards. Since the cards of the present invention follow the standard poker size, in their preferred embodiment, they can be dealt from a card holder such as is standard at casino black jack tables.

After the deal, the remaining cards may be placed in a compact pile to form the stock. In conventional dominoes the remaining dominoes (often called the boneyard) are left scattered about on the playing surface. The compact stock achieved with playing cards provides a significant advantage when the playing surface is a small area.

The cards can be held in a player's hand in the typical fan-like fashion illustrated in FIG. 6. In the preferred embodiment, this provides an alternative physical representation of a conventional tile domino. These domino cards allow a player to easily hold several dominoes in a single hand. It is feasible with an appropriate secondary indicia 80*b* to hold an entire deck of double-6 dominoes (28 cards) in a single hand and maintain clear view of each domino's value. This is a significant advantage over tile dominoes and the cards disclosed in U.S. Pat. No. Des. 83,342 to Niederlitz (1931). Using this prior art, a player with small hands can hold only about three or four dominoes in their hand and still have clear view of the value of the dominoes.

Tile dominoes are generally placed on their edge in front of the player on the playing surface. Domino playing cards provide a number of advantages over this method of holding your playing pieces that in general make play easier. It is easy for a player to conceal their hand. The cards can be folded up so only one card is visible. They can easily be placed face down on the table and picked back up as a group. They can be held close to or against the player's body. This makes it easier to play with a larger number of players and still conceal your cards. While in the hand, the cards do not take up any additional space on the playing surface.

Holding the cards in your hand at all times allows players with poor vision to more easily adjust the cards to the appropriate distance to recognize their value. This can be done with all cards simultaneously, rather than one domino at a time. In the preferred embodiment, recognition of the value of cards is made even easier by the numeric indicia. In this case, you need not count the spots to determine a domino's value. The domino cards are clearly labeled with their numeric value. This is also a significant advantage to players whose vision sometimes causes them to see double or to have spotted vision, both of which complicate counting spots on the cards. In the preferred embodiment, the domino cards are not crowded with indicia and illustrations that reference a standard 52-card deck or other information. This provides for a less distracting game and makes clear recognition of the card's value even easier.

The backs of domino tiles setting on the playing surface are exposed to the view of other players. Holding your cards in a fan-like fashion makes it much more difficult to see marks on the back of the playing pieces. This is because only a small portion of the back of each card is visible. Most of the back of each card is either covered by another card or the player's hand.

The first play is dependent on the specific game. Generally the player to the left of the dealer can play any card in their hand to start the game. Some games require that the player with a specific card (e.g., the player with the double six) begin by playing that card. Some games require that the first card or set of cards be played face-up from the stock. Other methods of beginning the play will become apparent in reading the game instructions in other sections.

The remainder of play is highly dependent on the method of play or on the specific game you are playing. These aspects of play are detailed below under their method of play.

In the preferred embodiment, the use of these interchangeable suit playing cards is practical in the play of both domino games and games for 52-card decks. The cards are particularly well suited to play new forms of rummy, solitaire, other sequence forming games, and matching games. The following sections provide detail on the method of play for several categories of these games. The instructions in those sections are not the final nor necessarily complete instructions for the games. They are included to provide more detail regarding the methods of play.

Description of Preferred Embodiment and Matching Method of Play—FIGS. 1 to 3, 6, 12

The preferred embodiment of the playing cards of the present invention is as described above under the title "Description of Preferred Embodiment of Cards and General Play—FIGS. 1 to 3, 6" and as illustrated in FIG. 1.

The "matching" method of play requires that a player match a pattern from one of their dominoes to the end of the layout. FIG. 12 shows a feasible layout after five cards have been played. The players can lay the cards in a method such that they overlap and only the indicia of the bottom card is exposed. One value from a card laid must match an end value of the layout. It is on this end of the layout that the player must lay the card. They must place the cards such that the matching numbers are adjacent. In this example, the next player must have a card with either a four or a three on it, in order to play.

In the preferred embodiment shown in FIG. 1, primary indicia 30*a* consists of a first value 32*a* and a second value 34*a*. First value 32*a* of primary indicia 30*a* is represented in secondary indicia 30*b* by a first value 32*b*. There is a consistent first value 32*c* in tertiary indicia 30*c*. Similarly, there are second values 34*b* and 34*c* of secondary indicia 30*b* and tertiary indicia 30*c* respectively that are representative of second value 34*a* of primary indicia 30*a*.

In the preferred embodiment, the orientation of indicia 30*a*, 30*b*, and 30*c* are consistent. That is first values 32*a*, 32*b*, and 32*c* are all on the same side of second values 34*a*, 34*b*, and 34*c* respectively. Thus when the card is rotated 180 degrees (turned upside down) the orientation of all three indicia 30*a*, 30*b*, and 30*c* is the inverse of its original orientation.

In the preferred embodiment, secondary indicia 30*b* and tertiary indicia 30*c* are placed in a manner that allows the method of overlapping the cards discussed above. These cards and method provide that the primary indicia is in the appropriate orientation and only the indicia of the bottom card need be visible.

More detail regarding the method of play will become apparent in the operation section that follows.

Operation Matching Method of Play—FIGS. 1 to 3, 6, 12 to 13E

The preliminary methods of play are as defined in the section above titled "Operation General Play—FIGS. 1, 6." The general concept of the matching method of play is that players try to match a pattern on one of their cards to the pattern at one end of a layout on the playing surface.

FIG. 12 depicts a feasible layout after 5 cards have been played in a conventional domino matching game. The values of the dominoes from the top to the bottom of the layout are 3, 5, 5, 4, 4, 2, 2, 3, 3, 4. All of the values in this sequence are in matched pairs except the first and last values. This is specifically because a player must have a matching value on a card in order to lay it down. Furthermore, they must lay it so that the two matching numbers are adjacent.

Generally a player may play at either end of the layout. In some games players lay the first double (card with two identical values) perpendicular to the previous line of play (i.e., instead of laying a card length-ways they lay it side-ways.) In some games this opens up two additional ends of play. FIGS. 13A to 13E depict this method of play. This will become more clear in the game instructions that follow. In solitaire games, a player generally plays on just one end of the layout.

In the preferred embodiment shown in FIG. 1, all three indicia 30*a*, 30*b*, and 30*c* have corresponding orientations and they are representative of conventional tile dominoes. If these domino cards are rotated 180 degrees tertiary indicia 30*c* moves into the location where secondary indicia 30*b* was. The values in this location are now the inverse of the values that were there with respect to their orientation (e.g., if the card of FIG. 1 is rotated 180 degrees, then the values in the upper left corner are changed from five over three to three over five.) This makes it practical to play conventional matching domino games.

This is a major advantage over Chinese domino cards. Chinese domino cards are not representative of conventional western domino tiles. Chinese domino cards do not have a first value at one end and a second value at the other end. Each end of the card has both values. The indicia on the second end are a 180 degree rotation of those on the first end. Therefore, when a Chinese domino card is rotated 180 degrees the indicia on the upper half of the domino is the same as it was before the rotation. This renders them impractical to play conventional domino games.

In the preferred embodiment of a deck of cards of the present invention (FIG. 2), all possible combinations of the values zero (or blank) through six are represented. This is representative of the conventional double-6 domino set. FIG. 3 shows those additional cards required to complete the double-9 domino set. It is clear that you could add cards to this group to create a double-12 set. Chinese domino cards do not have combinations with the blank or zero value. They also do not provide combinations of values higher than six. Only those combinations of values possible in the roll of two dice are used. U.S. Pat. No. Des. 83,342 to Niederlitz (1931) also does not include the double blank domino. This makes the Niederlitz and Chinese domino cards undesirable for playing conventional domino games.

In the preferred embodiment shown in FIG. 1, there is a secondary indicia 30*b* and tertiary indicia 30*c*. These indicia are located in positions on the card that allow a player to lay the cards in an overlapping fashion (FIG. 12). A layout in this fashion provides the advantage of taking up less space on the playing surface. Since players must lay tile dominoes end to end, the layout crosses the playing surface very quickly. Similarly, since the cards of U.S. Pat. No. Des. 83,342 to Niederlitz (1931) do not have a secondary indicia representing the domino, players must essentially lay them end to end taking up even more room than the tiles.

In the example layout in FIG. 12, if the next player has a card with a value of four in combination with any other value, then they can lay that card at the bottom of the layout. They would lay their card in such a manner that the four on their card is on the upper side of the card when they lay it down. This may require that they rotate their card 180 degrees. They would overlap the three four so that only the indicia in the upper left corner is visible.

Scoring, strategy, and other methods of play vary by the game. These and other details will become apparent in reading the following instructions. These directions include a partial set of domino matching games and original solitaire games.

CONVENTIONAL DOMINO GAMES

Block Dominoes

Players—This game is designed for two to four players.

Object—Players try to be the first to get rid of their cards.

Deck—A standard 28 card domino playing card deck is used.

Deal—Seven cards should be dealt to two players. Five cards should be dealt to three or four players.

Play—The player to the left of the dealer plays first. That player can play any card. The next players must play cards that can be matched to one end of the layout. The card should be played in such a way that the numbers that match are adjacent. If a player has no card that can be played, that player misses a turn.

Scoring—The player who gets rid of all their cards first, scores one point for each spot on the cards that are still in their opponent's hands. If the game is blocked, the player who has the least number of total spots on their cards receives the difference between the spots on their cards and the spots on the other player's cards.

Winning—The player who reaches 100 or 200 (whichever is decided before the start of play) first is the winner.

Partnership Block Dominoes

Players—This game is designed for four players to play in partnerships. Partners should sit across the table from one another.

Object—Players try to be the first to get rid of all their cards.

Deck—A standard 28 card domino playing card deck is used.

Deal—The dealer deals each player seven cards.

Play—The player with the double six starts the first hand by placing it on the table. The following hands are started by the player who won the hand before. The player to the left of the player that started plays next. Play passes around the table with players playing cards that can be matched to one end of the layout. The cards should be played in such a way that the numbers that match are adjacent. If a player cannot match a card to one end of the layout, that player's turn is lost.

Scoring—Partners score together. When one partner goes out, the partnership scores one point for each spot on their opponent's cards. If the game is blocked, the partnership that has the least total spots scores the difference between their total spots and their opponent's total spots.

Winning—The partnership that reaches 100 or 200 (whichever is decided before the start of play) first is the winning partnership.

Domino Pool

Players—This game is designed for two to four players.

Object—Players try to win the hand and therefore win the pot.

Deck—A standard 28 card domino playing card deck is used.

Betting—All players place an equal bet before the deal of the cards or the start of play.

Deal—Seven cards should be dealt to two players. Five cards should be dealt to three or four players.

Play—The player to the left of the dealer starts by playing any card. Play continues in a clockwise direction. Players must match one of their cards to one of the ends of the layout. The cards should be played in such a way that the numbers that match are adjacent. If a player cannot match one of their cards to the ends of the layout, that player's turn is lost.

Winning—The player that plays all of their cards first or the player with the least number of spots left in their hand when the game is blocked wins the pot. If there is a tie, the pot is shared.

Tiddle-A-Wink

Players—This game is designed for four or more players.

Object—Players try to be the first to get rid of their cards.

Deck—Two standard 28 card domino playing card decks are used or one standard 55 card domino playing card deck can be used.

Deal—As many cards as possible should be dealt to each player but all players should have the same number of cards. The extra cards should be placed off to the side.

Play—The player who holds the highest double starts. If a player plays a double, another card may be played as well in the same turn. Play passes around the table in a clockwise direction. Players must match one of their cards to one of the ends of the layout. The cards should be played in such a way that the numbers that match are adjacent. If a player has no card that matches an end of the layout, that player loses a turn.

Scoring—The player who gets rid of all their cards first scores one point for each spot on the cards their opponents hold. If the game is blocked, the player with the least number of total spots scores the difference between the spots on their cards and the spots on their opponent's cards.

Winning—The player who reaches 100 or 200 (whichever is decided before the start of play) first is the winner.

Blind Hughie

Players—This game is designed for two to five players.

Object—Players try to get rid of all their cards.

Deck—A standard 28 card domino playing card deck is used.

Deal—Five cards should be dealt to four or five players. Seven cards should be dealt to two or three players.

Play—Players do not look at their cards. A player's cards should be placed in a pile. The player to the left of the dealer starts by playing the top card on their pile to the center of the table. Play passes around the table in a clockwise direction. Players flip the top card on their pile. If the card matches one end of the layout, it can be played in such a way that the numbers that match are adjacent. If the card doesn't match an end of the layout, that player loses a turn and the card is placed at the bottom of their pile.

Scoring—The player who gets rid of all their cards first scores one point for each spot on their opponent's cards.

If the game is blocked, the player with the least number of spots scores the difference between their total spots and their opponent's total spots.

Winning—The player who reaches 100 or 200 (whichever is decided before the start of play) first is the winner.

Draw Dominoes

Players—This game is designed for two to four players.

Object—Players try to be the first to get rid of all their cards.

Deck—A standard 28 card domino playing card deck is used.

Deal—Seven cards should be dealt to two players. Five cards should be dealt to three or four players.

Play—The player to the left of the dealer starts by playing any card. Play passes around the table in a clockwise direction.

Players must play cards that can be matched to one end of the layout in such a way that the numbers that match are adjacent. If a player doesn't have a card to match to one end of the layout, cards should be drawn from the stock until a player does have a card that can be played. If the stock is used up and a player doesn't have a card that matches one end of the layout, that player loses a turn.

Scoring—The player who gets rid of all their cards first scores a point for each spot on their opponent's cards. If the game is blocked, the player with the least number of spots on their cards scores the difference between their spots and the total number of their opponent's spots.

Winning—The player who reaches 100 or 200 (whichever is decided before the start of play) first is the winner.

Doubles

Players—This game is designed for two to four players.

Object—Players try to be the first to get rid of all their cards.

Deck—A standard 28 card domino playing card deck is used.

Deal—Seven cards should be dealt to two players. Five cards should be dealt to three or four players.

Play—The player with the highest double starts. Play can come off of that double in all four directions. Play continues in a clockwise direction. Cards must be played in such a way that the numbers that match are adjacent. A player may only add a card if the double of that card has already been played. (i.e. If the double five is played, a player can lay the 5:0 so that the five is the matching number. On the other hand, the player could not play it so the zero was the matching number, if the double zero had not been played) If a player has no card that can be played, cards should be drawn from the stock until the player does have a card that can be played. If the stock is gone and a player has no card that can be played, that player loses a turn.

Scoring—The player who gets rid of all their cards first scores one point for each spot on their opponent's cards. If the game is blocked, the player with the least number of spots on their cards scores the difference between their spots and the total number of their opponent's spots.

Winning—The player who reaches 100 or 200 (whichever is decided before the start of play) first is the winner.

Fortress/Sebastopol

Players—This game is designed for four players.

Object—Players try to be the first to get rid of their cards.

Deck—A standard 28 card domino playing card deck is used.

Deal—The dealer deals each player seven cards.

Play—The player with the double six starts by playing that card. Play proceeds in a clockwise direction. Play on the double six is in all four directions. Cards must be played in such a way that the numbers that match are adjacent. A card must be played on each side of the double six before a second card can be added to any other direction. If a player does not have a card that can be played, that player loses a turn.

Scoring—The player who gets rid of all their cards first scores a point for each spot an opponent holds in their hand. If the game is blocked, the player with the least total spots scores the difference between their spots and their opponent's total spots.

Winning—The player who reaches 100 or 200 (whichever is decided before the start of play) first is the winner.

Sebastopol/Cyprus

Players—This game is designed for four to ten players.

Object—Players try to be the first to get rid of all their cards.

Deck—A standard 55 card domino playing card deck is used.

Deal—Nine cards should be dealt to four or five players. Seven cards should be dealt to six or seven players. Five cards should be dealt to eight to ten players.

Play—The player with the double nine starts by playing that card. If no one has the double nine, each player in turn draws a card until someone draws it. Play continues is a clockwise direction. Play on the double nine is in eight directions. Cards should be played in such a way so that the numbers that match are adjacent. A card must be played in each direction before a second card can be added to any direction. If a player doesn't have a card that can be played, one card must be drawn from the stock. If the player still cannot play, that player loses a turn.

Scoring—The player who gets rid of all their cards first scores one point for each spot on their opponent's cards. If the game is blocked, the player with the least number of spots on their cards scores the difference between their spots and the total spots on their opponent's cards.

Winning—The player who reaches 100 or 200 (whichever is decided before the start of play) first is the winner.

All Fives

Players—This game is designed for two to four players.

Object—Players try to score points by playing their cards in such a way that they form multiples of five on the ends of the layout and they also try to be the first to get rid of their cards.

Deck—A standard 28 card domino playing card deck is used.

Deal—The dealer deals each player five cards.

Play—The player to the left of the dealer starts and may play any card. The player wants to play a card that when the ends are summed equals five or a multiple of five. Play continues in a clockwise direction. The cards must be added to the layout in such a way that the numbers that are adjacent match. Players try to play cards in such a way that when the ends of the layout are summed, they equal five or a multiple of five. If a player doesn't have a card that matches one of the ends, that player draws one card from the stock. If that player still cannot play a card, the turn is lost. The first double that is laid should be placed cross-ways. This opens up two more ends to the layout. These ends must also be summed when a player is trying to total five or a multiple of five. Play can continue in any of the four directions.

Scoring—During play a player scores for forming five and multiples of five. If a player formed five, five points are scored. If a player formed ten, ten points are scored and so on. The player who gets rid of their cards first also scores one point for each spot on the opponent's cards. If the game is blocked, the player with the least number of spots on their cards scores the difference between their spots and the total spots of their opponents.

FIGS. 13A to 13E show an example series of play in All Fives. The first player laid the 4:6 and scored ten points, since its two ends total ten spots. The second player laid the 6:3 and did not score, since the two ends now total seven spots (four plus three.) The third player laid the 3:3 opening up a third end on the layout and scored ten points, since the three ends now total ten spots (four plus three plus three.) The fourth player laid the 3:5 opening up the fourth and final end of the layout and scored fifteen points, since the four ends now total fifteen spots (four plus three plus three plus five.) The fifth play was the 3:0 which did not score, since the four ends of the layout now total twelve spots (four plus three plus zero plus five.)

Winning—The player who reaches 150 or 200 (whichever is decided at the start of play) first is the winner.

All Threes

Players—This game is designed for two to four players.

Object—Players try to play their cards in such a way that they form multiples of three by summing the ends of the layout and they also try to be the first to get rid of their cards.

Deck—A standard 28 card domino playing card deck is used.

Deal—The dealer deals each player five cards.

Play—The player to the left of the dealer starts by playing any card. The player wants to play a card that when the ends are summed equals three or a multiple of three. Play continues in a clockwise direction. The cards must be added to the layout in such a way that the numbers that are adjacent match. Players try to play cards in such a way that when the ends of the layout are summed, it equals three or a multiple of three. If a player doesn't have a card that matches one of the ends, one card is drawn from the stock. If the player still cannot play a card, the turn is lost. The first double that is laid should be placed cross-ways. This opens up two more ends of the layout. These ends must be included in the sum when a player is trying to total three or a multiple of three. Play can continue in any of the four directions.

Scoring—During play a player scores for forming three and multiples of three. If a player formed three, three points are scored. If a player formed six, six points are scored and so on. The player who gets rid of their cards first also scores one point for each spot on their opponent's cards. If the game is blocked, the player with the least number of spots on their cards scores the difference between their spots and their opponent's total spots.

Winning—The player who reaches 150 or 200 (whichever is decided before the start of play) first is the winner.

Fives and Threes

Players—This game is designed for two to four players.

Object—Players try to play their cards in such a way that when the ends are summed they form a multiple of three or five and they also try to be the first to get rid of their cards.

Deck—A standard 28 card domino playing card deck is used.

Deal—The dealer deals each player five cards.

Play—The player to the left of the dealer starts by playing any card. The player wants to play a card that when the ends are summed equals a multiple of three or five. Play continues in a clockwise direction. The cards must be added to the layout in such a way that the numbers that are adjacent match. Players try to play cards in such a way that when the ends of the layout are summed, it equals a multiple of three or five. If a player doesn't have a card that can be played on one of the ends of the layout, one card is drawn from the stock. If the player still cannot add a card to the layout, the turn is lost. The first double that is laid should be placed cross-ways. This opens up two more ends of the layout.

These ends must be included in the sum when a player is trying to form a multiple of three or five. Play can continue in any of the four directions.

Scoring—During play a player scores for forming multiples of three and multiples of five. If a player formed three, three points are scored. If a player formed five, five points are scored. If a player formed six, six points are scored. If a player formed ten, ten points are scored and so on. If a player formed a number that was both a multiple of three and five, that player receives double the number of points. (i.e. if a player formed fifteen, thirty points would be scored.)

The player who gets rid of all their cards first scores one point for each spot left on their opponent's card(s). If the game was blocked, the player with the least number of spots in their hand scores the difference between the spots in their hand and the total spots in their opponent's hand(s).

Winning—The player who reaches 150 or 200 (whichever is decided before the start of play) first is the winner.

Bergen

Players—This game is designed for two to four players.

Object—Each player tries to score points during play and to be the first to get rid of their cards.

Deck—A standard 28 card domino playing card deck is used.

Deal—Six cards should be dealt to two or three players. Five cards should be dealt to four players.

Play—The player with the highest double starts. Play is only in two directions. Play continues in a clockwise direction. Cards must be played in such a way that the numbers that match are adjacent. Players also try to lay cards that will cause both numbers on the ends of the layout to be equal. If a player cannot play a card, one card is drawn from the stock. If the player still cannot play, the turn is lost.

Scoring—A player scores two points if two ends of the layout match. A player scores three points if there is a double at one end that matches the other end. Two points are scored for winning a hand. The player who plays all of their cards wins the hand. If the game is blocked, a hand is won by the player with the fewest doubles or the player with the fewest number of spots on their cards.

Winning—The player who reaches 10 or 15 (whichever is decided before the start of play) first is the winner.

SOLITAIRE

Single Foundation

Players—This game is designed for one player.

Object—Try to play all of the cards to the single foundation.

Deck—A standard 28 card domino playing card deck is used.

Deal—Deal a row with one card face-up followed by four face-down. Then over-lapping this row deal another row where the first two are face-up and the next three face-down. Then deal three up and two down, and so on until all cards have been dealt. The last two rows will all be face up with the very last row only having three cards.

Play—Only the top card (the card closest to the player) in a column can be played or moved. These cards may be played under four circumstances. First, if the card is the double zero it can be played above the tableau to start the only foundation. Second, if there is a top card, one of whose numbers matches the bottom number of the top card in a second column, then the first card can be played on top of the second in a direction such that the matching number is at the top of the played card (i.e., the matching numbers are adjacent.) Third, if the card is the only one in the column it can be turned upside down to facilitate playing other cards to it. Fourth, if the top card of a column has a number that matches the bottom number in the foundation you can play the card to the foundation, again in such a direction that the matching number is at the far end of the card from the player. Any exposed face down card can be turned over when the player desires. This card can be laid in either direction (i.e., so that either number is up) at the discretion of the player. An empty column cannot be filled, it remains empty for the remainder of play.

Up and Down

Players—This game is designed for one player.

Object—Try to get all of the cards to the foundation.

Deck—A standard 28 card domino playing card deck is used.

Play—Start by flipping the top three cards onto a single pile. The first double is put up to form the only foundation. This double can be played on if either number on the card from the stock matches either number on the foundation card. Continue to go through the deck three cards at a time as at the start. The stock may only be gone through five times.

Winning—If all of the cards are moved to the foundation, the game has been won.

Double Solitaire

Players—This game is designed for two players.

Object—Both players try to be the first to move all of their cards to the foundation.

Deck—Two standard 28 card domino playing card decks are used.

Deal—Each player should have a deck of cards and the cards should be laid down in the following way. A horizontal row should be formed where the first card is face-up and the next four are face-down. Then form a second horizontal row that overlaps the first row where the first card is face-up on top of the first face-down card of the first row and the next three are face-down. Continue in this fashion until the last row is a row of one face-up card.

Play—The first double that each player has available is used to form the foundation. The cards that are on the top of each column are available for play. The foundation can be laid on if either number on one of the available cards matches either number on the foundation card. Both players may lay on their own foundation or the other player's foundation.

They can move their face-up cards in the tableau by placing them on other cards so the matching numbers are adjacent. If a face-down card is exposed, it can be turned face-up. A player's turn is complete when a card is flipped from the stock. That card cannot be played until the player's next turn.

Winning—The player who gets all of the cards of their deck onto the foundation first is the winner. In case of a block, the player with the least number of cards in their stock+tableau+discards is the winner.

La Belle Lucie

Players—This game is designed for one player.

Object—Try to move all of the cards from the table to the foundation.

Deck—A standard 28 card domino playing card deck is used.

Deal—Lay all cards face-up on the table in nine columns of three and one lone card.

Play—The top card of each group is available for play. If the double six or the double zero are on top move them above the tableau to form the foundation. Play on those doubles in such a way that the number on the card in the tableau matches the number on the foundation card that is closest to the tableau. Play the card in such a way that the number that was matched is placed the farthest away from the tableau. The top card of each column can be moved onto another column if you can match one of the first card's numbers to the nearest number of the card you play it on. The tableau can be reshuffled twice. The last time the tableau is shuffled, one card can be pulled from anywhere in a fan to put on the foundation.

Winning—If all of the cards have been moved from the tableau to the foundation, the game has been won.

Accordion

Players—This game is designed for one player.

Object—Try to get all of the cards onto one pile.

Deck—A standard 28 card domino playing card deck is used.

Deal—Place seven cards face-up in a row.

Play—Cards can be moved one space or three spaces to the left, but only if the card they move onto has one of the same numbers. Once play is blocked, add more cards from the stock in the empty spaces. Continue to do this until all of the cards are used up.

Winning—If all of the cards are in one single pile at the end of the game, the game has been won.

Braid

Players—This game is designed for one player.

Object—Try to get all of the cards to the foundation.

Deck—A standard 28 card domino playing card deck is used.

Deal—Place ten cards face-up corner to corner so they look like a braid. Then place three cards face-up on each side of the braid. Then flip the next card to start the foundation.

Play—The bottom card on the braid and the six face-up cards on the side can be played to the foundation. The foundation can be played on in such a way that one of the numbers on the card matches the number that is closest to the player on the foundation card. The card should be played so that the number that matched is farthest away from the player. The stock may be turned one card at a time and used to play to the foundation. The six cards on the sides must be replaced if they are used. The top and bottom card on either side can be replaced by the bottom card on the braid, the top card on the waste pile or from the stock. The middle cards must be replaced from the stock. The stock may be reused as many times as necessary.

Winning—If all of the cards are on the foundation, the game has been won.

Leapfrog

Players—This game is designed for one player.

Object—Try to have as many open spots in the tableau as possible after the stock is used up.

Deck—A standard 28 card domino playing card deck is used.

Deal—Place sixteen cards on the table in a four card by four card layout.

Play—You can leap cards horizontally, vertically or diagonally, but the card that is leapt onto and the one that leaped must have one number in common. The card that leaped becomes the top card of the pile and the card leapt over is taken out as waste. The remaining cards in the stock should be added to the open spaces.

Winning—Attempt to end the game with as many open spots in the tableau as possible.

Maze

Players—This game is designed for one player.

Object—Try to get all of the cards in matching order.

Deck—A standard 28 card domino playing card deck is used.

Deal—Place all of the cards face-up on the table in a seven row by four column layout.

Play—Remove all of the doubles and place them off to the side. Any of the other cards can be moved into an open space, if one of their numbers matches the bottom number on the card above it. The card should be placed so the matching numbers are adjacent. A series can continue onto the next column.

Winning—If all of the cards are in matching order, the game has been won.

Monte Carlo

Players—This game is designed for one player.

Object—Try to remove all of the cards from the tableau.

Deck—A standard 28 card domino playing card deck is used.

Deal—Place ten cards in a two column by five row layout.

Play—Cards can be removed that are touching horizontally, vertically or diagonally if they have one number in common.

Once all of the p airs have been removed, move the cards up and to the left in order and add to the bottom of the layout from the stock. Play continues in this manner until all of the stock is used.

Winning—If all of the cards are removed from the tableau and the stock is used up, the game has been won.

Bisley

Players—This game is designed for one player.

Object—Try to get all of the cards to the foundation.

Deck—A standard 28 card domino playing card deck is used.

Deal—Place all of the zeros face-up in a row, such that the zeroes are at the top. Then place the rest of the cards face-up below them in three overlapping rows of seven columns.

Play—The cards at the bottom of each column are available for play. The available cards can either be played onto the foundation or onto another available card, if the top number of the card you are using matches the bottom number of the card you lay it on. The card should be played so that the matching numbers are adjacent. Therefore, cards will always retain their original orientation. Spaces in the layout are not filled.

Winning—If all of the cards are on the foundation, the game has been won.

Golf

Players—This game is designed for one player.

Object—Try to clear all of the cards from the tableau.

Deck—A standard 28 card domino playing card deck is used.

Deal—Place twenty of the cards face-up in a four row by five column layout. Then flip the first card of the stock to start a discard pile, this card can be played in either direction.

Play—Any of the 20 cards in the tableau can be played on the discard pile, if one of its numbers matches the bottom number on the discard pile. The card should be played so that the matching number is up (i.e., the matching numbers are adjacent when played in an overlapping fashion.) In an alternate version of the game, the player is allowed to match either number on the top card in the discard pile. Try to play as many cards to the waste pile as possible. If there are no more cards from the tableau that can be played to the discard pile, a card from the stock should be flipped onto the discard pile. Again, you can lay this card in either direction. The stock can only be used once.

Scoring—The player scores penalty points for the number of cards left in the tableau. If the tableau is cleared, the score is negative the number of cards left in the stock.

Make a Wish

Players—This game is designed for one player.

Object—Try to remove all of the cards from the tableau using the least amount of moves as possible.

Deck—A standard 28 card domino playing card deck is used.

Deal—Deal all of the cards face-up into piles that form a layout of four columns by two rows. The piles in the first row contain four cards and those in the second row contain three cards.

Play—Try to remove as many cards as possible in each turn. You can remove only the cards that are on the top of each pile. Cards that have one number that matches can be removed and placed face-down in the form of a trick. Only cards that were exposed when the move was started can be removed and not cards that were uncovered in the middle of the move.

Winning—If all of the cards have been removed using less than 10 tricks, the game has been won.

Yukon

Players—This game is designed for one player.

Object—Try to move all of the cards to the foundation.

Deck—A standard 28 card domino playing card deck is used.

Deal—Deal the cards out in seven rows of four cards in an overlapping fashion. The first row of cards are all face-down.

The second row has one face-up and three down. The third row has two face-up and two down. The fourth row has three cards face-up and one down, and the remaining cards are all dealt face-up.

Play—The double six and double zero can be removed to form foundations whenever they become fully exposed. The bottom group of cards in any column can be moved to another column, if the top number in the group of cards matches the bottom number in the column you place it on. Any top (fully exposed) card can be moved to the foundation, if one of its numbers matches the bottom number in the foundation. It is played so the matching numbers are adjacent. Empty columns can be filled with any card from the tableau. An alternative version of play allows you to lay cards on the foundation in any orientation as long as one number on each card is the same.

Winning—If all of the cards have been moved to the foundation, the game has been won.

Forty Thieves

Players—This game is designed for one player.

Object—Try to get all of the cards to the foundation.

Deck—Two standard 28 card domino playing card decks are used.

Deal—Deal the cards into four overlapping rows of seven cards each. All of the cards should be face-up.

Play—The double zero forms the foundation and can be moved there as soon as it is exposed. Only one card can be moved to the foundation at a time and only the bottom card of each column is available for play. The available cards can be played onto the bottom of another row in such a way that the numbers that match are adjacent or to the foundation in such a way that a the bottom number on the foundation card matches one of the numbers on the card being played to the foundation. The card should be played in such a way that the matching number is on the top. Spaces in the tableau can be filled with the bottom card of a column, a group of cards from a column or a card from the stock. The stock is played one card at a time in such a way that all of the cards are overlapping and visible but only the top card is available for play. You can go through the stock twice.

Winning—If all of the cards are on the foundation, the game has been won.

OTHER MATCHING GAMES

Match Rummy

Players—This game is designed for two to eight players

Object—Players try to meld their cards before any other player.

Deck—A standard 28 card domino playing card deck is used for two to four players. Two decks should be used for five or more players.

Deal—The dealer deals each player five cards.

Play—A turn is always started by drawing a card either from the stock or the discard pile. Each player tries to meld their cards. A meld must contain a run of at least three cards formed by matching one number on two of the cards and either unmatched number on those cards to a number from the remaining card (e.g., if a player holds the 1:3 and the 3:4 and the 4:6 is drawn, those cards can be laid down in a meld.) A player can lay on another player's meld even before they meld. A player cannot go out by discarding. All of the cards must be melded or one must be left in the player's hand. If stock runs out, the discard pile is shuffled and reused.

Scoring—Players score penalty points for the number of spots on the cards left in their hand when another player goes out.

Winning—Play to 30 or 50 (whichever is decided before the start of play). The player with the lowest score is the winner.

Kings Corners

Players—This game is designed for two to four players.

Object—Each player tries to get rid of all their cards.

Deck—A standard 28 card domino playing card deck is used for two or three players. Two decks should be used for four players.

Deal—The dealer deals each player five cards. Then the rest of the cards are placed in the center as the stock. The top two cards are flipped to start discard runs on either side of the stock.

Play—A turn is started by drawing a card from the stock as long as stock is available. Then players can lay their cards on the discard runs if they can match the number at the end of the run that is farthest from the stock pile. The numbers that match should be adjacent. A player can continue their turn until no more of their cards can be played. If a player has no cards that can be played, that player must draw from the stock until a card is drawn that can be played. If the stock is gone and a player cannot play, the turn is lost. If the number nearest the stock in one run matches the number farthest from the stock in the other run, then the player can move the entire run to the top of the second run and lay any card in place of the old run. The player who draws the double six can lay it on one of the open sides of the stock. This forms the foundation of a third run which cannot be moved.

Scoring—Players score penalty points for the number of spots on the cards left in their hand.

Winning—Play to 30 or 50 (whichever is decided before the start of play). The player with the lowest score is the winner.

Crazy Eights

Players—This game is designed for three of more players.

Object—All players try to get rid of all their cards before any other player.

Deck—A standard 28 card domino playing card deck is used for three players. Two decks should be used for four or more player.

Deal—Deal each player five cards one at a time. Then place the stock in the middle and flip the first card to start a discard pile.

Play—The player to the left of the dealer starts. A player must match one of the two numbers on the discard pile. If a double if laid, the next player must draw two cards and lose a turn. A card whose total weight is eight can be played even if it doesn't match either of the two numbers. The player can then call the suit. If a player cannot play, cards must be drawn until it is possible. If stock runs out, shuffle and use the discard pile.

Winning—The first player to run out of cards is the winner.

Steal the Pack

Players—This game is designed for two to four players.

Object—Each player tries to get the most cards.

Deck—A standard 28 card domino playing card deck is used.

Deal—The dealer deals each player four cards one at a time. Then four cards are placed face-up in the center of the table.

Play—The player to the left of the dealer starts. Players try to match one number on one of their cards with a number on one or more of the center cards. The card from the player's hand is placed on top of the card(s) from the center and placed in front of the player. The next player does the same thing and so on. A player can take another player's bundle instead of or in addition to one or more cards from the center as long as one number matches on all of the cards. If a player cannot match any cards, that player must place one card in the center. When everyone has played their four cards, the dealer deals each player four more (two for four players) cards. Each player continues to get more cards in this fashion until all of the cards have been played.

Winning—The player with the most cards in their bundle wins.

Give Away

Players—This game is designed for two or more players.

Object—Players try to get rid of all their cards.

Deck—A standard 28 card domino playing card deck is used.

Deal—The dealer deals all of the cards one at a time. It doesn't matter if some players have one more card than other players.

Play—Players do not look at their cards and they place them in a neat pile. The player to the left of the dealer starts by flipping their top card. If it is a double, the player plays it to the center. If it is not a double, the player starts a discard pile. If a player can play to the center, the player's turn continues until that player cannot play to the center. The next player flips a card. That player plays to the center if the card can be played onto the card in the center by matching one of the numbers. A player can play on another player's discard pile in the same way. If a player runs out of face down cards and their last card was played to the center or another discard pile, then the discard pile is flipped face-down and the player continues their turn. If the last card was flipped onto their discard pile, the player must wait until their next turn to flip the pile.

Winning—The player who gets rid of all their cards first is the winner.

Newmarket

Players—This game is designed for three to eight players.

Object—Each player tries to get the most chips.

Deck—A standard 28 card domino playing card deck is used for three to four players. Two decks should be used for five or more players. In addition, the double of each suit is also needed from another deck. These cards are called "boodle" and are placed face-up in the center of the table.

Deal—The dealer deals each player and a widow hand that is to the dealer's left one card at a time. Each player should have the same number of cards and as many as possible. The left over cards should be placed face-down on the table.

Before Play—Each player receives a supply of betting chips or counters. Before each hand, all players must place one chip on each of the boodle cards. Before play starts, the widow hand may be exchanged for the dealer's hand if the dealer chooses. If this is done, the dealer's hand is placed face-down on the table. If the dealer doesn't take the widow, it can be auctioned to any player who wants it. The highest bidder pays the dealer in chips. That player's cards are then placed face-down on the table and the widow is picked up. If no one wants the widow hand, it is left face-down and no one sees the cards.

Play—Play begins with the player to the dealer's left. The lowest card in any suit that that player holds should be placed face-up on the table. The next player can play a card if one number matches one of the numbers on the center card. If a player doesn't have a card that can be played, the turn is lost. If play becomes blocked, the last player to play a card starts a new sequence with the lowest card they hold. Whenever a player plays a card that matches a boodle card, that player wins all of the chips on that card. If no one claims the chips on a boodle card, they stay for the next hand. Before each hand, each player must place one chip on each boodle card. When a player has no cards left, the hand is over.

Scoring—Every player must give the player who went out one chip for each card they hold in their hand.

Winning—The winner of the game is the first player to win an agreed amount of chips or the player with the most chips at the end of a time limit or a set number of deals.

Spit

Players—This game is designed for two players.

Object—All players try to get rid of all of their cards first. It is important to be fast or the other player will win.

Deck—A standard 28 card domino playing card deck is used.

Deal—Deal each player fourteen cards one at a time. Two cards should be flipped face-up in front of each player from their fourteen cards.

Play—The dealer says 1-2-3-Spit and each player flips one card to the center. If one number on a player's card and one of the center cards matches, then that card can be played to the center and it is replaced from the stock. It is important to be fast or the other player may put a card there first. If both players are blocked, the dealer says 1-2-3-Spit and they both flip a card to the center again. Once a player's cards are gone, that player takes either pile from the center (the one that appears to have the fewest cards) and the other player takes the other pile. Both piles are shuffled. Each player assures they have two face-up cards in front of them. Each turns a card to the center and this cycle is continued until the smallest pile only has two cards. Both cards are then turned up in front of the player so there is only one center pile.

Winning—Once a player has no cards left and there is only one center pile, that player wins.

Sputter

Players—This game is designed for two players.

Object—All of the players try to play their cards in such a way that they are the first to get rid of all of their cards.

Deck—A standard 28 card domino playing card deck is used.

Deal—Deal each player fourteen cards one at a time. Two cards should be flipped face-up in front of each player from the fourteen they received. One card should also be flipped face-up in the center by each player.

Play—The non-dealer goes first. If one number on either of the player's cards matches a number on a center card, that card can be placed on the center card. A player then replaces that card from the stock. A player's turn continues until neither of the player's cards can be played to the center. Then the dealer takes a turn. Play continues back and forth until someone is out of cards. If both players are stuck, each player flips one card to the center. The player who played the last card is the first to play on the new cards. The first player to run out of cards picks up the smallest center pile. The other player picks up the larger center pile. Both piles are shuffled. The player who ran out of cards starts. Play continues until the smallest pile is only two cards. These two must be turned face-up in front of the player. Now there is only one pile in the center.

Winning—Once a player has no cards left and there is only one pile in the center, that player wins.

Description of Preferred Embodiment and Summation Method of Play—FIGS. 1 to 3, 6

The preferred embodiment of the playing cards of the present invention is as described above under the title "Description of Preferred Embodiment of Cards and General Play—FIGS. 1 to 3, 6" and as illustrated in FIG. 1.

The "summation" method of play requires the addition of first value 32*a* and second value 34*a* of indicia 30*a*. This sum determines a card's total value or weight. In FIG. 1 the weight of the card illustrated would be 5+3 or 8. This weight can then be compared to the weight of other dominoes in a player's hand or to other dominoes in play.

In the preferred embodiment, the deck of cards represents a set of double-6 dominoes, FIG. 2. In this case, all dominoes can be combined in pairs such that the sum of the weights of each pair is twelve. For example, the double six (weight of twelve) and the double zero (weight of zero) total twelve. However, not all pairs are unique. For example, the double five can be combined with either the two zero or the double one.

Operation Summation Method of Play—FIGS. 1, 2, 6

The preliminary methods of play are as defined in the section above titled "Operation General Play—FIGS. 1, 6." The general concept of the summation method of play is that players must total the spots on their cards to determine the card's weight or value.

One strategy of play using the summation method requires that the player collect pairs of cards. The total weight of these pairs must be twelve, in the preferred embodiment of a deck of cards (FIG. 2). For example, a player must pair the six five (weight of eleven) with the one zero (weight of one) to total twelve. The methods of collecting these pairs varies by game. The cards can be taken from a layout on the playing surface, other players, the stock, the deal, or by other methods. These methods will become clear in the game instructions that follow.

In the preferred embodiment of a deck of cards of the present invention (FIG. 2), all possible combinations of the values zero (or blank) through six are represented. This is representative of the conventional double-6 domino set. Chinese domino cards do not have combinations with the blank or zero value. Only those combinations of values possible in the roll of two dice are used. U.S. Pat. No. Des. 83,342 to Niederlitz (1931) also does not include the double blank domino. Neither of these decks' cards can be grouped into pairs with equal sums. This makes the Niederlitz and Chinese domino cards undesirable for playing games using the summation method of play.

Another strategy of play is to form runs or groups of cards whose weight is different by a value of one. For example, this strategy can be used in the play of rummy and solitaire games. Yet another strategy allows players to collect groups of cards that either have the same weight or that form incremental sequences. For example, this combination of strategies can be used in versions of poker and cribbage games. Scoring, strategy, and other methods of play vary by the game. These and other details will become apparent in reading the following partial list of instructions.

It is clear that these methods of play will stimulate players (especially young players) to learn arithmetic through the playing of games. Further arithmetic skills, particularly multiplication and division, are required in the play of some matching and interchangeable suit games. For example, some of these games require that the ends of a layout sum to a multiple of five or three. Other games require the use of similar logic. These games are discussed in their associated sections.

Concentration

Players—This game is designed for two or more players.

Object—Try to be the player who clears the most cards off of the table.

Deck—A standard 28 card domino playing card deck is used.

Deal—Place all of the cards face-down on the table.

Play—In a player's turn two cards are flipped face-up. If the sum of the spots is twelve, then the player can remove those two cards and go again. If the sum of the spots is not twelve, then the cards are turned face-down and the next player takes a turn.

Winning—The player with the most cards when the table is cleared is the winner.

Old Maid

Players—This game is designed for two or more players.

Object—Try to get rid of all your cards without being stuck with the old maid.

Deck—A standard 28 card domino playing card deck is used for two to four players. Two decks should be used for five or more players. The double six(es) must be removed. If two decks are being used, only one double zero should be left as the old maid.

Deal—Deal all of the cards one at a time, even if some players have one more card than others.

Play—Pairs are removed from each player's hand that sum twelve spots. The player to the left of the dealer starts by picking one card from the player to their left. If the player can match that card to form a pair that totals twelve spots, the player lays those 2 cards in the center of the table.

Winning—The players who do not have the old maid at the conclusion of the game are the winners.

Go Fish

Players—This game is designed for two to eight players.

Object—Try to be the player who has the most pairs at the end of the game.

Deck—A standard 28 card domino playing card deck is used for two to four players. For five or more players, two decks should be used.

Deal—Deal 5 cards to each player one at a time.

Play—Everyone should remove from their hand any pairs whose total spots is twelve and place the cards in front of them.

Then the player to the left of the dealer starts by asking any player for a card that when combined with one in the player's hand sums twelve spots. If that player doesn't have one, then the player says go fish. The player who asked for the card then picks a card from the stock. If a player gets the card that was asked for, the 2 cards can be laid down and the player goes again. If the player does not get the card, play continues with the next play. If a player runs out of cards, the player draws one from the stock on their turn. If a player runs out of cards in the middle of a turn, then the player picks a card and continues the turn.

Winning—The player with the most pairs at the end of the game is the winner.

Black Jack

Players—This game is designed for two to seven players.

Object—Each player tries to beat the dealer and get as close to 21 as possible without going over.

Deck—A standard 28 card domino playing card deck is used for two to four players. Two decks should be used for five or more players.

Betting—Every player except the dealer places a preliminary bet.

Deal—The dealer deals one card to each player face-up and the dealer receives one face-down. Then the dealer deals everyone a card face-up.

Play—The cards are worth the sum of their spots. If the players don't think they have enough points with their two cards, they can take a hit (ask for another card). If the players feel they're close enough to twenty-one and will beat the dealer, they can stand (take no cards). If they take a hit and go over twenty-one, they bust and must turn their cards face-down. If they feel they can win if they have one more card, they can double down. To do this they place an amount equivalent to the amount they already bet down beside their cards. The dealer will then give them one more card. If the first two cards they receive have the same total spots, they can split them. Splitting means that they play each card as a separate hand, but they must put an amount equivalent to their first bet down by the second card. Once a player stays or busts, play is moved to the next player with the dealer being last.

Winning—If they beat the dealer, they receive their bet from the dealer. If they score exactly twenty-one with their first two cards, they receive their bet and a half from the dealer. If they lose to the dealer or bust, the dealer takes their money. If they tie with the dealer, it is a push and no one gains or loses money.

War

Players—This game is designed for two players.

Object—Each player tries to get all of the cards.

Deck—A standard 28 card domino playing card deck is used.

Deal—The dealer deals all of the cards face-down one at a time.

Play—Players do not look at their cards. Both players turn their top card face-up beside each other. The player with the card that has the most total spots takes both cards. If both cards have the same number of spots, each player plays one card face-down and one card face-up on top of their first card. The player whose second card has the most spots takes all six cards. If there is still a tie, there is another "war".

Winning—The winner is the player who gets all of the cards.

Alternate Method: Instead of using total spots, use the highest number on the card.

Snap

Players—This game is designed for two or more players.

Object—Each player tries to get all of the cards.

Deck—A standard 28 card domino playing card deck is used.

Deal—The dealer deals all of the cards face-down one at a time. It doesn't matter if some players have one more card than others.

Play—Players don't look at their cards and they place them in a neat pile. The player to the left of the dealer starts by flipping one card face-up next to their face-down pile. The player to their left does the same thing and so on around the table until any player sees that the cards on top of two piles have the same number of total spots. If a player sees this, snap is said and that player gets both of the face-up piles. The player puts them on the bottom of their face-down pile. Play then continues with the player to the left of the last player to play a card. When a player runs out of face-down cards, the face-up pile is flipped and used. When a player calls snap in error, that player must give each player one card.

Winning—The player who gets all of the cards is the winner.

Casino

Players—This game is designed for two to four players.

Object—Each player tries to take as many cards from the center as possible, especially the cards that score points.

Deck—A standard 28 card domino playing card deck is used.

Deal—The dealer deals two cards to each player. Then two are placed face-up in the center. The dealer then does the same thing again.

Play—The player to the left of the dealer starts. A player can take combinations of cards on the table whose total spots is equal to the total spots on one of the player's cards. A player may play a card on top of one in the center, so the total of the spots on the two cards is equal to the total spots on a card held. That player must take those two cards in their next turn. Another player can add another card, but that player must be able to take them in their next turn. If a player cannot take one or more cards, one of the player's cards must be placed in the center. Once everyone has used their four cards, the dealer deals four more two at a time.

Scoring—At the conclusion of the hand, the player with the most cards scores three points, the most zeros scores one point, the Big Casino (double six) scores two points, the Little Casino (double zero) scores one point, and each one scores one point.

Winning—The player with the most points after one hand wins or play to twenty-one.

Thirty-Five

Players—This game is designed for two to five players.

Object—Each player tries to get a total of 35 spots in a particular suit.

Deck—A standard 28 card domino playing card deck is used for two players. Two decks should be used for three or more players.

Betting—A small preliminary bet is placed by all players before any cards are dealt.

Deal—The dealer deals one card at a time to each player and to the middle until each player and the middle have four cards each. Then five additional cards are dealt to each player. Now each player should have nine cards and there should be four in the middle. The rest of the cards are placed off to the side and not used.

Play—Players look at their cards. A player whose cards of one suit total thirty-five or more spots takes the pot. If more than one player has thirty-five, the pot is divided among them. If no player has thirty-five, the bidding begins.

Bidding—The player to the left of the dealer starts. A player can bid any amount up to the total in the pot. A player may bid or throw their cards in. When only one player remains active, the four cards from the center are added to that player's hand.

Winning—If the player now has thirty-five in one suit, the amount of their bid can be taken from the pot. If a player's bid is greater than the value of the pot, the pot is received and nothing more. If the player does not have thirty-five, their bid is paid into the pot.

Pyramid

Players—This game is designed for one player.

Object—Try to get all of the cards in pairs.

Deck—A standard 28 card domino playing card deck is used.

Deal—Place fifteen cards all face-up in a pyramid. The first row only having one card. The second row having two cards that are over lapping the first card and so on until the last row is a row of five.

Play—Only the cards that have no cards over lapping them are available for play. Any two available cards that sum a total of twelve spots can be removed. Cards from the stock are turned up one at a time. Pairs can be formed from two cards on the tableau, one from the stock and one from the tableau or the top two cards on the discard pile. Once the stock is used, the waste pile can be reused twice without shuffling.

Winning—If all of the cards are removed from the tableau and there are no cards left in the stock, the game has been won.

Craps

Players—This game is designed for two or more players.

Object—Each player tries to get a winning combination.

Deck—A standard 28 card domino playing card deck is used.

Betting—Before a player is dealt a card, a bet must be placed in the center of the table. The other players have the opportunity to "fade" part or all of the player's bet. The combination of all of the other player's bets cannot be greater than the player's bet. If a player's bet was not entirely faded, the part of the bet that was not faded can be withdrawn or the player can call off the bet. Side bets may also be placed between any of the players including the player that is active.

Special terms—The first deal of a player's turn is called the "come-out" deal. If a player is dealt a combination that totals seven or eleven on the "come-out" deal, a "natural" has been dealt and play passes to the next player. If the player is dealt a combination that totals two, three or twelve on the "come-out" deal, a "miss out" or "crap out" has been dealt and play passes to the next player. If a player is dealt a combination that totals four, five, six, eight, nine or ten, a "point" has been dealt. Now to win, the player must "make a point" (i.e. be dealt a combination that totals that same number before a seven is dealt).

Deal—The dealer deals the player to the left one card. If that card gave the player a natural, the dealer then deals a card to the next player. If that card gave the player a miss out or crap out, the dealer again deals a card to the next player.

If that card gave the player a point, additional cards are dealt to that player until that same number or a seven is dealt to the player. Play passes around the table in this manner.

Winning—If a player is dealt a natural, that player wins. If a player is dealt a miss out or crap out that player loses. If the player being dealt to loses, the other players that bet take the amount they bet and an equivalent amount of the player's bet. If the player being dealt to wins, all of the money in the center of the table is collected by that player.

Yacht

Players—This game is designed for two to ten players.

Object—Each player tries to score the most points by being dealt higher scoring cards.

Deck—A standard 28 card domino playing card deck is used for two to three players. Two decks should be used for four to eight players. Three decks should be used for nine or more players.

Deal—The player to the left of the dealer is dealt three cards face-up.

Play—Play starts with the player to the left of the dealer. Each end of the card represents one die. A player must decide which numbers are to be kept and say them out loud. The maximum number of numbers a player can keep is five. If a player doesn't want to keep five of the original ones, an additional card may be asked for. If the player doesn't like one or both of the numbers on this new card, one more additional card may be asked for but if any of the numbers from the first card are to be kept, the player must say which numbers. A player can never change what the original numbers were. These numbers can only be used to score in one space on the scoring sheet. The next player then takes a turn and does the same thing. If later in the game, a player has no place to score for the combination that is on their cards, the turn is lost and play passes to the next player.

Scoring—There is a scoring sheet that has every player's name across the top and all of the combinations they need to get down the side. The combinations include:

1) ones—multiply the number of ones times one
2) twos—multiply the number of twos times two
3) threes—multiply the number of threes times three
4) fours—multiply the number of fours times four
5) fives—multiply the number of fives times five
6) sixes—multiply the number of sixes times six
7) Big Straight—run of five where six is high—30 points
8) Little Straight—run of five where zero or one is low—25 points
9) Three of a kind—three numbers of the same value—sum of all the numbers
10) Four of a kind—four numbers of the same value—sum of all the numbers
11) Five of a kind—five numbers of the same value—50 points
12) Full House—three numbers of one value and two numbers of another value—28 points
13) Choice—sum of all the numbers Winning—At the end of the game when everyone has all of their spaces filled in, the winner is the player with the most total points.

Kabu

Players—This game is designed for two to six players.

Object—When the number of spots on a player's cards are summed, a nine should be the last digit.

Deck—A standard 28 card domino playing card deck is used.

Deal—The dealer deals each player two cards one at a time.

Play—Players look at their cards and sum the total spots on both cards. They want to have nine as the last digit (e.g. 9, 19, 29, etc.). Players can request up to two additional cards one at a time.

Scoring—Points are scored in the following way:

1) last digit is nine—five points
2) last digit is eight or zero—four points
3) last digit is seven or one—three points
4) last digit is six or two—two points
5) last digit is five or three—one point Winning—The player who reaches twenty points first is the winner.

Clock

Players—This game is designed for one player.

Object—Try to get each of the cards in their correct position in the form of a clock.

Deck—A standard 28 card domino playing card deck is used.

Deal—Deal the cards face-down in the layout of a clock. There should be one card in the middle and at the 12, 1 and 11 o'clock positions. There should be two cards at the 2, 3, 9 and 10 o'clock positions. There should be three cards at the 4, 5, 7 and 8 o'clock positions. There should be four cards at the 6 o'clock position.

Play—Play is started by flipping the card that is in the middle. Sum the spots on the card and place it under the pile at its correct position. (i.e. If the sum of the spots is six, place it under the pile at the 6 o'clock position.) Then flip the top card on that pile and place it under its correct pile. When the double zero turns up place it in the center and turn a card from any other pile desired.

Winning—If all of the cards are in their proper number position, the game has been won.

Sum Rummy

Players—This game is designed for two to eight players.

Object—Players try to meld their cards and go out before any other player.

Deck—A standard 28 card domino playing card deck is used for two to four players. Two decks should be used for five or more players.

Deal—The dealer deals each player five cards.

Play—A turn is always started by drawing a card either from the stock or the discard pile. Players try to meld their cards.

Each meld must contain a run of at least three cards formed by using the sum of the spots on each card. Players can play on other player's melds even before they lay a meld. A player cannot go out by discarding. Players must meld all of their cards or one must be left in their hand. If stock runs out, the discard pile is shuffled and reused.

Scoring—Players score penalty points for the number of spots on the cards still in their hand when a player goes out.

Winning—Play to 30 or 50 (whichever is decided before the start of play). The player with the lowest score is the winner.

Domino Cribbage

Players—This game is designed for two players.

Object—Players try to be the first to make it around the board twice (i.e. score 121 points).

Deck—A standard 28 card domino playing card deck is used.

Deal—The dealer deals each player six cards. The next card is turned over and the number that is the farthest away from the dealer is the starter suit. Each player discards two face-down to form the crib.

Play—The non-dealer plays a card and calls out the total number of spots. The dealer then plays a card and calls out the total number of spots on both cards together. Play continues in this manner with players playing cards and trying to get scoring combinations. If when the count gets close to 31 a player cannot play a card that would keep the count under 31, that player must say go and the next player plays as many cards as they can as long as the count stays under 31. Once 31 has been reached or no one can play, the cards are flipped and the count is started at zero again. Once all of the cards have been played, the hands are picked up and scored.

Scoring—Points are scored both during and after play. Points are scored during play in the following ways:

1) double as starter—dealer scores 1 point
2) reaching a count of 15—2 points
3) pair (same total spot count)—2 points
4) triplet (three cards of same total spot count)—6 points
5) fourth domino of same total spot count—12 points
6) run—1 point for each card
7) exactly 31—2 points
8) last card nearest to 31—1 point
9) last card of a hand—1 point
10) reaching a count of 15 with the last card—3 points At the conclusion of the hand, the non-dealer's hand is picked up and score first. Then the dealer's hand and the crib are both scored by the dealer. Points are scored after play in the following ways:

1) combination totaling 15—2 points
2) double run of three (a three card run with one of the cards also having a pair)—8 points
3) double run of four (a four card run with one of the cards also having a pair)—10 points
4) triple run (three of a kind with two other cards in sequence)—15 points
5) quadruple run (two pairs with a card in sequence with both)—16 points Winning—The winner is the player who makes it around the board twice first.

Four Leaf Clover

Players—This game is designed for one player.

Object—Try to clear all of the cards off of the table and use up the entire stock.

Deck—A standard 28 card domino playing card deck is used.

Deal—Lay sixteen of the cards in a 4 card by 4 card layout.

Play—Two cards can be removed if the sum of their spots is twelve. The cards must be touching either horizontally, vertically or diagonally. Once all of the pairs have been removed that can be removed, move the cards up in the order they are and add more cards at the bottom to replenish the layout. Continue play in this manner.

Winning—If all of the cards are cleared off of the table and there are no cards left in the stock, the game has been won.

Matador

Players—This game is designed for two to four players.

Object—Players can only play cards that form certain numbers and they try to be the first to get rid of their cards.

Deck—A standard 28 card domino playing card deck is used.

Deal—Seven cards should be dealt for two players. Five cards should be dealt for three or four players.

Special Terms—There are wild cards called matadors. They can be played in any turn. They are the 6:1, 5:2, 3:4 and the 0:0.

Play—The player with the highest double starts a layout in the center of the table. There are two ends to the layout. You can place a card at one end of the layout, if the sum of the adjacent numbers is seven. A matador can be played at any time, even if it doesn't total seven in the layout. If a player cannot play a card, a card must be drawn from the stock. If the player still cannot play, the turn is lost.

Scoring—The player that gets rid of all their cards first scores one point for each spot on their opponent's cards. If the game is blocked, the player with the least number of spots scores the difference between their spots and the total spots of their opponents.

Winning—The player who reaches an agreed number of points first is the winner.

Description of Preferred Embodiment and Independent Values Method of Play—FIGS. 1 to 3, 6

The preferred embodiment of the playing cards of the present invention is as described above under the title "Description of Preferred Embodiment of Cards and General Play—FIGS. 1 to 3, 6" and as illustrated in FIG. 1.

The "independent values" method of play allows a player to use either first value 32*a*, second value 34*a*, or both values on a card during the course of play. Furthermore, when the player uses both values they do not always have to be used in association with one another. One value can be used for one purpose, while the other is used for a separate purpose. This will become clear in the following section describing the operation.

To most effectively allow the independent values method of play, the preferred embodiment provides that first value 32*a* and second value 34*a* are of the same type. In the preferred embodiment, these values are represented numerically.

Operation Independent Values Method of Play—FIGS. 1, 6, 16A

The preliminary methods of play are as defined in the section above titled "Operation General Play—FIGS. 1, 6." The general concept of the independent values method of play is that each value of a card is treated independently. Each value is treated almost as if it were on a card of its own.

Depending on the game, the player may choose to use one value from the card, both values from the card in combination, or both values from the card for two independent purposes. For example, in a poker hand with three cards of the preferred embodiment, assume a player has the 2:4, 3:5, and 6:5. Depending on the rules of the specific game this method of play may allow: a pair of fives, using up to one value from each card; a two through six straight, using one or both values in combination from the cards; or the pair and two straights (one using each five), using both values from the cards independently.

The method of play allowing both values of a card to be used for two independent purposes can significantly increase the speed at which some games are played. For example, using this method with cards of the preferred embodiment it is feasible to complete a game of Cribbage to 121 in two hands. This in turn increases the number of games you can play and thus your odds of winning at least one game. For many players this will increase their attention and interest in the game.

This method of play has other interesting ramifications. For example, assume there are four players in a game of Pig, described in detail below. Further assume one player is trying to collect the group of four cards that possess the value of two (i.e., the two three, two four, two five, two six), and another player is trying to collect fives (i.e., the zero five, one five, two five, and three five.) If one player is holding the two five that player can succeed in their goal, while preventing the second player from succeeding. This situation cannot occur in the game of Pig using the standard 52-card deck.

Scoring and further strategies and methods of play vary by the specific game and will become apparent in reading the game instructions that follow and those in other sections.

Rummy

Players—There can be anywhere from two to eight players.

Object—Players try to meld all of their cards before any other player.

Deck—A standard 28 card domino playing card deck is used for two to four players. Two decks should be used for five or more players.

Deal—Deal five cards to each player one at a time.

Play—A turn is always started by drawing a card from the stock or the discard pile. Each meld must contain at least a run of three cards formed by taking one number off of each card. Cards can be removed from the ends of existing melds to use immediately in another meld, but there must be at least three cards left in the meld. All of the cards from a meld can be taken to use immediately on other melds. A player cannot go out by discarding. All of the cards in a player's hand must be melded to go out or else one card must be saved. The discard pile should be shuffled if the stock runs out.

Scoring—Each player scores penalty points for the number of spots on the card(s) left in their hand when someone goes out.

Winning—Play to 30 or 50, whichever is decided before play is started. The player with the lowest score is the winner.

Domino Playing Card Rummy

Players—This game is designed for two to seven players.

Object—Players try to meld all of their cards.

Deck—A standard 28 card domino playing card deck is used for two to four players. Two decks should be used for five or more players.

Deal—The dealer deals each player five cards one at a time.

Play—A turn is always started by drawing a card from the stock or discard pile. Players try to meld their cards. The meld must contain a run of six formed by taking one number off of each card. A turn is always ended by discarding a card except when a player melds their cards and then there will be no card left to discard. The discard pile can be shuffled if stock runs out.

Scoring—Players score penalty points for the number of spots on the cards left in their hand.

Winning—Play to 75 or 100 whichever is decided before the start of play. The player with the lowest score is the winner.

Cribbage

Players—This game is designed for two players.

Object—Each player tries to be the first to make it around the cribbage board twice.

Deck—A standard 28 card domino playing card deck is used.

Deal—The dealer deals each player six cards.

Play—Two cards are then removed from each player's hand and placed face-down to form the crib. The non-dealer cuts the cards and the dealer flips the top card. If it is a double the dealer scores two points. Otherwise the number that is the farthest away from the dealer is the starter suit. The non-dealer plays one card face-up on the table. The dealer does the same and tries to form a combination that scores. If a player plays a card that forms a pair, run, fifteen, etc., the appropriate number of points are awarded. As a player lays a card, the value must be stated and if or what is scored. When the count reaches thirty-one, the pile is flipped and the player who laid the last card gets 2 points. If a player cannot play a card that would keep the count thirty-one or less, go is said and the next player has the opportunity to play a card. If thirty-one is not reached, but no player can play a card, the player that played the last card scores 1 point. Once the cards are flipped, play is started on the way to thirty-one again.

Scoring—Points are scored both during and after play. Combinations of cards that score follow. In creating scoring combinations the player can use one or both numbers from each consecutive card. For example, if the last two cards played were the 2:4 and 3:6, and the next player lays the 5:5, then they can score for a pair (5 & 5) and two runs of five cards (the 2 through 6 with each of the two 5s.) However, to score for 15 or 31 the entire sum of the previous numbers is used in combination with one or both of the numbers on the card played.

1) Pair—a number appears twice on consecutive cards (i.e., a double or a card that has one number in common with the previous card)—2 points 2) Three of a kind—a number appears three times on consecutive cards—6 points 3) Four of a kind—a number appears four times on consecutive cards—12 points 4) Run—formed by one or both numbers from consecutive cards—1 point per card 5) Any combination of numbers totaling fifteen—Both numbers on the card can be used together or individually—2 points The last card of a hand scores 1 point. The non-dealer's hand is picked up and scored first. If a player holds the double of the starter suit, it is worth one point. The dealer's hand is scored after the non-dealer is finished. The dealer also receives the points that are in the crib.

Winning—Play to 121. The player who makes it around the board twice first is the winner.

Pig

Players—This game is designed for three to seven players.

Object—Each player tries to be the first one to collect four cards with a common value. The player's hand must then be placed in the center of the table.

Deck—Only a certain number of cards are used from a standard 28 card domino playing card deck depending on the number of players. For three players, only use the 0:3-6, 1:3-6, and 2:3-6. Then for additional players add in order 3:3-6; 4:4-6 & 5:5; 3:0-2 & 1:1; and then 5:6, 6:6, 0:1 & 0:0.

Deal—Deal each player four cards one at a time.

Play—The dealer counts to three and then everyone passes one card to the player on their left. Play continues this way until someone has a group of four cards with a common value. At this time, that player puts their hand in the center of the table. As soon as a hand is in the center, each player immediately tries to place their hand on top of that hand.

Scoring—The last person to place their hand in the middle gets a letter (P-I-G).

Winning—The cards are shuffled and dealt again until someone has all three letters and is the PIG. The players who are not the PIG are the winners.

Liar's Dice

Players—This game is designed for three or more players.

Object—Each player tries to fool all of the other players and win chips from them.

Deck—A standard 28 card domino playing card deck is used.

Deal—The dealer deals each player three cards.

Play—Each end of the card acts as a "dice." The numbers are used independently from one another. One die can be ignored. The players make a claim as to the value of the hand. A player can say more, less or exactly what is held. If someone accuses a player of lying, the cards must be shown. Otherwise, it is the next person's turn and they must claim a higher ranking hand.

Scoring—The rank of hands from highest to lowest is as follows:

1) Four of a kind—four numbers of the same value
2) Full House—three numbers of the one value and two numbers of another value
3) High Straight—run of five numbers where 6 is high
4) Low Straight—run of five numbers where 0 or 1 is low
5) Three of a kind—three numbers of the same value
6) Two Pair—two numbers of one value and two numbers of another value
7) One Pair—two numbers of the same value
8) High Numbers—highest number of five unmatched numbers Winning—If a player under-stated the value of the hand, that player wins. If the player over-stated the value of the hand, the challenger wins. Each player does the same and each winner gets one chip from the loser.

Poker Dice

Players—This game is designed for two or more players.

Object—Each player tries to get the best poker hand.

Deck—A standard 28 card domino playing card deck is used for two to six players. Two decks should be used for seven or more players.

Betting—All players place a bet before the deal of the cards.

Deal—The dealer deals the player to the left three cards face-up.

Play—Each end of the card represents one die and the numbers are used individually. A player may ask for one additional face-up card. Then play passes to the next player. Once everyone has their numbers, the hands are compared. The rank of hands from highest to lowest is as follows with higher numbers in a given rank of hand beating lower numbers:

1) Four of a kind—four numbers of the same value
2) Full House—three numbers of one value and two numbers of another value
3) Straight—run formed by five numbers
4) Three of a kind—three numbers of the same value
5) Two Pairs—two numbers of one value and two numbers of another value
6) One Pair—two numbers of the same value
7) No Pair—five unmatched numbers not in sequence Winning—The player with the highest ranking hand wins the pot.

Yacht

Players—This game is designed for two to ten players.

Object—Each player tries to score the most points by being dealt higher scoring cards.

Deck—Two standard 28 card domino playing card decks are used for two to eight players. Three decks should be used for nine or more players.

Deal—The player to the left of the dealer is dealt three cards face-up.

Play—Play starts with the player to the left of the dealer. Each end of the card represents one die and the numbers are used individually. A player must decide which numbers are to be kept and say them out loud. The maximum number of numbers a player can keep is five. If a player doesn't want to keep five of the original numbers, an additional card may be asked for. If the player doesn't like one or both of the numbers on this new card, one more additional card may be asked for but if any of the numbers from the first card are to be kept, the player must say which numbers. A player can never change what the original numbers were. These numbers can only be used to score in one space on the scoring sheet. The next player then takes a turn and does the same thing. If later in the game, a player has no place to score for the combination of numbers, the turn is lost and play passes to the next player.

Scoring—There is a scoring sheet that has every player's name across the top and all of the combinations they need to get down the side. The combinations include:

1) ones—multiply the number of ones times one
2) twos—multiply the number of twos times two
3) threes—multiply the number of threes times three
4) fours—multiply the number of fours times four
5) fives—multiply the number of fives times five
6) sixes—multiply the number of sixes times six
7) Big Straight—run of five where six is high—30 points
8) Little Straight—run of five where zero or one is low—25 points
9) Three of a kind—three numbers of the same number—sum of all the numbers
10) Four of a kind—four numbers of the same number—sum of all the numbers
11) Five of a kind—five numbers of the same number—50 points
12) Full House—three numbers of one number and two numbers of another number—28 points
13) Choice—sum of all the numbers Winning—At the end of the game when everyone has all of their spaces filled in, the winner is the player with the most total points.

Centennial

Players—This game is designed for two to eight players.

Object—Each player tries to go all the way from zero to twelve and then back to zero before any of the other players.

Deck—A standard 28 card domino playing card deck is used.

Deal—The dealer deals the player to the left two cards.

Play—You need a scoring sheet that has a row of boxes numbered zero through twelve. Each player needs a counter or something to mark their spot. Each end of the card represents one die. In order to place a player's counter on a square, a zero must be one of the numbers on the two cards. A player can use those first four numbers to go as many spaces as possible. The numbers can be used individually or two or more of them can be summed to get the number needed. If a player gets a zero on their first draw and doesn't have a one, the cards are given back to the dealer and the dealer gives the player two new cards. If a player gets stumped, the next player takes a turn.

Winning—The player who makes it to twelve and back first is the winner.

Beetle

Players—This game is designed for two or more players.

Object—Each player tries to complete a beetle before all of the other players.

Deck—A standard 28 card domino playing card deck is used.

Deal—The dealer deals the player to the left one card.

Play—Each player needs a piece of paper and a pencil. If a player's card has a zero on it, the body to that player's beetle can be drawn. Only one number can be chosen off of each card to use. Players must get a zero first and then a one before they can get any other number. A player only gets one card each round. Even if a player gets a number that is needed to add parts to that player's beetle, the player cannot go again. Each number corresponds to a part of the beetle as follows:

a) the zero is the body b) the one is the head c) the two is one eye d) the three is one feeler e) the four is three legs f) the five is the mouth g) the six is the tail To complete a beetle each player must get one zero, one one, two twos, two threes, two fours, one five and one six. After the zero and the one, the other numbers can come in any order.

Winning—The player who completes a beetle first is the winner.

Hearts

Players—This game is designed for two or more players.

Object—Each player tries to get a wider variety of numbers and therefore more points than any other player.

Deck—A standard 28 card domino playing card deck is used.

Deal—The dealer deals the player to the left three cards face-up.

Play—Each end of the card represents one die and the numbers are used individually. The players hope to score as many points as possible for the following combinations. After marking the player's score, play continues with the next player.

Scoring—The following combinations of numbers score as follows:

1) a one—5 points 2) a one and a two—10 points 3) a one, a two and a three—15 points 4) a one, a two, a three and a four—20 points 5) a one, a two, a three, a four and a five—25 points 6) a one, a two, a three, a four, a five and a six—35 points The player can only use one combination per turn. If three ones are dealt, the player's entire score is lost.

Winning—The winner is the player that has the highest score after a set number of rounds or the first to reach a set score.

Square Poker

Players—This game is designed for two or more players.

Object—Each player tries to get the highest ranking poker hand.

Deck—A standard 28 card domino playing card deck is used for two to seven players. Two decks should be used for eight or more players.

Betting—Each player places a small preliminary bet.

Deal—The dealer deals each player one card face-down and one card face-up. Another face-up and another face-down card are added later so each player has four cards in the form of a square.

Betting—Each player bets or folds after the first two cards are dealt and then again after each of the third and fourth cards are dealt. Each player tries to get the best poker hand horizontally, vertically or diagonally when each number is used individually. For example, in FIG. 16A in the first vertical row there is a straight (4,3,2,1). There is also three of a kind diagonally (three 2's). There is also a pair diagonally in the other direction (two 3's). The rank of hands from highest to lowest is as follows:

1) Straight—run formed by all four of the numbers

2) Three of a kind—three numbers that are the same

3) Two Pair—two sets of two numbers that are the same

4) One Pair—two numbers that are the same

5) Highest number—highest number when there are four unmatched numbers

Winning—The player with the highest ranking hand wins the pot.

Description of Preferred Embodiment and Interchangeable Suit Method of Play—FIGS. 1 to 3, 6

The preferred embodiment of the playing cards of the present invention is as described above under the title "Description of Preferred Embodiment of Cards and General Play—FIGS. 1 to 3, 6" and as illustrated in FIG. 1.

The "interchangeable suit and rank" method of play leads to some of the most interesting games. Using this method of play and the preferred embodiment of the playing cards the player decides whether to use first value 32*a* or second value 34*a* as the suit. Having so decided the other value then becomes the rank for the card.

This determination may either be made at the beginning of a hand or at the time the card is played. When the decision is made at the beginning of the hand the card may be positioned to indicate the selection. This is possible because, in the preferred embodiment of the cards, both secondary indicia 30*b* and tertiary indicia 30*c* are oriented to correspond to the primary indicia 30*a*. When the cards are turned 180 degrees all three indicia are inverted. If the card of FIG. 1 is inverted then second value 34*c* will be on top and first value 32*c* will be on the bottom.

In most games described below the suit and rank are determined at the time the card is played. In this case, the intentions of a player may switch throughout the play. Additionally, a card laid by another player can force the first player to change the intended suit and rank of one of their cards. These scenarios will become clear in the section below describing the operation of interchangeable suit play.

The method of card flipping can be used even if the suit and rank selection is not made until the point of play. A player may use this process to better understand the cards they are dealt.

Operation Interchangeable Suit Method of Play—FIGS. 1, 6, 14A to 15, 16B, 16C The preliminary methods of play are as defined in the section above titled "Operation General Play—FIGS. 1, 6." The preferred embodiment for the interchangeable suit method of play is shown in FIG. 1. The general concept of play is that a player can either choose a first value 32*a* or a second value 34*a* as the suit. The other value then becomes the rank of the card.

Allowing a player to interchange the suit and rank of the card effectively doubles the possible denominations in the deck. For example, the card shown in FIG. 1 can be used as two denominations: the rank of three in the five's suit or the rank of five in the three's suit.

In the preferred embodiment, the cards contain a secondary indicia 30*b* and a tertiary indicia 30*c*. These indicia are oriented the same as the primary indicia 30*a*. Therefore, when a card is rotated 180 degrees the values in the upper left corner are inverted. Thus a player can use the orientation of the values in a given indicia to determine the card's suit and rank. For example, assume the top value is the rank and the bottom value is the suit. Then FIG. 1 would represent the rank of five in the suit of threes, in its current orientation. However, if you rotate the card 180 degrees the three would then be the top value on each indicia. This would make the card a three in the five's suit.

In some games it is required that the suit and rank be chosen at the beginning of a hand. The orientation technique described above allows players to mark this selection. Thus a game might specify that the bottom value in the upper left indicia determines the suit. A game may allow a player to set the orientation they desire at the beginning of the hand. Another game may require that players pick all of their cards up at once and accept the orientation that is dealt. This provides a significant advantage over Chinese domino cards where the cards cannot be reoriented to indicate a different suit and rank.

Still, it is possible to recognize both denominations of the card without rotating the card. This is due to multiple features of the cards in their preferred embodiment. The first aspect is the nature of allowing the suit and rank to be interchangeable. This allows one indicia to represent multiple denominations. The second aspect is the location and orientation of the secondary and tertiary indicia. The indicia's orientation and some of its benefits were described in a paragraph above. In the preferred embodiment, the location of secondary indicia 30*b* and tertiary indicia 30*c* is such that you can clearly view at least one indicia when the cards are held in a typical fan-like fashion (FIG. 6). This is true before and after a card is rotated 180 degrees.

This provides for quick play and does not require you to memorize the alternative denominations of a card. This provides a significant advantage over other prior art multiple denomination playing cards. Prior art multiple denomination cards do not suggest this method of interchanging the card's suit and rank. Prior double denomination cards possess two different indicia. These two indicia are located in positions that usually require a player to flip the card over to recognize the alternative denomination of the card. Otherwise, the cards must either be memorized or spread out more in the hand than cards of the present invention. This generally reduces the practical number of cards a player can hold to about four. Additionally, cards of the present invention have the advantage of a less crowded and less distracting face than multiple denomination cards of the prior art which have separate indicia for each denomination.

In some games the denomination of a card is not determined until the time the player uses it. Due to the nature of these interchangeable suit cards, a player can orient cards according to their desired use but still recognize the alternative denomination. This allows them to change the intended suit of the card at the moment of play as they desire or as the game requires.

In the preferred embodiment, a deck of cards of the present invention are representative of a set of double-6 dominoes. Thus all possible combinations of the numbers from zero through six taken two at a time are represented. For most games the deck consists of eight suits, one for each number, zero through six, and the doubles' suit. Every card belongs to two suits. If the card is a mixed card (its two values are different) then it belongs to the suit associated with each value. If the two values on the card are identical then the card belongs to the suit of that value and the doubles' suit. Each suit has seven cards: the three highest ranking cards, the three lowest ranking cards, and one middle ranking card. In most games the double of a given suit is the highest ranking card in that suit.

This division of cards results in only six cards out of the 28 card deck that fall in the lowest three ranking cards for both of their suits. These six cards are the zero, one, and two in combination with a three; the zero and one with a two; and the zero one. The zero in the zero's suit is the double and so is the highest ranking card in that suit. The zero in the four's suit can also be played as the four in the zero's suit, where it is no longer one of the three lowest cards. In fact there are only four additional cards that are not one of the three highest cards in one of their suits. These are the zero, one, two, and three in combination with a four. This leaves 18 out of 28 cards, or over 64%, that can possibly be used as one of the three highest ranking cards in some suit.

This results in almost any hand having the potential of being a winning hand in a trick taking game. For many players this provides more excitement and anticipation than playing with a standard 52-card deck.

Many trick taking games force players to use their cards in a manner other than what they hope for. For example, a player holding the double zero may want to lay it on the zero's suit where it has the highest value in the suit. However, someone else may lead the trick and call the double's suit. If this is the only double the player has and the game requires them to follow suit they will lose the card, and thus the ability to use it to take a trick in the zero's suit.

Similarly, in a trick taking game that has a trump suit, a player may lose a potential trump card because they are forced to play it to the card's other suit. For example, assume the trump suit is zeroes and a player has the zero six but no other sixes. If a trick is led in the suit of sixes, then the player must use their zero six and they will lose it since it is the lowest six possible. This is despite the fact the player could potentially have used the card as the second highest valued trump card.

This method of play increases the role of chance in a game. This is because the sequence of play greatly affects the value of a card. Thus a player's chance of winning is not only affected by the deal but also is significantly altered by the sequence of play. This has the advantage over standard 52-card decks of giving less skilled players a better chance of winning.

The cards of the present invention also make it very difficult to count cards. The first reason for this is because for every card played you must remember two denominations are no longer in play. For example, if the card of FIG. 1 is played to the five's suit you must not only remember that the three in the five's suit is out of play but also the five in the three's suit. A second factor complicating the counting of cards is the fact that the suit and rank are both of the same type. A third reason it is difficult to remember what has been played is that there are eight suits. Another factor that makes it more difficult to count cards of the present invention than those in a standard 52-card deck is that almost every card is important. Only six of the cards are low ranking cards and even these could easily become winners. This is because players may players may play the higher ranking cards in those suits to their alternative suit.

The difficulty of remembering what cards have been played provides another advantage over standard 52-card decks. Using cards of the present invention would help prevent the counting of cards at casinos. The cards of the present invention also have a tendency to equalize the play quality of many players. This usually leads to more enjoyable games.

The cards and methods of the present invention also have other interesting ramifications. For example, since each card has multiple suits, a player can use it to fulfill very different runs or sequences. A player holding the card containing the two and three can use that card in a sequence in the two's suit, such as two one, two two, two three; or the player could use the card in a sequence in the three's suit, such as three two, three three, and three four. Additionally, the player could change their mind during the course of play if they drew cards for a sequence other than the one they originally intended to develop.

Scoring, strategy, and other methods of play vary by the specific game and will become apparent in reading the game instructions that follow and those in other sections.

Sweep Fives

Players—There can be anywhere from two to six players.

Object—Each player tries to take the most doubles, five's and cards. Each player also tries to take the double five and to sweep the table.

Deck—A standard 28 card domino playing card Deck is used.

Deal—Deal 3 cards to each player one at a time, two cards for six players. Then place four cards face up in the center of the table. Place the remaining cards to the side to be dealt later.

Play—Play starts with the player to the left of the dealer. This player must play one card. If a player holds a card that matches one number on one or more cards in the center of the table and the sum of the other numbers on the player's card and the card(s) on the table is a multiple of five, then those cards can be taken and laid face-down in front of the player. (i.e. as seen in FIG. 15 if a player held the 4:1 in their hand and the 4:4, 4:5 and 4:0 were on the table, they could be taken because the 4's match and 1+4+0+5=10 which is a multiple of five) Doubles are of the same suit as well as being part of their number suit.(i.e. as seen in FIG. 15 if a player held the 5:5 they could take the 0:0 because doubles are of the same suit and 5+0=5) If a player takes all of the cards on the table, called a sweep, one of the cards should be placed face-up in front of the player to mark it. In this case, the next player must lay a card on the table. If a player cannot match or take any cards on the table, the player must place one card face-up on the table. If a player lays a card and doesn't realize some cards could have been taken, anyone can take them if they see it. After the first deal of each hand, if the face-up cards as a group of four or as two pairs have one number in common and the sum of the other numbers is a multiple of five, the dealer takes all of the cards and scores a point for a sweep. When everyone is out of cards, the dealer deals three more cards to each player from the stock. The last round may only have two cards.

Scoring—At the conclusion of the hand, one point is scored by the players who have the most doubles, five's, and cards.

One point is also scored for each sweep and for the double five.

Winning—The player who reaches ten or fifteen (Five Player Alterations: Only e start of play) first is the winner.

Five Player Alterations: Only place three cards face-up on the table at the start.

Five Card Draw

Players—This game is designed for two to eight players.

Object—Each player tries to get a higher ranking poker hand than all of the other players.

Deck—A standard 28 card domino playing card deck is used for two to four players. Two decks should be used for five or more players.

Betting—All players place a bet before the start of play.

Deal—Everyone is dealt five cards one at a time.

Betting—Everyone has the opportunity to bet or pass beginning with the player to the left of the dealer. Each bet must be at least as much as the preceding player's bet, but the bet cannot be raised once everyone has bet the same amount.

Play—Each player may discard one or more cards and receive new ones from the dealer. (For four or eight players only two cards may be discarded, but for any other number of players, any or all of their cards can be discarded.) Players don't have to draw if they don't want to.

Betting—Once everyone has had their opportunity to draw, there is another betting procedure. Bluffing is allowed.

Scoring—The rank of hands from highest to lowest where the higher numbered suits beat lower numbered suits is as follows:

1) Royal Flush—run of the five heaviest cards in the same suit (i.e. 6:6, 6:5, 6:4, 6:3, and 6:2)
2) Straight Flush—run of five cards in the same suit (i.e. 1:0, 1:1, 1:2, 1:3 and 1:4)
3) Five of a kind—five cards of the same rank
4) Four of a kind—four cards of the same rank
5) Full House—three cards of one rank and two cards of another rank.
6) Straight—run formed by one number off of each card (i.e. 6:0, 5:2, 4:6, 3:1 and 2:1)
7) Three of a kind—three cards of the same rank
8) Two Pairs—two cards of one rank and two cards of another rank
9) One Pair—two cards of the same rank
10) High Card—heaviest card when there are five unmatched cards FIGS. 16B and 16C are examples of possible poker hands. FIG. 16B shows a hand containing a straight formed by taking one number off of each card (4,3,2,1,0) or a full house, three 3's and two 2's. FIG. 16C shows a royal flush (the 6,5,4,3, and 2 of the 6's suit). The hand illustrated in FIG. 16C would beat all other hands.

Winning—The player with the highest ranking hand wins the pot.

Rummy

Players—There can be anywhere from two to eight players.

Object—Players try to meld all of their cards before any other player.

Deck—A standard 28 card domino playing card deck is used for two to four players. For five or more players, two decks are needed.

Deal—Deal five cards to each player one at a time.

Play—A turn is always started by drawing a card from the stock or the discard pile. Each meld must contain at least a group of three in sequence in a suit. Doubles are of the same suit as well as belonging to the number suit. A player can lay on other's meld even before they meld. Cards can be removed from the ends of existing melds to use immediately in another meld, but there must be at least three cards left. All of the cards from a meld can be taken to use immediately on different melds. A player cannot go out by discarding. All of the cards in a player's hand must be melded to go out or else one card must be saved. The discard pile should be shuffled if stock runs out.

Scoring—Each player scores penalty points for the number of spots on the card(s) left in their hands when someone goes out.

Winning—Play to 30 or 50, whichever is decided before play is started. The player with the lowest score is the winner.

Contract

Players—This game is designed for three or four players. If there are four players, play with partners. Partners should sit across from one another.

Object—Each player tries to make a bid and take as many tricks as possible. The players who did not get the bid try to prevent the bidder from taking tricks.

Deck—A standard 28 card domino playing card deck is used.

Deal—Deal all of the cards one at a time (for 3 people there will be one card left over that should be flipped for all to see).

Bidding—Bidding starts with the player to the left of the dealer. Rank of suits is no trump, doubles, 6's, 5's, 4's, 3's, 2's, 1's, and 0's. The bid is raised by bidding more tricks in the same suit or bidding the same number of tricks in a higher suit.

Play—The highest bidder leads the first trick. The player who leads each trick calls the suit. All players must follow suit if possible even if the other number on the card is of the trump suit. In this case the player is only following suit, not trumping. Players must trump if they cannot follow suit. A trick is won by the highest card of the suit played (double is always highest) unless trump was played and then the highest trump card. The winner of each trick leads the next trick. As shown in FIG. 14A the player who led the trick called 3's as the suit and all players followed suit. The 3:3 wins the trick because it is the highest card of the suit. In FIG. 14B, 2's were called as the suit and 4's are trump.

The 4:0 takes the trick because it is the highest trump card that was played. The 4:2 is considered a rank of 4 in the suit of 2's because that was the suit that was called. In FIG. 14C, doubles were called as the suit and 0's are trump.

The 6:6 would take the trick because doubles were called as the suit and the 6:6 is the highest double played. The 0:0 is considered a double in this case and it is the lowest card of the suit so it does not take the trick. The player who played the 6:4 has no doubles and no zero so they just had to play any card.

Scoring—If the bid is made, the player scores the number of tricks multiplied by the bid. If the bid is not made, the other players score the player's bid multiplied by the number of tricks that player was short.

Winning—The player who reaches 100 first is the winner.

Nots

Players—This game is designed for three or more players.

Object—Each player tries not to take tricks that have zeros in them.

Deck—A standard 28 card domino playing card deck is used.

Deal—The dealer deals the same number of cards to each player one at a time.

Play—The player to the left of the dealer leads the first trick. The player who leads the trick calls the suit. If a double is led, the suit can be doubles or the number. The double is always the highest card of every suit. All players must follow suit if possible, but they don't have to head the trick. A trick is won by the highest card of the suit played. The player who took a trick leads the next trick.

Scoring—Players score penalty points for each zero that they take.

Winning—Play to 10. The person with the lowest score is the winner.

Kowah

Players—This game is designed for two to eight players.

Object—Players try to meld their cards and be the first to go out.

Deck—A standard 28 card domino playing card deck is used for two to four players. Two decks should be used for five or more players.

Deal—Deal five cards to each player one at a time.

Play—A turn is always started by drawing a card from the stock or the discard pile. Players must get one meld of three and one meld of two. Each meld must be cards in sequence in the same suit. Each turn should be ended by discarding a card onto the discard pile. Lay the group of three face-up and the group of two face-down. Anyone who draws a card after someone has laid their cards down must show it to everyone. If stock runs out, the discard pile can be shuffled and used.

Scoring—If someone else draws the card a player needs, the player scores one point. If someone discards the card a player needs, the player scores two points. If the player draws the card they need, that player scores three points.

Winning—Play to five. The player who reaches five first is the winner.

Blackout (Poacher)

Players—This game is designed for three to seven players.

Object—All players bid on the exact number of tricks they will take and the player must try to get that exact number.

Deck—A standard 28 card deck is used.

Deal—The first hand only one card is dealt to each player. The second hand two cards are dealt and so maximum is reached. The last card is turned over to signify trump unless there is no card left in which case there is no trump. Trump is the number that is the farthest away from the dealer.

Bidding—Each player must bid the exact number of tricks they think they will take. The player to the left of the dealer starts the bidding.

Play—The player to the left of the dealer leads the first trick. The player who leads a trick calls the suit. Players must follow suit if possible even if the other number on the card is of the trump suit. In this case they are only following suit, not trumping. A trick is won by the highest card of the suit played (double is always highest) unless trump was played and then the highest trump card takes the trick. The player who takes a trick leads the next trick.

Scoring—If a player bids zero and takes zero tricks, then that player receives five points+the total number of tricks in the hand. If a player gets the exact number of tricks bid, that player gets ten points+the total number of tricks in the hand. No points are awarded or lost for too many or not enough tricks.

Winning—The player with the highest score after the last hand is the winner.

Nap (Napoleon)

Players—This game is designed for two to seven players.

Object—Players bid the minimum number of tricks they think they will take and try to get at least that many.

Deck—A standard 28 card domino playing card deck is used.

Deal—Deal five cards to each player one at a time. Only deal four cards for six or seven players.

Bidding—Players bid two-five as to the number of tricks they think they will take. There is only one round of bidding and each bid must be higher than the preceding bid.

Play—The highest bidder names trump and leads the first trick. The player who leads a trick calls the suit. The player who wins a trick leads the next trick. A trick is won by the highest card of the suit played (double is always highest) unless trump was played and then the highest trump card takes the trick. Players must follow suit if possible even if the other number on the card is of the trump suit. In this case players are only following suit, not trumping. If a player cannot follow suit, they do not have to trump.

Scoring—If a player takes at least as many tricks as they bid, they score the bid. If a player doesn't take as many tricks as they bid, the other players score the bid.

Winning—Play to 10. The player who reaches ten first is the winner.

Whist

Players—This game is designed for three or four players. If there are four players, play should be in partnerships with partners sitting across from one another.

Object—Each player tries to take as many tricks as possible and to take tricks with the honor cards in them.

Deck—A standard 28 card domino playing card deck is used.

Deal—Deal each player the same number of cards. Then flip the last card to indicate trump. The number that is the farthest away from the dealer is trump. If there is no card left, then each player, starting with the player to the dealer's left, has the opportunity to grand or pass. If a player grands, that player is saying that they can take at least three tricks. The first player to grand calls trump.

Play—The player to the left of the dealer leads the first trick if there are three players. If there are four players, the player who grands leads the first trick. The player who leads a trick calls the suit. Players must follow suit even if the other number on their card is of the trump suit. In this case they are only following suit, not trumping. A player must trump if they cannot follow suit. A trick is won by the highest card of the suit played (double is the highest in every suit) unless trump was played and then the highest trump card takes the trick.

Scoring—At the conclusion of the hand, players receive one point for each trick over three. If a player grands and the partnership doesn't take three tricks, they lose 1 point for each trick they were short of four. The four honors are 6:6, 5:5, 4:4, and 3:3. If a player or partnership has two or more of these, they score one point for each.

Winning—Play to 21. The player who reaches twenty-one first is the winner.

Five Card Stud

Players—This game is designed for two to ten players.

Object—Each player tries to get the highest ranking poker hand.

Deck—A standard 28 card domino playing card deck is used for two to five players. Two decks should be used for six or more players.

Betting—All players make a small bet before the start of play.

Deal—The dealer deals each player one card face-down and one card face up. Each player later receives three additional face-up cards.

Play—Players may look at their face-down card.

Betting—The player with the highest face-up card has the opportunity to bet or pass first. The bet then goes around the table in a clockwise direction. Each bet must be at least as much as the preceding player's bet, but the bet cannot be raised once everyone has bet the same amount. There is a betting procedure after each face-up card is added. Bluffing is allowed.

Play—After the last bet, the players who are still active expose their face-down card.

Scoring—The rank of hands from highest to lowest where higher numbered suits beat lower numbered suits is as follows:

1) Royal Flush—run of the five heaviest cards in the same suit
2) Straight Flush—run of five cards in the same suit
3) Five of a kind—five cards of the same rank
4) Four of a kind—four cards of the same rank
5) Full House—three cards of one rank and two cards of another rank
6) Straight—run formed by taking one number off of each card
7) Three of a kind—three cards of the same rank
8) Two Pairs—two cards of one rank and two cards of another rank
9) One Pair—two cards of the same rank
10) High Card—heaviest card when there are five unmatched cards Winning—The player with the highest ranking hand wins the pot.

Slapdouble

Players—This game is designed for two to eight players.

Object—Each player tries to get all of the other player's cards.

Deck—A standard 28 card domino playing card deck is used for two to four players. Two decks should be used for five or more players.

Deal—The dealer deals all of the cards one at a time face-down. It doesn't matter if some players have one more card than others.

Play—Players do not look at their cards. Players put their cards in a neat face-down pile. The player to the left of the dealer starts by placing the top card face-up in the center of the table. Each player does the same thing. If a double is laid, each player must try to be the first to put their hand on it. The first person to "slap" the double gets the middle pile. That player should shuffle the cards with the middle pile and continue play.

Winning—The player who gets all of the cards is the winner.

I Doubt It

Players—This game is designed for three or more players.

Object—Players try to be the first to get rid of all their cards.

Deck—A standard 28 card domino playing card deck is used.

Deal—The dealer deals all of the cards face-down. It doesn't matter if some players have one more card than others.

Play—Players look at their cards. Play starts with the player to the left of the dealer. A player must lay at least one card face-down in the center of the table and say how many cards and what they are. The first player should lay zeros and the second player ones and so on. Once six is reached, play is started at zero again. If a player doesn't have the number that is supposed to be played, it should be bluffed. If another player thinks a player is bluffing, "I doubt it" should be said. If the player was bluffing, that player must take all of the cards in the center. If the player wasn't bluffing, the doubter must take the center pile.

Winning—The player who gets rid of their cards first is the winner.

Suit of Armor (My Ship Sails)

Players—This game is designed for four players.

Object—Each player tries to get seven cards of the same suit and be the first to put their hand in the center.

Deck—A standard 28 card domino playing card deck is used.

Deal—The dealer deals each player seven cards.

Play—At the same time, all players pass one card to their left. Play continues until one player has all seven cards of a particular suit. That player then places their hand in the center of the table.

Winning—The first player to place their hand in the center wins.

Three Player Alterations: Only use the 0:0-6, 1:1-6, 2:2-6 and three jokers.

All Fours (7-up)

Players—This game is designed for two to four players.

Object—Each player tries to take more tricks and earn more points than any other player.

Deck—A standard 28 card domino playing card deck is used.

Deal—The dealer deals each player six cards three at a time. The next card is turned face-up and determines trump. The number farthest away from the dealer is trump. If the number closest to the dealer is a zero, the dealer scores one point.

Play—If the player to the left of the dealer is happy with the trump suit, that player says, "I stand" and play begins. If the player is not happy, they say "I beg" and the dealer can choose whether or not to change trump. If the dealer chooses to keep the trump, "Take one" is said to the player, who scores one point. Then play starts. If the dealer decides to change trump, the face-up card is placed off to the side. The dealer then deals each player two more cards and turns the next card face-up to determine trump. If it is a different suit, play begins. If it is the same suit, the dealer repeats the process again. The process is repeated until a new trump suit is determined. If the entire deck is used before a new trump is determined, the entire deck is shuffled and dealt again. Once trump is determined, each player discards enough cards face-down so there are only six cards left in each hand. The player to the left of the dealer leads the first trick. The player who leads a trick calls the suit. Players must follow suit even if the other number on their card is of the trump suit. In this case they are only following suit, not trumping. They must trump if they cannot follow suit. A trick is won by the highest card of the suit played (doubles are always highest) or the highest trump card if trump was played. The player who takes a trick leads the next trick.

Scoring—At the conclusion of the hand, one point is scored for each of the following:

1) the player dealt the highest trump card (high)

2) the player dealt the lowest trump card (low)

3) the player who takes the zero of trump (zero)

4) the player who takes the highest total value of cards in tricks (total number of spots) (game)

Winning—The player who reaches seven points first is the winner. If more than one player reaches seven, points are counted in the following order to determine the winner: high, low, zero, and game.

Four Player Alterations: Play in partnerships. Play is the same as in the basic game, except if trump is decided to be changed, all of the cards are shuffled and dealt again.

Knockout Whist

Players—This game is designed for two to seven players.

Object—Each player tries to win all of the tricks of a hand.

Deck—A standard 28 card domino playing card deck is used for two to four players. Two decks should be used for five or more players.

Deal—The dealer deals each player seven cards. The remaining cards are placed face-down off to the side. Each hand the number of cards dealt to each player is decreased by one. The top card of the remaining cards is flipped to determine trump. The number that is the farthest away from the dealer is trump. If there is no card left, then there is no trump.

Play—The player to the left of the dealer leads the first trick. The player who leads a trick calls the suit. Players must follow suit if possible even if the other number on their card is of the trump suit. In this case they are only following suit, not trumping. If they can't follow suit, they must trump or play any card. A trick is won by the highest card of the suit played (doubles are always highest) or if trump was played, the highest card of trump played. The player who takes a trick leads the next trick. At the end of the hand, anyone who did not take a trick is out of the game. The cards are shuffled and dealt to the remaining players. The winner of the most tricks in the previous hand, calls trump and leads the first trick of the next hand. If there is a tie, the top card of the left over cards is flipped and the player to the left of the dealer starts. Play continues in this way with each player that doesn't take any tricks dropping out.

Winning—The player who wins all of the tricks of any hand is the winner of the game.

Piquet

Players—This game is designed for two players.

Object—Players try to score points by having certain cards in their hand. They also try to take more tricks than the other player.

Deck—A standard 28 card domino playing card deck is used.

Deal—The dealer deals each player ten cards two at a time. The remaining eight cards form the stock.

Play—The dealer has the first chance to discard. The dealer decides how many cards they want to exchange, up to five cards. Even if the dealer does not discard five cards they can look at that number of cards at the top of the stock and replace them without showing the other player. Then the non-dealer can discard up to the number of cards left in the stock. The dealer turns the remaining cards in the stock face-up for all to see. The points in each player's hand are declared before the start of play. A player may include the same card in more than one combination.

The non-dealer leads the first trick. The player who leads a trick calls the suit. Players must follow suit if possible even if the other number on the card is of the trump suit. In this case they are only following suit, not trumping. The winner of a trick leads the next trick. The highest card of the suit played wins the trick (double is always the highest) unless trump is played and then the trump card takes the trick.

Scoring—Before play begins points are scored as follows. The player with the most cards of one suit scores one point for each card of that suit. If both players have the same number of cards in their fullest suit, then the player whose suit is of a higher number scores. If both are of the same suit, no one scores. The player with the longest run in a suit scores: three points for three cards, four points for four cards, fifteen points for five cards, sixteen points for six cards and seventeen points for seven cards. The player with the highest sequence may also score for any other sequence held.

During play, each player scores one point for: leading a trick, taking a trick that the opponent led, and taking the last trick. A player also scores ten points for taking six or more tricks. Pique or thirty bonus points are scored by the non-dealer if thirty points are scored before the dealer scores anything. Repique or sixty bonus points are scored by either player if thirty points are scored before the lead of the first trick. Capot or forty bonus points are scored by either player if that player takes all ten tricks.

Winning—The player who has the most points at the end of four or six deals (as decided at the beginning of play) is the winner.

La Malilla

Players—This game is designed for two to four players.

Object—Each player or partnership wants to take more tricks than the others, especially the ones with scoring cards in them.

Deck—A standard 28 card domino playing card deck is used.

Deal—Four players with partners: The dealer deals each player seven cards one at a time. Before the dealer's cards are looked at, one of them is flipped to indicate trump. The number that is the farthest away from the dealer is trump. Then the dealer looks at the cards and picks the Favorito suit (it can be any suit including trump).

Play—The player to the left of the dealer leads the first trick. The player who leads a trick calls the suit. Players must follow suit if possible even if the other number on the card is of the trump suit. In this case they are only following suit, not trumping. They must trump if they cannot follow suit. The highest card of the suit takes the trick (double is always highest) unless trump is played and then the highest trump card takes the trick. The player who takes a trick leads the next trick.

Scoring—The first and last trick are worth two points. The double and next two highest cards in each suit are worth three, two and one respectively. They are worth twice as much in the Favorito suit. The winning partnership scores their points minus twenty six, unless they take all of the tricks. Then they score fifty-two.

Winning—The partnership that has the most points after four hands is the winner. If there is a tie, play two more hands.

Four Individual Players: Play the same as four with partners except each player receives their score minus thirteen points or fifty-two points for all of the tricks. A tie shares a win.

Three Players: The dealer deals nine cards to each player and flips the last card as trump. Otherwise the play is the same as four players with partners except each player receives their score minus seventeen points or fifty-two points for all of the tricks. A tie shares a win.

Two Players: The dealer deals each player twelve cards. Play is the same as four with partners except after each trick a card is drawn by each player from the stock. The winner of the last trick draws first. This continues until the stock is gone. Players can play any suit including trump until stock is exhausted. Then they must follow suit if possible even if the other number on the card is of the trump suit. In this case they are only following suit, not trumping. Each player receives their score minus twenty-six points or fifty-two points for all tricks. Ties are broken by two additional hands.

Ecarte'

Players—This game is designed for two players.

Object—Each player tries to take more tricks than the other player.

Deck—A standard 28 card domino playing card deck is used.

Deal—The dealer deals each player five cards—a pack of two and then a pack of three or vice versa. The next card is placed face-up by the stock and the number that is the farthest away from the dealer is trump. The non-dealer may propose to exchange cards. If the dealer agrees, the non-dealer discards any number of cards and draws new ones from the stock. The dealer then has the opportunity to exchange cards. The non-dealer may repeat the proposal and players continue to exchange until the stock is exhausted. If the dealer ever refuses the exchange, play begins and there is no more exchanging. If the non-dealer does not want to exchange, play begins. The dealer may never propose an exchange.

Play—The non-dealer leads the first trick. The player who leads a trick calls the suit. Players must follow suit if possible even if the other number on the card is of the trump suit. In this case they are only following suit, not trumping. A player must always take the trick if possible. The winner of a trick leads the next trick. A trick is won by the highest card of the suit played (double is always highest) unless trump was played and then the highest trump card takes the trick.

Scoring—Players score one point if three tricks are taken and two points if all five tricks are taken. If the double of trump is turned up to signify trump, the dealer scores one point. If the double of trump is in someone's hand, that player scores one point if it is declared before the first trick is led.

Winning—The player who reaches five first is the winner.

Euchre

Players—This game is designed for two to six players.

Object—Each player or partnership tries to take more tricks than the other.

Deck—A standard 28 card domino playing card deck is used.

Deal—Four players with partners: The dealer deals each player five cards—a pack of three and then a pack of two. The next card is then turned face-up and the number that is the farthest away from the dealer is trump. Each player has the option of accepting or refusing the suit of trump. If everyone accepts it, the dealer discards one card and picks up the face-up card. If someone refuses, the face-up card is placed under the stock. Once one player has accepted, play begins. If all four players refuse, there is a second round in which all players have the opportunity to nominate a trump suit or pass. Once a player has nominated a suit, play begins. If all players pass, all of the cards are thrown in and the cards are dealt again.

Play—The player who nominated trump is the "maker". The maker has the opportunity to play alone or with a partner. If the maker plays alone, the partner's cards are placed face-down on the table. The "maker" leads the first trick. The player who leads a trick calls the suit. Players must follow suit even if the other number on the card is of the trump suit. In this case they are only following suit, not trumping. Players must trump if they cannot follow suit. A trick is won by the highest card of the suit played (double is always highest) unless it was trumped and then the highest trump card wins the trick. The winner of a trick leads the next trick.

Scoring—If the "maker" and the maker's partner win all five tricks, called a "march", they score two points. If the "maker" chose to play alone, four points are scored for a "march". If the maker and the maker's partner win three or four tricks, they score one point. If they don't take at least three tricks, they have been "euchred" and their opponents score two points.

Winning—The player or partnership that reaches five first is the winner.

Two Players: Play is the same as with four players, but there is no declaration to play alone.

Three Players: The maker plays alone and the other two players form a partnership against the maker. The maker scores three points for a march. Otherwise the scoring is the same.

Pinochle

Players—This game is designed for two to four players.

Object—Players try to meld their cards and to take more tricks than the other players.

Deck—A standard 28 card domino playing card deck is used.

Deal—Two Players: The dealer deals nine cards to each player three at a time. The next card is turned face-up and the number that is the farthest away from the dealer is trump. If the card is the zero of trump, the dealer scores ten points. For three players, the dealer deals six cards to each player and the next card is turned face-up for trump. The dealer deals four players five cards and again the next card is turned face-up for trump.

Play—The player to the dealer's left leads the first trick. The player who leads a trick calls the suit. The winner of a trick leads the next trick. A trick is won by the highest card of the suit played (double is always highest) or the highest trump card if trump was played. As long as there is still stock, players don't have to follow suit or trump. After each trick, the player who took the trick can meld one thing and each player draws a card from the stock. If a player holds the zero of trump, it can be laid down and ten points claimed along with laying another meld. A player can also place the zero of trump in the place of the trump card by the stock and take the trump card in their hand. Each card melded can be used later in another meld. A card that has been melded can be played on a trick, but after it has been played, it can no longer be used for meld. Melds include:

1) run of five trump cards—150 points
2) highest two cards of trump—40 points
3) highest two cards of a suit—20 points
4) double six and double zero together—40 points
5) four doubles—100 points
6) four sixes—80 points
7) four fives—60 points
8) four fours—40 points
9) four threes, twos, ones or zeros—20 points Once the stock is exhausted, players must follow suit even if the other number on the card is of the trump suit. In this case they are only following suit, not trumping. Players must trump if they cannot follow suit. Players must take the trick if they can. There are no more melds.

Scoring—Points are scored at the conclusion of each hand. A player scores for the following cards:

1) each double—11 points
2) each six—10 points
3) each five—4 points
4) each four—3 points
5) each three—2 points The winner of the last trick scores ten points. Points are rounded to the nearest ten before they are added to a player's score.

Winning—The player or partnership that reaches 1,000 wins.

Contract Bridge

Players—This game is designed for four players to play with partners. Partners should sit across the table from one another.

Object—Each partnership tries to take more tricks and score more points and bonus points than the other partnership.

Deck—A standard 28 card domino playing card deck is used.

Deal—The player to the left of the dealer shuffles the cards and the player to the right of the dealer cuts the cards. The dealer deals each player seven cards.

Bidding—Bidding begins with the dealer. Each player has the opportunity to bid, pass, double, or redouble. If a player passes, another call may still be made later in the bidding, but if a bid, double or redouble is followed by three passes, the bidding is over. If all four players pass at the opening bid, the cards are thrown in and the deal passes to the next player. A bid symbolizes the number of tricks a player thinks can be taken over three and the suit that will be used as trump. The rank of suits for bidding is no trump, sixes, fives, fours, threes, twos, ones and zeros. The honors are the highest three cards of the trump suit and if there is no trump, the double six, five and four are honors. Each bid must be higher than the preceding bid. Players can raise the bid by bidding more tricks in the same suit or the same number of tricks in a higher suit. The maximum tricks a player can take is seven so four is the maximum bid.

Special Terms—If a partnership succeeds in bidding and winning seven tricks, it is known as a grand slam. A small slam occurs if a partnership bids and takes six tricks. If double is said, a player thinks that the bidder can be prevented from making their bid. If a double becomes the contract and the bidders succeed, their score is doubled. If the bidders don't make their bid, the side that doubled gets at least twice the score it otherwise would have had. If a bid has been doubled, either player from the bidding partnership may say redouble. By doing this, they are showing their confidence in the bid and scoring is affected. The declarer is the player who first made the bid in the contracted trump suit.

Play—The player to the dealer's left leads the first trick. The player who leads a trick calls the suit. A player must follow suit if possible even if the other number on the card is of the trump suit. In this case a player is only following suit, not trumping. If a player cannot follow suit, any card can be played. A trick is won by the highest card of the suit played (double is always highest) if no trump appeared. If trump was played, then the highest trump card wins. The player who won the previous trick leads the next trick. As soon as the first trick has been led, the declarer's partner's cards are laid face-up on the table with trump to the right. The declarer plays both hands.

Scoring—The scoring pad has a vertical line separating we and they and a horizontal line in the middle. Points are scored both above and below the line. Trick points are scored below the line and can only be scored by the declarer's partnership in each hand. Premium points are scored above the line in the following ways:

1) overtricks
2) successful doubling or redoubling
3) bidding and making a slam
4) having a certain number of honor cards in one hand
5) winning the final game of a rubber
6) if the declarer's partnership fails to make their contract, their opponents score for their undertricks A partnership is vulnerable if it has won one game of the rubber. Scoring tables:

| Trick score: scored by declarer below the line- | 0 | 1 | 2 | 3 | 4 | 5 | 6 | NT |
|---|---|---|---|---|---|---|---|---|
| First trick over three bid and made: | 20 | 20 | 20 | 20 | 30 | 30 | 30 | 40 |
| Other tricks bid and made: | 20 | 20 | 20 | 20 | 30 | 30 | 30 | 30 |
| Doubling doubles trick score: | | | | | | | | |
| Redoubling doubles doubled score: | | | | | | | | |

| Premium score: scored by declarer above the line- | not vulnerable | vulnerable |
|---|---|---|
| Small Slam: | 500 | 750 |
| Grand Slam: | 1000 | 1500 |
| Each overtrick undoubled: | trick value | trick value |
| Each overtrick doubled: | 100 | 200 |
| Each overtrick redoubled: | 200 | 400 |
| Making a doubled or redoubled contract: | 50 | 50 |

| Rubber, game, and partscore: scored above the line- | Points |
|---|---|
| Winning a rubber, if opponents have won no game: | 700 |
| Winning a rubber, if opponents have won one game: | 500 |
| Won one game in an unfinished rubber: | 300 |
| Having the only partscore in an unfinished rubber: | 50 |

| Honors: scored by either side above the line- | Points |
|---|---|
| Two trump honors in one hand: | 100 |
| Three trump honors in one hand: | 150 |
| Top three doubles in one hand, no trump contract: | 150 |

| Undertricks: scored by opponent above the line- | undoubled | doubled | redoubled |
|---|---|---|---|
| First trick, not vulnerable | 50 | 100 | 200 |
| Subsequent tricks | 50 | 200 | 400 |
| First trick, vulnerable | 100 | 200 | 400 |
| Subsequent tricks | 100 | 300 | 600 |

Winning—When the trick score of either team reaches 100, a horizontal line is drawn under the score and a new game of the rubber is started. When a team has won two games, they have won the rubber.

Grand

Players—This game is designed for four players. They should form partnerships of two and partners should sit across the table from one another.

Object—Each partnership tries to score more points than the other partnership.

Deck—A standard 28 card domino playing card deck is used.

Deal—The dealer deals each player seven cards one at a time.

Bidding—The player to the left of the dealer has the first opportunity to bid or pass. The bids are fives or multiples of five and indicate the number of points a player expects to make in that hand. If the first three players pass, the dealer must make a bid. The highest bidder chooses the game for that hand (whist, grand, euchre or nots).

Play—The highest bidder always leads the first trick.

Whist: The bidder names the trump suit. Play is the same as in whist.

Scoring—Each trick more than three counts five points. If a partnership makes a grand slam and takes seven tricks, they score thirty-five points. No points are scored for honors. If the bidding partnership fails to make their bid, the entire amount of the bid is deducted from their score. The opposing team scores five points for each trick they take over three.

Grand: Play is the same as in whist, but there are no trumps.

Scoring—Each trick over three is worth nine points. A grand slam scores sixty-three points. If either partnership gets a grand slam, it wins the game regardless of its score. If the bidding partnership fails to make their bid, the entire amount of their bid is deducted from their score.

The opponents also score nine points for every trick they take over three.

Euchre: Can only be chosen on a bid of twenty-five or less. The bidder names the trump suit.

Each player discards two of their cards face-down. The play is the same as euchre, but there are a few differences. If the bid is less than twenty, the bidder cannot play alone. If the bid is twenty, the bidder may choose whether or not to play alone. If the bid was twenty-five, the bidder must play alone. If the bidder is playing alone, one card may be exchanged for the partner's best card before the partner's cards are laid face-down on the table.

Scoring—Either partnership may score in the following ways:

1) five points for three tricks 2) ten points for four tricks 3) twenty points for five tricks with a partner 4) twenty-five points for five tricks alone If a partnership fails to make its bid, the amount they bid plus twenty points is subtracted from their score. If a player who chose to play alone doesn't make their bid, the partnership loses twice their bid.

Nots: Nots is only allowed on a bid of fifty or less. Play is the same as in nots.

Scoring—If the bidding partnership doesn't take any tricks with zeros, they score fifty points. If the partnership does take some zeros, it must subtract their bid plus the number of zeros they took from their score. Their opponents lose one point for each zero they take.

Winning—The partnership that reaches 100 points first wins. A time limit or specific number of hands may be set instead.

Seven Card Stud

Players—This game is designed for two to eleven players.

Object—Each player tries to get a higher ranking poker hand than all of the other players.

Deck—A standard 28 card domino playing card deck is used for two to four players. Two decks should be used for five to seven players. Three decks should be used for eight to eleven players.

Deal—The dealer deals each player two cards face-down and then one card face-up. Later four more face-up cards are added one at a time.

Betting—The player with the highest face-up card after the initial deal has the opportunity to bet or pass first. Players may look at their face-down cards before betting. The bet goes around the table in a clockwise direction. Bluffing is allowed. Each bet must be at least as much as the preceding bet, but the bet cannot be raised once everyone has bet the same amount. After each additional card is added there is a betting procedure.

Play—After the last bet, players who are still active may discard two of their seven cards. The remaining five cards are used for a showdown. The rank of hands from highest to lowest is as follows with the higher numbered suits beating the lower numbered suits:

1) Royal Flush—run of the five heaviest cards in the same suit (i.e. 6:6, 6:5, 6:4, 6:3, and 6:2)
2) Straight Flush—run of five cards in the same suit (i.e. 1:0, 1:1, 1:2, 1:3 and 1:4)
3) Five of a kind—five cards of the same rank
4) Four of a kind—four cards of the same rank
5) Full House—three cards of one rank and two cards of another rank.
6) Straight—run formed by one number off of each card (i.e. 6:0, 5:2, 4:6, 3:1 and 2:1)
7) Three of a kind—three cards of the same rank
8) Two Pairs—two cards of one rank and two cards of another rank
9) One Pair—two cards of the same rank
10) High Card—heaviest card when there are five unmatched cards Winning—The player with the highest ranking hand wins the pot.

Brag

Players—This game is designed for three to twelve players.

Object—Each player tries to get a higher ranking hand than all of the other players.

Deck—A standard 28 card domino playing card deck is used for three to nine players. Two decks should be used for ten or more players.

Betting—Each player places a small preliminary bet before any cards are dealt.

Deal—The dealer deals each player three cards one at a time.

Betting—Players look at their cards and the betting begins with the player to the dealer's left. A player cannot pass and bet later. All players must bet or dropout. Each bet must be at least as much as the preceding bet. Once everyone has bet the same amount, the bet cannot be raised.

Play—The remaining players have a showdown. The rank of hands from highest to lowest is as follows with higher numbered suits beating lower numbered suits:

1) "Pryle"—three cards of the same suit
2) "On a bike" run—a run of three cards in the same suit
3) run—a run of three formed by taking one number off of each card
4) One Pair—two cards of the same suit
15) High card—heaviest card of three unmatched cards Winning—The player with the highest ranking hand wins the pot.

Thirty-Five

Players—This game is designed for two to five players.

Object—Each player tries to get a total of 35 spots in a particular suit.

Deck—A standard 28 card domino playing card deck is used for two players. Two decks should be used for three or more players.

Betting—A small preliminary bet is placed before any cards are dealt.

Deal—The dealer deals one card at a time to each player and to the middle until each player and the middle have four cards each. Then five additional cards are dealt to each player. Now each player should have nine cards and there should be four cards in the middle. The rest of the cards are placed off to the side and not used.

Play—Players look at their cards. A player whose cards of one suit total thirty-five or more spots takes the pot. If more than one player has thirty-five, the pot is divided among them. If no player has thirty-five, the bidding begins.

Bidding—The player to the left of the dealer starts. A player can bid any amount up to the total in the pot. A player may bid or throw their cards in. When only one player remains active, the four cards from the center are added to that player's hand.

Winning—If the player now has thirty-five in one suit, the amount of their bid can be taken from the pot. If a player's bid is greater than the value of the pot, the pot is received and nothing more. If the player does not have thirty-five, their bid is paid into the pot.

Klondike

Players—This game is designed for one player.

Object—Try to move all of the cards to the foundation.

Deck—A standard 28 card domino playing card deck is used.

Deal—Deal the first row of five cards with only the left one face-up. Then deal a row of four cards over lapping the four face-down cards of row one with the left card face-up. Deal three more rows in this manner until the last row consists of one face-up card.

Play—The doubles form the foundation and they can be played on in descending order. Each face-up card can be played to the foundation or onto another face-up card in ascending order. If a face-down card is exposed, it can be flipped face-up. If a space opens up in the first row, it can be filled with a zero. The stock is flipped one card at a time and can only be used once.

Winning—If all of the cards are moved to the foundation, the game has been won.

Poker Solitaire

Players—This game is designed for one player.

Object—Try to get as many poker hands as possible with the highest point combination as possible.

Deck—A standard 28 card domino playing card deck is used.

Deal—Deal twenty-five cards placing them randomly in a five card by five card layout.

Play—Try to get as many poker hands as possible horizontally and vertically.

Scoring—The points scored for each are as follows:

1) Straight Flush—run of five cards in the same suit—30 points

2) Four of a kind—four cards of the same suit—16 points

3) Full House—three cards of one suit and two cards of another suit—10 points

4) Straight—run formed by taking one number off of each card—12 points

5) Three of a kind—three cards of one suit—6 points

6) Two Pairs—two cards of one suit and two cards of another suit—3 points

7) One Pair—two cards of the same suit—1 point

Winning—If at least 50 points have been scored, the game has been won.

Cribbage Solitaire

Players—This game is designed for one player.

Object—Try to make it around the cribbage board twice in the least amount of deals as possible.

Deck—A standard 28 card domino playing card deck is used.

Deal—Deal three cards to the player's hand and two cards to the crib. Then deal three more cards to the player's hand. Look at the player's hand and discard two cards to the crib. Turn up the next card in the stock as the starter. The number that is the farthest away is the starter suit. If the starter is a double, score two points.

Play—Play one card face-up on the table. Then play another card face-up beside the first one. Try to form a scoring combination. If the count is brought to exactly 31, score two points. Score one point for playing the last card before 31. Once 31 is reached, flip the cards and start on the way to 31 once again. When all of the cards have been played, pick them up and score the player's hand.

Scoring—Points are scored both during and after play. The following combinations of cards score as follows:

1) One Pair—two cards of the same suit—two points

2) Three of a kind—three cards of the same suit—six points

3) Four of a kind—four cards of the same suit—twelve points

4) Straight—run formed by taking one number off of each card—one point per card

5) Combination totaling fifteen—any combination of the numbers on the cards totaling fifteen—two points A double can make it possible to use both numbers to form two different runs, pairs, combinations of fifteen, etc. If the double of the starter suit was in the player's hand, score two points.

Then pick up and score for the crib. Then place the starter at the bottom of the stock and place the other cards off to the side. Deal again from the stock in the same manner as previously. Continue to play in the same manner. The last hand will only consist of four cards dealt to the player's hand and there will be no crib or starter.

Winning—If the trip around the board twice was made by only going through the stock once, the game has been won.

Poker Squares

Players—This game is designed for two or more players.

Object—Each player wants to position the cards in such a way that more and better poker hands are produced than by all of the other players.

Deck—A standard 28 card domino playing card deck is used.

Deal—The dealer turns twenty-five cards one at a time

Play—Each player has a piece of paper with a five by five grid on it. As the dealer turns a card, each player must write it in a square before another card is turned. Each player tries to get the best combination of poker hands going horizontally and vertically.

Scoring—Points are scored in the following ways:

1) Straight Flush—run of five cards in the same suit—30 points

2) Four of a kind—four cards of the same suit—16 points

3) Straight—run formed by taking one number off of each card—12 points

4) Full House—three cards of one suit and two cards of another suit—10 points

5) Three of a kind—three cards of the same suit—6 points

6) Two Pair—two cards of one suit and two cards of another suit—4 points

7) One Pair—two cards of the same suit—2 points

Winning—The player with the most points at the end of one hand wins.

Bezique

Players—This game is designed for two players.

Object—Each player tries to take the most doubles, tricks and sixes.

Deck—A standard 28 card domino playing card deck is used.

Deal—The dealer deals each player eight cards. The next card is flipped and the number that is the farthest away from the dealer is trump. If the sum of the spots on the trump card is seven, the dealer scores one point.

Play—The non-dealer leads the first trick. The player who leads a trick calls the suit. The winner of a trick leads the next trick. A trick is won by the highest card of the suit played (double is always the highest) unless trump was played and then the highest trump card takes the trick. After each trick, both players draw a card from the stock, trick taker first. As long as there is still stock, players don't have to follow suit. Once stock runs out, players must follow suit even if the other number on the card is of the trump suit. In this case they are only following suit, not trumping. Players must trump if they cannot follow suit and they must head the trick if possible. A player can only meld when that player takes a trick. Only one meld can be laid down at a time. The same card can be used in more than one meld. The meld must be left on the table, but it can be played as if it were still in the player's hand.

Scoring—Melds include:

1) four doubles—10 points 2) four sixes—8 points 3) four fives—6 points 4) four fours—4 points 5) four threes, twos, ones or zeros—2 points 6) the highest two cards of the trump suit—4 points 7) the highest two cards of any suit—2 points 8) a run of four cards in the trump suit—15 points At the conclusion of the hand, one point is scored for each double, trick and six taken.

Winning—The player who reaches 21 first is the winner.

Solo Whist

Players—This game is designed for four players.

Object—Players bid as to the number of tricks they can take. Players must then try to take at least that number of tricks to score points.

Deck—A standard 28 card domino playing card deck is used.

Deal—The dealer deals each player seven cards. The last card dealt to the dealer is turned face-up. The number that is the farthest away from the dealer is trump.

Bidding—Each player has the opportunity to bid or pass. If a player passes, there is a second chance to bid. If all players pass, the cards are thrown in and the deal passes to the next player. Possible bids include:

1) "Prop"—propose a temporary partnership—plan to take five tricks with a partner—trump is indicated at the deal
2) "Cop"—become partner with the player who proposed a partnership
3) "Solo"—plan to take three tricks alone—trump is indicated at the deal
4) "Misere" or nullo—plan to lose all tricks—trump is indicated at the deal
5) "Abondance"—plan to take five tricks—trump is chosen by the bidder
6) "Royal Abondance"—plan to take five tricks—trump is indicated at the deal
7) "Misere ouverte" or spread—plan to lose all tricks—player has no trump—turn cards face-up on the table after the first trick
8) "Abondance declaree"—plan to take seven tricks with no trump suit Play—The bidder leads the first trick. The player who leads a trick calls the suit. The player who wins a trick leads the next trick. A trick is won by the highest card of suit played (double is always highest) unless trumped and then the highest trump card.

Scoring—If a player's bid is made, the proper amount of points are received. If a player's bid is not made, the proper amount of points are lost. Points for each bid are as follows:

1) "Prop"—5 points
2) "Cop"—5 points
3) "Solo"—10 points
4) "Misere" or nullo—15 points
5) "Abondance"—20 points
6) "Royal Abondance"—25 points
7) "Misere ouverte" or spread—30 points
8) "Abondance declaree"—40 points Winning-The player who reaches 50 or 75 (whichever is decided before the start of play) first is the winner.

Pass the Garbage

Players—This game is designed for two to eight players.

Object—Each player tries to get a higher ranking hand than all of the other players.

Deck—A standard 28 card domino playing card deck is used.

Deal—The dealer deals seven cards to each player.

Betting—Each player bets after they receive their cards. Each bet must be at least as much as the preceding bet, but once everyone has bet the same amount, the bet cannot be raised.

Play—Each player passes their worst three cards to the player on their left. They then take the cards given to them and put them in their hand. Players then discard their two worst cards so they're left with a hand of five.

Betting—Each player bets or passes. Each bet must be at least as much as the preceding bet, but once everyone has bet the same amount, the bet cannot be raised.

Scoring—The rank of hands from highest to lowest with higher numbered suits beating lower numbered suits is as follows:

1) Royal Flush—run of the five heaviest cards in the same suit (i.e. 6:6, 6:5, 6:4, 6:3, and 6:2)
2) Straight Flush—run of five cards in the same suit (i.e. 1:0, 1:1, 1:2, 1:3 and 1:4)
3) Five of a kind—five cards of the same rank
4) Four of a kind—four cards of the same rank
5) Full House—three cards of one rank and two cards of another rank.
6) Straight—run formed by one number off of each card (i.e. 6:0, 5:2, 4:6, 3:1 and 2:1)
7) Three of a kind—three cards of the same rank
8) Two Pairs—two cards of one rank and two cards of another rank
9) One Pair—two cards of the same rank
10) High Card—heaviest card when there are five unmatched cards Winning—The player with the highest ranking hand wins the pot.

Skat

Players—This game is designed for three players. The player to the left of the dealer is called the forehand and the player and the player to their left is the middlehand and the dealer is the endhand.

Object—Each player tries to get the bid and therefore win the chance to choose which game is played Each player then tries to score more points than all of the other players.

Deck—A standard 28 card domino playing card deck is used.

Deal—First a packet of three cards is dealt to each player. Then four cards are set aside and form the skat. Then a packet of two cards is dealt to each player and then another packet of three cards. There should be eight cards in each player's hand and four cards in the skat.

Bidding—The highest bidder gets to pick the game. The bid represents the number of game points a player plans to make.

Middlehand has the opportunity to bid or pass first. If middlehand bids, forehand must either "hold" (i.e. make the same bet) or pass. If forehand holds, middlehand must either raise the bid or pass. It goes back and forth until one of the two players passes. Then endhand has the opportunity to bid or pass. If endhand bids, the other player who is still active must either bid or pass. It goes back and forth between the two of them until one of them passes. If both forehand and middlehand pass, endhand may either bid or pass. If all players pass, the cards are thrown in and the deal passes to the next player.

Play—The bidder must decide whether or not to pick up the skat. If the skat is picked up, four cards must be discarded from the bidder's hand and the games that can be chosen are limited. The bidder may choose between suits, grand, simple null, open null and reject. If the skat was picked up, simple null, open null and reject cannot be chosen.

Suits: The bidder calls the trump suit. The bidder's goal is to earn at least 78 points by taking tricks with scoring cards in them.

Grand: The doubles are trump. The bidder's goal is to earn at least 78 points by taking tricks that have scoring cards in them.

Simple Null: There is no trump and the bidder tries to lose every trick.

Open Null: There is no trump and the bidder tries to lose every trick. The bidder's cards must be placed face-up on the table during play.

Reject: This game can only be chosen by forehand and only if middlehand and endhand both passed their first turn.

The doubles are trump and each player tries to take fewer trick points than the other players.

If a player did not pick up the skat, it is referred to as "handplay." If a player chose handplay and chose suits or grand as the game, the value of the game may be made higher by playing "open". The bidder's hand must then be placed face-up on the table. If a bidder chooses suits or grand, "Schneider" (i.e. the bidder will win at least 118 trick points) or "Schwartz" (i.e. the bidder will take every trick) may also be declared. Forehand leads the first trick. The player who leads a trick calls the suit. The player who takes a trick leads the next trick. A trick is won by the highest card of suit played (double is always highest) unless trump was played and then the highest trump card takes the trick. All players must follow suit if possible even if the other number on the card is of the trump suit. In this case they are only following suit, not trumping. Players don't have to trump.

Scoring—Trick points are scored as follows:

1) each double—11 points
2) each six—10 points
3) each five—4 points

After the last trick, the skat is scored as trick points as follows:

1) in suits or grand—to the bidder if the skat was taken before play
2) in reject—to the winner of the last trick
3) in null—to no one (it is discarded)

Game points are scored as follows except for reject:

1) null—23 game points for making simple null and 24 game points for making open null
2) suits and grand—must be calculated—multiply a base game value by many multipliers
   Base Values:
   a) Grand—20 points
   b) Doubles—12 points
   c) sixes—11 points
   d) fives—10 points
   e) fours—9 points
   f) threes—8 points
   g) twos—7 points
   h) ones—6 points
   i) zeros—5 points
   Multipliers:
   a) automatic for making game—1
   b) for choosing handplay—1
   c) for making Schneider and Schwartz
      1) Schneider made but not predicted-1
      2) Schwartz made but not predicted—2
      3) Schneider predicted and made—3
      4) Schneider predicted and Schwartz made—4
      5) Schwartz predicted and made—5

A player adds all of the multipliers together and multiplies them by the base value for the game played.

Except at reject, only the bidder scores as follows:

1) If the bid is made, all of the game points are received.
2) If the bid is not made at
   a) suits or grand—the amount of the bid is lost at handplay, but twice the bid is lost if the skat was taken.
   b) null—the bidder loses the game value Scoring for reject is as follows:

1) the player who takes the fewest trick points—10 points
2) the player who takes no tricks—20 points
3) if there is a tie, the player who did not take the last trick—10 points
4) if someone takes all tricks—lose 30
5) if all players tie, forehand scores 10 points for calling the game.

Winning—The winner is the player with the highest score after a set number of hands.

La Mosca

Players—This game is designed for two or more players.

Object—A player first tries to win the pot with a straight flush. If this is not possible, each player then tries to take more tricks than any other player.

Deck—A standard 28 card domino playing card deck is used for two to four players. Two decks should be used for five or more players.

Deal—The dealer places five chips in the pot. Then five cards are dealt to each player and the next card is flipped. The number that is the farthest away from the dealer is the trump suit.

Betting—The player to the dealer's left has the opportunity to stay or fold first. If a player stays, up to three cards may be exchanged. A player cannot fold after cards have been taken. If all players fold, the dealer takes the pot.

Play—After the dealer has made a decision whether to stay or fold, any player who has a Straight Flush shows it, takes the pot and collects five chips from each player. If more than one player has a straight flush, the trump flush wins or the higher numbered suit wins. If no player has a straight flush, play continues with the player to the left of the dealer leading the first trick. The player who leads a trick calls the suit. All players must follow suit if possible even if the other number on the card is of the trump suit. In this case they are only following suit, not trumping. If a player cannot follow suit, that player must trump and must take the trick if possible. If a player cannot follow suit and cannot take the trick with trump, that player doesn't have to play trump. Any card can be played. The winner of a trick leads the next trick. A trick is won by the highest card of the suit played (double is always highest) unless trump was played and then the highest trump card takes the trick.

Scoring—For each trick, a player takes one-fifth of the chips in the pot. Players who stayed and won no tricks must pay five chips to the pot. Each player should deal the same number of hands. At the end of the game, if there are any chips left in the pot, play ends in one final hand where everyone stays and non-trick takers do not have to add back to the pot.

Winning—The player with the most chips at the end of the game is the winner.

Spider

Players—This game is designed for one player.

Object—Try to get all of the cards in their correct suit.

Deck—Two standard 28 card domino playing card decks are used.

Deal—Deal the cards into four overlapping rows of seven cards each. The first three rows should be face-down and the fourth row should be face-up.

Play—The doubles are built on within the tableau in descending order. Only when an entire suit is in sequence from the double to the zero can it be removed from the tableau. The double zero can be removed as soon as it is exposed because it is the only card in its sequence. The face-up cards are available for play onto another face-up card in descending order. No cards can be played onto the zero of any suit because they are the lowest cards of the suit.

When a card is moved onto another card, all of the cards that are overlapping it must be moved as well. When a face-down card is uncovered, it can be turned face-up and made available for play. A space in the tableau can be filled by any card or series of cards. When there are no moves left in the tableau and all of the spaces have been filled, seven cards from the stock are placed one at the bottom of each column. Play continues in this way with more cards being added when there are no more moves.

Winning—If all of the cards are in their respective suits and removed from the tableau, the game has been won.

Canasta

Players—This game is designed for four players who play in partnerships with partners sitting across from one another.

Object—Each partnership tries to get higher scoring melds than the other partnership and to score more bonus points.

Deck—Four standard 28 card domino playing card decks are used.

Special Cards—The double zero and all cards with a weight of two are wild (i.e. 0:0, 1:1 and 2:0). The 3:0 is a bonus and the 2:1 is a stop card.

Deal—The dealer deals each player eleven cards one at a time. The rest of the cards form the stock of which the top card is flipped to start the discard pile.

Play—The player to the left of the dealer is the first to play. Each player begins a turn by drawing a card from the stock.

A player then tries to make as many melds as possible. Melds include at least three cards of the same suit. Cards may be laid on any melds that the player or partner currently have in front of them. A player ends a turn by placing one card face-up on the discard pile. The first meld of each partnership must contain a certain number of points depending on their current score. Once one of the partners has made a meld, either partner can lay any other meld they have. A meld must contain at least two natural cards and no more than three wild cards. A canasta is a meld of seven cards. A natural canasta is one that has no wild cards. A mixed canasta is one that contains both naturals and wild cards. More cards can be added to a canasta, but there can be no more than three wild cards in a mixed canasta and a natural canasta loses its value if a wild card is added.

Instead of taking the top card from the stock, a player may take the top card on the discard pile to begin the turn. Players can only do this if there are two naturals of the same suit in their hand. The two cards along with the card from the discard pile must be melded immediately. The player must also take the entire discard pile. As many cards as possible may be used by adding them to existing melds or by making new melds. The player's turn ends by discarding one card to start a new discard pile. As long as the discard pile is not frozen, a player can also take it if the top card can be melded with one of the same suit and a wild card or if the top card matches an existing meld of the partnership. The discard pile can be frozen in the following ways:

1) It is frozen for a partnership who hasn't made its first meld.
2) It is frozen if the 2:1 is the top card.
3) If is frozen if there is the 3:0 or a wild card in the discard pile. The cards that are discarded after it should be placed sideways so it is obvious. It can be unfrozen if a player can meld the top card or the wild card with two naturals in their hand.

The 3:0 is a bonus card and cannot be melded. If a player draws a 3:0, it must be placed face-up on the table and another card must be drawn. If a player is dealt a 3:0, it must again be placed face-up on the table and another card must be drawn. If a 3:0 is picked up in the discard pile, it is laid face-up on the table, but no cards are drawn. If a partnership has all four 3:0's, they score 800 points. If a partnership has laid one or more 3:0's on the table, but did not make a first meld before the end of the hand, they lose 100 points per 3:0.

The 2:1's can only be melded when a player is going out. They are usually used as stop cards and they can never be melded with wild cards. A player can go out only if the partnership has made at least one canasta. Players go out by melding all of their cards. A player can go out without discarding if chosen. A player has achieved concealed going out if all of the player's cards are melded at one time when that player previously had no melds. A canasta must be laid unless the partnership has already done so. A player usually asks the permission of their partner to go out and must do as the partner says. This serves as a warning to the partner to meld all of their cards possible in the next turn.

Scoring—Each partnership scores in a variety of ways. A partnership receives the total of all bonus points plus the total point value of their melded cards minus the value of the cards left in either partner's hand. The point values for each card is as follows:

1) 0:0—50 points each
2) 1:1 and 2:0—20 points each
3) 1:0—20 points each
4) sum of spots is 12, 11, 10, 9 and 8—10 points each
5) sum of spots is 7, 6, 5, or 4—5 points each
6) 2:1—5 points each
7) 3:0—100 points each or 800 for all four The score of a partnership compared to the value they need for their first meld is as follows:

1) any negative score—15 points
2) 0 to 1495—50 points
3) 1500 to 2995—90 points
4) 3000 or more—120 points Bonus points are scored in the following ways:

1) Natural Canasta—500 points
2) Mixed Canasta—300 points
3) Going Out—100 points
4) Concealed Going Out Out—100 extra points Winning—The partnership that reaches 5000 first is the successful partnership.

Variations: 1) The top card on the discard pile cannot be taken to lay on a player's canasta even if the deck is not frozen.

2) A player must have two natural cards to match with the top card of the discard pile. (i.e. a player cannot have a natural and a wild card)

Progressive Rummy

Players—This game is designed for two to four players.

Object—Players try to meld their cards before any other players.

Deck—Two standard 28 card domino playing card decks should be used for two or three players and three decks should be used for four players.

Deal—The first hand the dealer deals each player three cards. The second hand the dealer deals each player six cards. The third hand the dealer deals each player nine cards. The fourth hand the dealer deals each player twelve cards. The rest of the cards are placed face-down in the middle of the table to form the stock. The top card is flipped to start a discard pile.

Play—Players try to meld their cards. A turn is started by drawing a card from the stock or the discard pile. The first hand, each meld must be three of a kind (i.e. three cards of the same suit). The second hand each player must meld three of a kind and a run of three in a particular suit. The third hand each player must meld three of a kind, a run of three in a particular suit and a run of three formed by taking one number off of each card. The fourth hand each player must meld three of a kind, a run of three in a particular suit, a run of three formed by taking one number off of each card, and a run formed by using the sum of the spots on each card. Each meld can be laid down at a different time. If stock runs out, the discard pile can be shuffled and reused.

Scoring—When a player melds their cards and goes out, the other players must total the spots on their cards and the player that went out scores the total of everyone's hands.

Winning—The player with the highest score at the conclusion of the four hands is the winner.

Forty-Two

Players—This game is designed for four players who play in partnership. Partners should sit across the table from one another.

Object—Players try to score points by winning tricks.

Deck—A standard 28 card domino playing card deck is used.

Deal—The dealer deals each player seven cards.

Bidding—A player bids as to the number of trick points that player plans to take. The player that has the 1:0 has the opportunity to bid or pass first and the bid passes around the table in a clockwise direction. The minimum bid is 30 points. Each player only has the opportunity to bid once and each bid must be greater than the preceding bid.

Play—The highest bidder calls the trump suit. The bidder leads the first trick. A player who leads a trick calls the suit.

Players must follow suit if possible even if the other number on the card is of the trump suit. In this case they are only following suit, not trumping. Players must trump if they cannot follow suit. A trick is won by the highest card of the suit played (double is always highest) or the highest trump card if trump was played. The player who takes a trick leads the next trick.

Scoring—The value of tricks is as follows:

1) one point for each trick taken
2) five points for taking the 5:0, 4:1 and the 3:2
3) ten points for taking the 5:5 and the 6:4

If a partnership takes at least as many trick points as they bid, they receive their trick points plus their bid. If a partnership doesn't take as many trick points as they bid, their opponents score the bid plus the number of trick points they have taken.

Winning—The partnership that has the most total points after a set number of hands wins.

Domino Bingo

Players—This game is designed for two players.

Object—Players try to score points by taking tricks.

Deck—A standard 28 card domino playing card deck is used.

Special Terms—The double zero is called bingo. It takes any other card.

Deal—The dealer deals each player seven cards. The next card is flipped to indicate trump. The number that is the farthest away from the dealer is trump.

Play—The non-dealer leads the first trick. The player who leads a trick calls the suit. Players don't have to follow suit as long as there are cards in the stock. After each trick, the player who took the trick draws a card and then the other player draws a card. A trick is won by the highest card of suit played (double is always highest) or the highest trump card if trump was played. The player who took a trick leads the next trick. Once stock runs out or the game has been closed, players must follow suit if possible even if the other number on the card is of the trump suit. In this case they are only following suit, not trumping. Players must trump if they cannot follow suit. If a player thinks they can make at least 70 points from tricks and doubles without drawing any more cards, the player can flip the face-up card and this closes the game. No more cards are drawn from the stock.

Scoring—The value of tricks is as follows:

1) double of trump—28 points
2) if zeros are trump, bingo—14 points
3) the 6:4—10 points
4) the 3:0—10 points
5) the doubles not of trump—total number of spots
6) trump other than the double—total number of spots The value of having more than one double in a player's hand at a time is as follows:

1) two doubles—20 points
2) three doubles—40 points
3) four doubles—50 points
4) five doubles—60 points
5) six doubles—70 points
6) seven doubles—210 points If bingo is one of the doubles, a player receives 10 extra points. In order for a player to claim these points, the player must play one of the doubles and show the other ones. The player must also take that trick.

Game points are scored in the following ways:

1) for every 70 points from tricks or doubles—1 game point
2) for being the first player to reach 70 points if the other player has more than 30 points—1 game point
3) for reaching 70 points after the other player has won a trick, but has not scored 30 points—2 game points
4) for reaching 70 points before the other player takes a trick—3 game points
5) for taking the double of trump with bingo—1 game point Winning—The player who scores seven game points first is the winner.

Description of Alternative Embodiments and Methods of Play—FIGS. 4 to 11

Figure 4:
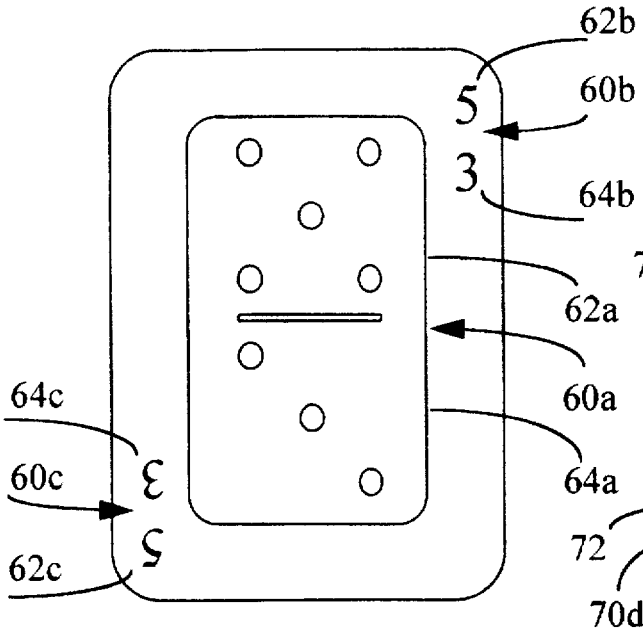
FIG. 4 is a view of an interchangeable suit card with a domino illustrated in plan view. This figure shows secondary indicia in non-standard corners (upper right and lower left.) This figure also shows a lower indicia that is in a direction opposed to the direction of the domino.

FIG. 4 shows an alternative embodiment. This embodiment shows a primary indicia 60a that is composed of a plan view illustration of a domino. Additionally, the card shows a secondary indicia **60*b* and a tertiary indicia 60*c*. The location of secondary indicia 60*b* and tertiary indicia 60*c* are in the opposite corners of standard playing cards. Each indicia is composed of a first value 62 and a second value 64. This embodiment shows one of the three indicia oriented in the opposite direction of the other two. In this example, first value 62*c* of tertiary indicia 60*c* is below its second value 64*c*, while first values 62*a* and 62*b* of primary indicia 60*a* and secondary indicia 60*b* respectively are above their second values 64*a* and 64*b***.

Figure 5:
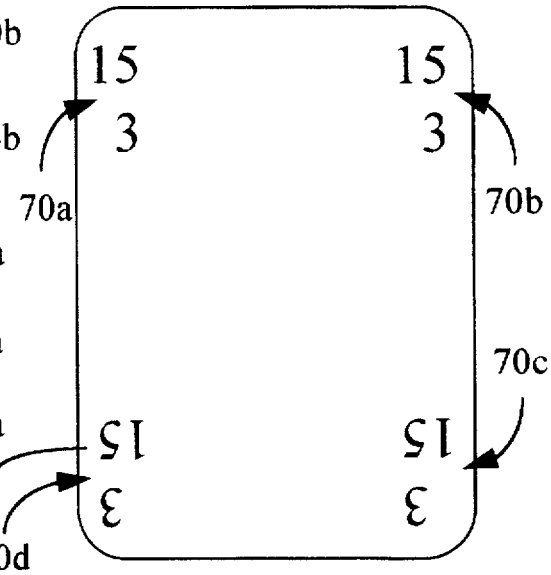
FIG. 5 is a view of an interchangeable suit card with indicia in all corners. This figure is not representative of a conventional domino.

FIG. 5 shows an alternative embodiment, where there is no primary indicia. This example does not have any illustration in the center of the card. However, a non-utilitarian design could be placed here. Alternatively, you could use a central design for another purpose. For example, the center designs could represent a standard 52-card deck of playing cards, cards for an associated board game, or cards for another new game. This card also shows four indicia 70*a*, 70*b*, 70*c*, and 70*d*. There is one indicia in each corner. This card also shows indicia that are not representative of any of the standard sets of dominoes. First value 72 of each indicia is outside the range of values for the standard sets of dominoes.

FIG. 6 is an alternative embodiment, where primary indicia 80*a* is a full-card size illustration of a domino. This figure also shows cards that each have a secondary indicia 80*b*. However, they do not possess a tertiary indicia.

FIG. 7 discloses a color coding method for the indicia of a domino playing card. First value 92*b* and second value 94*b* of secondary indicia 90*b* are color coded to coordinate with first value 92*a* and second value 94*a* of primary indicia 90*a*. In a first embodiment, all cards possessing a given value are coded with the same color for that value. In an alternative embodiment, a value could be coded with a first color on one domino and a second color on another domino.

FIG. 8 presents an interchangeable suit domino card with a secondary indicia 100*b* whose values are not represented with numerals. However, secondary indicia 100*b* and tertiary indicia 100*c* are representative of and have the same orientation as primary indicia 100*a*.

FIG. 9 shows an embodiment of an interchangeable suit card where the indicia are not representative of a conventional domino. This figure shows indicia with non-numeric values. Additionally, this figure discloses interchangeable suit cards with more than two suits. Indicia 110 is composed of a first value 112, a second value 114, and a third value 116. Any of these three values can be used as suits or ranks under the interchangeable suit method of play.

FIG. 10 discloses an interchangeable suit card with multiple suits. A primary indicia 120*a* on this card is representative of an unconventional four sided domino. Hence, the indicia on this card are composed of a first value 122, a second value 124, a third value 126, and a fourth value 128. This card shows a method of orienting a second indicia 120*b*, a third indicia 120*c*, a fourth indicia 120*d*, and a fifth indicia 120*e* on cards with four suits. This method provides that each of these secondary indicia is representative of the orientation of the values of primary indicia 120*a* relative to the given secondary indicia. FIG. 10 shows one method of orienting the values of the secondary indicia. Here the values are oriented such that when the card is held with a given indicia in the upper left corner, then the top value represents the top value on primary indicia 120*a* and each successive value represents the next value in primary indicia 120*a* when proceeding clockwise around the indicia. This method can easily be abstracted to any card with multiple suits, including the one shown in FIG. 9.

FIG. 11 shows one embodiment of a joker for the present invention. The indicia representing this joker has a first value 132 and a second value 134. In this example, both values are wild. Another embodiment might hold a first value strict and let a second value be wild. Alternatively, any number or the blank could be specified as wild by a particular game.

Several preferred methods of play are explained in the descriptions and operations sections above. These methods of play are described in relation to the preferred embodiment of the playing cards of the present invention. Those methods of play can be altered slightly for use with alternative embodiments described here. Additionally, it should be clear from the descriptions of the games above that there are other alternative methods of play.

Operation Alternative Embodiments—FIGS. 4 to 12

The scoring, strategy, and methods of play for the alternative embodiments here follows from the operation sections for the preferred embodiment. Some of the possible variations are included here.

FIG. 4 would suggest a method of holding the cards where they are overlapped in the opposite fashion as is shown in FIG. 6 (i.e. the card on top would be the leftmost card rather than the rightmost and each successive card would be offset to the right far enough to view the indicia in its upper right corner.)

These cards would not be as effective using the overlapping method shown in FIG. 12 for matching games. This is because tertiary indicia 60*c*, FIG. 4, is oriented in a direction opposed to primary indicia 60*a*. This prevents the player from placing the matching value from secondary indicia 60*b* and tertiary indicia 60*c* adjacent to their equivalent values on the cards they match. To make this point more clear it can be seen from the illustration that if the card is rotated 180 degrees then the top value in the upper right corner would still be a five. Therefore, if the player matches this card with another that has a value of three then the matching values on their secondary and tertiary indicia will not be adjacent. At least the five will be between them.

The method of play could still allow the cards to be overlapped. However, the players must disregard the secondary and tertiary indicia and consider only the primary indicia for the matching method of play. One indicia from the card should remain exposed so players can examine what has been played in the past.

These cards also do not lend themselves well to the method describe above under "Operation Interchangeable Suit Method of Play" for orienting your cards to indicate a chosen suit. Again this is because the visible indicia looks the same after rotating the card. However, the player could use the orientation of the primary indicia to indicate the chosen suit.

The cards illustrated in FIG. 5 can use basically the same methods of play as the preferred embodiment. However, certain embodiments do not directly allow the summation method of play. For example, both the double-9 and double-12 decks have an odd number of cards. This precludes the possibility of grouping the cards into pairs. To use the summation method of play with these cards the dealer must remove any unmatched cards.

The cards shown in FIG. 6 would require players to lay their cards end to end like tile dominoes under the matching method of play. All cards must be held in the method shown in FIG. 6 so that the single secondary indicia can be seen, clearly identifying the value of the card.

FIG. 7 shows color coded cards. This allows players to play matching dominoes or to follow suit in interchangeable suit and rank games simply by matching the colors on the cards. For example, instead of searching to match a five to a five they could compare color attempting to match a blue to a blue. In a first embodiment, the colors and values could be coordinated. This method would simply make play easier for players with strong color recognition skills. In an alternative embodiment the colors and values could be separate features. This would lead to several additional methods of play. For example, in matching games you may be allowed to match either the number or the color. The colors might indicate a tertiary suit or a required arithmetic operation.

The card shown in FIG. 8 can use basically the same methods of play as those of the preferred embodiment.

The cards disclosed in FIG. 9 allow the player to match the cards along three sides instead of two. Another embodiment for these cards may take the shape of primary indicia 110 (i.e., the cards themselves could be triangular.)

In interchangeable suit and rank play the player can select from more than two possible suits. A first method of selection might allow the player to use any one of the three values as the suit and either of the other values as the rank. In a second method of selection, the suit or rank may be formed by a combination of two of the values. In another method of play, the card can consist of two suits or ranks.

The card shown in FIG. 10 suggests the possibility of rotation by 90 degrees to indicate a selection of a suit and rank for the card. Each non-primary indicia is positioned and oriented in a method to depict its relationship to primary indicia 120*a*. Matching can be accomplished on all four sides of the card.

FIG. 11 shows a joker that could be added to a deck of cards of the preferred embodiment. In matching games a player can match a joker to any value. When the other end of the joker is also wild the player that laid it could call its value. An alternative method of play would allow the next player (that desired to use the open end) to set its value. In other games the player who plays the joker can set both its suit and rank.

An alternative embodiment for the joker may allow only one of the values to be wild. The method of play for this card would allow the player to match the wild end against any value. However, some games may require that if the card can be played against its fixed end that it must. For example, assume the layout was as shown in FIG. 12 and a player had a joker that was four at one end and wild at the other. A game may require that if the player lays this card they must do so by matching the four against the bottom of this layout (i.e., they cannot play the wild side against either the open four at the bottom or the three at the top of the layout.)

Other variations in play are apparent from reading the instructions of the games above and the ramifications below.

Conclusion, Ramifications, and Scope

Accordingly, the reader will see that the cards of the present invention, in their preferred embodiment, allow the practical and easy play of traditional domino games. They are representative of and can easily be substituted for a standard set of double-6, double-9 or double-12 dominoes. They provide for an easier method of holding the dominoes in your hand and for playing them.

These cards provide for easier play on smaller playing surfaces because the cards can be held in the hand, the stock can be stacked in a pile the area of a single card, the cards in the layout can be overlapped, and they can be stored in a standard playing card box. The cards are very portable and encourage players to take them with on vacation, to friends' houses, and to other gatherings.

The cards can be manufactured readily and inexpensively. They can be used with standard playing card accessories. The cards are not crowded with several different distracting indicia. They fit the norm of socially accepted standard playing cards.

They provide clear view and easy recognition of their value, especially for players with poor vision. They provide a numeric alternative to the typical domino indicia. Their secondary and tertiary indicia are located in positions that allow easy recognition when the cards are held in a typical fan-like fashion. The second and third indicia are oriented to be representative of the primary indicia. Therefore, when the card is rotated 180 degrees the values of the exposed indicia are inverted.

These cards can be shuffled easily by a single player without scratching the playing surface or causing as much wear or marking of the playing pieces. They reduce the chance of cheating on the draw and during play because of marked playing pieces. These cards provide for practical play by a larger number of players.

Additionally, these cards and the methods of play disclosed in the present invention allow a person to play standard games for 52-card decks. They provide for play of interchangeable suit or multiple denomination games. In this mode the cards provide a large proportion of high value cards. Thus increasing the perceived value of the cards, the potential for any given hand to win, and the excitement of play caused by these factors.

This method of play allows a single indicia to represent multiple denominations. This and the location of the indicia make it possible to easily recognize all of the cards' denominations when they are held in the typical fan-like fashion. The location and orientation of indicia also allow players to select and set an indication of what denomination they choose for a card at the beginning of play. Methods of play are also described to allow players to choose a card's denomination at the time they play it Aspects of the indicia and other factors make it more difficult to remember what has been played earlier in a hand. All of these factors also increase the role of chance throughout the play.

These cards and the methods of play allow people to play many games more quickly. This increases the number of games you can play, which in turn increases a given players chance of winning games.

The disclosed cards and methods of play can help stimulate the learning of arithmetic through the playing of games. The cards also facilitate the play of new forms of games requiring the formation of sequences or the matching of values.

While my above description contains many specific details, these should not be construed as limitations on the scope of the invention, but rather as an exemplification of one preferred embodiment thereof. Many other variations are possible. For example, the playing pieces could be blocks, or computer generated playing cards or pieces; the playing cards and or indicia could have other shapes, such as triangular or hexagonal; the indicia could be illustrations of animals; the bottom value of each indicia could additionally be placed to the right of the top value to allow an in-hand arrangement that makes it easier to recognize matching type runs, in games such as a variation of rummy; arithmetic games could be based on the difference or product of the values of an indicia; there could be a double-14 deck of cards; some games could be played with multiple decks or fractions of a deck; the described methods of play and games could be played with tile pieces; tile pieces could possess numeric indicia; etc.

Thus the scope of the invention should not be determined by the embodiments illustrated.

I claim:

1. A method of playing cards, the playing cards used by two or more card players, the playing cards having a front side and a back side, the front side of the playing cards having a playing face, the playing cards having a first indicia disposed in an upper left hand corner of the playing face of the front side of each playing card, the first indicia having a first value and a second value, the playing cards having a second indicia disposed in the lower right hand corner of the playing face of the front side of each playing card, the second indicia having a first value and a second value, the first value of the second indicia the same as the first value of said first indicia, the second value of the second indicia the same as the second value of said first indicia, the playing steps comprising:

selecting either the first value or the second value on a playing card as a suit, the unselected value added with unmatched values on other playing cards;

matching the selected suit on the playing card with other playing cards having the same suit on a playing surface; and taking other playing cards with the playing card by adding the unselected value on the playing card with the unmatched values on the other playing cards, the sum of the unselected value and the unmatched values having a sum of a certain multiple.

2. The method of play as described in claim 1 wherein the first value and the second value of said first and said second indicia are numeric.

3. The method of play as described in claim 1 wherein the sum of the certain multiple is a multiple of 5.

4. The method of play as described in claim 1 wherein the first value and the second value of said first and said second indicia have a numeric value in a range of "0" to "6".

5. The method of play as described in claim 1 further including the step of determining a score for the card players, one component of the score being based on the number of cards the card players took having certain suits.

6. The method of play as described in claim 1 further including the step of determining a score for the card players, one component of the score being based on the number of times the card players took all of the other cards on the playing surface.

7. A method of playing cards, the playing cards used by two or more card players, the playing cards having a front side and a back side, the front side of the playing cards having a playing face, the playing cards having a first indicia disposed in an upper left hand corner of the playing face of the front side of each playing card, the first indicia having a first value and a second value, the playing cards having a second indicia disposed in the lower right hand corner of the playing face of the front side of each playing card, the second indicia having a first value and a second value, the first value of the second indicia the same as the first value of said first indicia, the second value of the second indicia the same as the second value of said first indicia, the playing steps comprising:

selecting either the first value or the second value on a playing card as a suit;

matching the selected suit on the playing card with other playing cards having the same suit; and combining the unselected value with unmatched values on the other playing cards, whereby the combination of unselected values satisfies a predetermined arithmetic function.

8. The method of play as described in claim 7 wherein the first value and the second value of said first and said second indicia are numeric.

9. The method of play as described in claim 7 wherein the first value and the second value of said first and said second indicia have a numeric value in a range of "0" to "6".

10. The method of play as described in claim 7 wherein the first value of said first indicia is positioned above the second value of said first indicia and wherein the first value of said second indicia is positioned above the second value of said second indicia.

11. The method of play as described in claim 10 wherein the first value and the second value of said first and said second indicia are numeric.

12. The method of play as described in claim 10 wherein the first value and the second value of said first and said second indicia have a numeric value in a range of "0" to "6".

13. The method of play as described in claim 10 further including the step of rotating the card to position the selected value in a particular location relative to the unselected value.

14. The method of play as described in claim 13 wherein the first value and the second value of said first and said second indicia are numeric.

15. The method of play as described in claim 13 wherein the first value and the second value of said first and said second indicia have a numeric value in a range of "0" to "6".

* * * * *